US005429655A

United States Patent [19]

Ogura et al.

[11] Patent Number: 5,429,655

[45] Date of Patent: Jul. 4, 1995

[54] SYSTEM FOR REMOVING NON-METALLIC FOREIGN MATTER IN MOLTEN METAL

[75] Inventors: Shigeru Ogura; Masayuki Onishi; Hidenari Kitaoka; Mitsuru Sakurai; Toshikazu Sakuraya; Yozo Tanino; Tsukasa Terashima; Yoshiro Tomiyama; Yuki Nabeshima; Yuji Miki; Saburo Moriwaki; Noboru Yasukawa, all of Chiba, Japan

[73] Assignee: Kawasaki Steel Corporation, Japan

[21] Appl. No.: 952,891

[22] PCT Filed: Mar. 27, 1992

[86] PCT No.: PCT/JP92/00388

§ 371 Date: Nov. 20, 1992

§ 102(e) Date: Nov. 20, 1992

[87] PCT Pub. No.: WO92/17295

PCT Pub. Date: Oct. 15, 1992

[30] Foreign Application Priority Data

| | | | |
|---|---|---|---|
| Mar. 27, 1991 | [JP] | Japan | 3-063401 |
| Mar. 29, 1991 | [JP] | Japan | 3-066390 |
| Apr. 12, 1991 | [JP] | Japan | 3-079522 |
| Apr. 18, 1991 | [JP] | Japan | 3-086654 |
| Apr. 22, 1991 | [JP] | Japan | 3-090279 |
| Apr. 24, 1991 | [JP] | Japan | 3-093990 |
| Apr. 30, 1991 | [JP] | Japan | 3-099097 |
| Apr. 30, 1991 | [JP] | Japan | 3-099098 |
| Apr. 30, 1991 | [JP] | Japan | 3-099099 |
| Apr. 30, 1991 | [JP] | Japan | 3-099180 |
| May 21, 1991 | [JP] | Japan | 3-116162 |

[51] Int. Cl.[6] ..... B22D 41/005

[52] U.S. Cl. ..... 75/10.61; 266/234; 266/237; 266/275

[58] Field of Search ..... 266/234, 237, 275; 75/10.16

[56] References Cited

U.S. PATENT DOCUMENTS

| | | | |
|---|---|---|---|
| 3,709,476 | 1/1973 | Hammarlund et al. | 266/234 |
| 5,106,411 | 4/1992 | Miki et al. | 266/234 |

FOREIGN PATENT DOCUMENTS

| | | | |
|---|---|---|---|
| 0109638 | 3/1940 | Australia | 266/234 |
| 0022317 | 2/1983 | Japan | 266/234 |
| 0029975 | 2/1984 | Japan | 266/234 |
| 1087812 | 5/1986 | Japan | 266/234 |
| 1-40155 | 2/1989 | Japan . | |

*Primary Examiner*—Scott Kastler

*Attorney, Agent, or Firm*—Austin R. Miller

[57] ABSTRACT

An apparatus for removing non-metallic foreign matter in a molten steel includes a tundish and a coil device. The tundish is an intermediate container receiving the molten steel from a ladle and feeding a purified molten steel by removing the non-metallic foreign matter in the molten steel. For removing the non-metallic foreign matter, the tundish has a swirl flow bath and a floatation bath. In the circumference of the swirl flow bath of the tundish, a coil device is arranged for flowing the molten steel in the swirl flow bath in swirl fashion. The tundish and the coil device are formed separately and constructed for relative movement to each other. The molten steel in the swirl flow bath of the tundish is flown in swirl fashion in the horizontal direction by a magnetic field generated by the coil device. At this time, the molten steel forms a parabolic concaved surface. The non-metallic foreign matter in the molten steel is forcedly floated up on the parabolic surface portion of the molten steel, which is removed by an appropriate means. The molten steel thus purified flows into the floatation bath from the swirl flow bath. With the static flow in the floatation bath, the residual non-metallic foreign matter floats up. The purified molten steel is poured into the mold through the bottom of the floatation bath.

26 Claims, 38 Drawing Sheets

SYSTEM FOR REMOVING NON-METALLIC FOREIGN MATTER IN MOLTEN METAL

FIELD OF THE INVENTION

The present invention relates to a system for removing non-metallic foreign matter in a molten metal, which includes a tundish, an electromagnetic coil for generating a shifting field, a moving apparatus therefor, and an operation method, in steel continuous casting facilities and so forth.

BACKGROUND ART

In a production technology for high quality sheets, removal of non-metallic foreign matter or impurity during the molten steel state is critical for determining fraction defective of the products. It is recent trend in molten steel purification technologies, (1) to increase size of an intermediate container, i.e. tundish, between a ladle and a mold in a continuous casting to prolong a period to maintain the molten steel in the tundish with the expected floating up of the foreign matter;

(2) to provide gates in multi-stages in the tundish for controlling flowing route of the molten steel to prolong period to maintain the molten steel in the tundish; and (3) in the mold, to prevent mold powder generated by molten steel flow from a discharge opening of a nozzle from penetrating by modifying configuration of an immersion nozzle to control flow of the molten steel within the mold.

However, with these methods, satisfactory improvement of the quality cannot be obtained. Particularly, the quality at the non-steady pouring, so-called as ladle exchange, is a level creating a problem. Therefore, methods are disclosed in Japanese Unexamined Patent Publications (Kokai) Nos. 58-22317, 55-107743, 01-312024 and 02-217430, to generate a horizontal swirl flow of the molten metal to float up the foreign matter. This technology provides centrifugal force by horizontal rotation to the molten metal and the non-metallic foreign matter so as to concentrate the non-metallic foreign matter toward the swirl center due to difference of specific weights to separate by promoting collision, absorption and aggregation. This technology can achieve an improvement in the foreign matter separation effect in comparison with the methods simply prolonging dwell period or controlling molten steel flow path in the tundish. In other words, when an equal separation capacity is required, the last-mentioned method may provide an advantage in significant reduction of the size of the tundish.

On the other hand, the technology disclosed in Japanese Unexamined Patent Publication No. 58-22317 simply provides a rotational force generating apparatus outside of the tundish. On the other hand, the technologies disclosed in Japanese Unexamined Patent Publications Nos. 55-107743, 01-312024 or 02-217430, simply provide energization coils in the outer circumferences of the tundishes, and do not disclose concrete facility construction. Accordingly, if such technologies are applied, a problem is encountered in restriction for attaching and detaching power source cables, cooling water paths upon moving the tundish for the repairing or so forth, the magnitude of movement of which can be substantial, because the rotational force generating apparatus or the energization coil have to be moved therewith.

Especially, in case of the apparatus for electromagnetically providing rotational force (energization coil), connection of the cable is a labor intensive operation, and the operation is very difficult. On the other hand, they may provide an advantage to permit preliminary adjustment of positional relationship between the tundish and the coil. However, the above-mentioned problem is much more critical.

On the other hand, the above-mentioned method for purifying the molten steel employing horizontal swirl flow as disclosed in Japanese Unexamined Patent Publications 58-22317 or 55-107743, the following problems can be encountered.

(1) When the molten steel is horizontally rotated, the outer circumferential portion of the molten steel proturburates in parabolic fashion, the height of which is proportional to square of the radius and rotation speed Therefore, increasing of the radius results in substantial increase of the height of the facility. In addition, in order to drive all of the molten steel for horizontal rotation, substantially large electromagnetic coil is required which increases cost for the facility making it impractical.

(2) Reduction of rotational radius may be desirable in view of the requirements for the facility. However, reduction of the capacity Of the tundish may make it impossible to accomplish the buffer function for realizing ladle replacing.

(3) Due to penetration of air into the molten metal resulting from swirl flow, air oxidation of the upper surface of the molten metal or melting of refractory will be simultaneously progressed to abruptly increase the non-metallic foreign matter generated in the container and to flow out the large size non-metallic foreign matter. As a solution to this, it becomes necessary to use expensive refractory having high wear resistance in the overall area of the container and to seal the overall container with gas or so forth, causing increased cost.

On the other hand, as set forth above, in the continuous casting of the molten metal, there have been proposed means for concentrating the non-metallic foreign matter toward the rotation center for separation by rotating the molten metal in the horizontal direction and by utilizing the difference of the centrifugal forces resulting from the difference of densities between the molten metal and slag (see Japanese Unexamined Patent Publication No. 55-107743), or means for separating the non-metallic foreign matter by natural floating up after horizontal rotation (see Japanese Unexamined Patent Publication No. 01-312024).

However, in either case, a molten metal circulating bath 54*a* of a tundish 54 is positioned in the vicinity of a ladle nozzle 53 so that the ladle nozzle 53 is submerged within the rotating molten metal, as shown in FIGS. 34 and 35. Therefore, the ladle nozzle 53 may be subject to melting or breakage due to the force resulting from flow velocity of the molten metal 51. In FIG. 34, 58 denotes a tundish nozzle, 59 denotes a mold, and 60 denotes a cast block.

In addition, the method of purifying the molten steel employing the horizontal swirl flow as set forth above, further holds the following problems.

(4) If the molten steel removed from the foreign matter by horizontal swirl flow is simply discharged from the portion of the bottom of a rotary bath in the vicinity of the swirl center of the molten steel, the foreign matter separation effect can be degraded when the molten steel level in the tundish is lowered.

(5) Particularly, in the case that the molten steel is directly poured to the mold from the bottom, namely the bottom surface of the refractory of the rotary bath, it is difficult to obtain a high foreign matter separation effect in the overall range of pouring.

This is the same either in the case that the pouring is performed from the rotary bath directly to the mold or in the case that the pouring is performed from the rotary bath to the mold via a floatation bath (distribution path).

On the other hand, a carbon steel is typically used for the tundish, and, in particular, an austenitic stainless steel is used for suppressing attenuation of magnetic field when a static magnetic field is applied (see Japanese Unexamined Patent Publication Nos. 1-279706, 2-217430 and 1-312024).

When a shifting field is applied to the tundish, and if the material of the container member of the tundish is the carbon steel, the magnetic field is attenuated so that the magnetic field cannot be effectively applied to the molten steel within the tundish.

Also, when the container member of the tundish is stainless steel, although attenuation of the magnetic field will not be caused, an eddy current may be generated within the tundish container member in the shifting field. Therefore, a force to move the container is generated to cause vibration of the overall container.

On the other hand, as set forth above, as a method for preventing lowering of the temperature of the molten steel in the tundish and separating the foreign matter by floating up at the center of the tundish with the difference of the centrifugal force resulting from rotational force exerted on the molten steel, apparatus disclosed in Japanese Unexamined Patent Publication No. 01-245019 and illustrated in FIGS. 45 and 46 are proposed by the owner of the present invention. The feature of the apparatus illustrated in FIGS. 45 and 46 resides in a solenoid coil 92 provided around a tundish 91 for heating, and a shifting field generating coil 93 providing stirring.

This apparatus will not create any problem when heating and rotating stirring independently, but will create problems when both are operated simultaneously.

In FIGS. 45 and 46, flow patterns of the molten steel generated in a molten steel 94 when the heating solenoid coil 92 and the stirring shifting field generating coil 93 are operated simultaneously.

The flow pattern of the molten steel 94 generated by the heating solenoid coil 92 is similar to the case of a crucible induction furnace as illustrated in "Industrial Electric Heating", published by Foundation of Energy Saving Center, pp 110, FIG. 4.23, in which reversing flow in vertical direction is formed about the solenoid coil 92.

On the other hand, the flow pattern of the molten steel generated by the shifting field generating coil 93 for rotating stirring is swirl flow 96 in the horizontal direction.

Accordingly when the heating coil 92 and the stirring coil 93 are operated simultaneously, the swirl flow 96 in the horizontal direction for separating the foreign matter is disturbed by the vertical reversing flow generated by the operation of the heating coil 92. As a result, the swirl flow 95 in the horizontal direction is weakened to lower the performance for separating the foreign matter.

On the other hand, as set forth above, a technology for separating the foreign matter in the tundish of the continuous casting facility by floating up, which can be an important point in determining the quality of the product, has been disclosed in Japanese Unexamined Patent Publication No. 1-312024. Namely, it can employ a method, in which, as shown in FIGS. 49 and 50, in a rectangular shape tundish 110, a semi-cylindrical coil device 101 for generating a shifting field is provided on the outer periphery of a swirl flow bath 110*a* as a bath for pouring the molten steel from a ladle 105 for stirring molten steel 106 in the above-mentioned bath 110*a* to float up the foreign matter having small specific weight with the centrifugal force. 102 denotes a molten steel path, 103 denotes an iron skin, 104 denotes a refractory, 107 denotes a submerged nozzle of a ladle, 108 denotes a submerged nozzle of the tundish, 109 denotes an arrow indicating rotating direction of the molten steel, and 110*b* is a distributing bath.

With this arrangement, when swirl flow 109 is generated in the molten steel 106, the swirling molten steel surface 106*a* becomes a concaved surface depending upon the rotation speed as illustrated in FIG. 48. 106*b* denotes a static molten steel surface. The depth Z(m) of the concaved surface shown in FIG. 48 can be expressed by the following equation, assuming the rotation speed of the molten steel is N (r.p.m.), a rotation radius is r(m) and the gravity weight is g:

$$N = \frac{30\sqrt{2gZ}}{\pi r} \tag{1}$$

As a problem to be created by causing swirling surface 106*a* (concaved surface) of the molten steel, defects in that the excessive length of the submerged nozzle 107 for pouring the molten steel 106 from the ladle 105 without causing oxidation is required which raises the cost for the nozzle and in that possibility of causing breakage due to thermal impact and so forth is increased.

In addition, by formation of the concaved surface, the area of the molten steel surface 106*a* is increased to cause a problem in promoting oxidation of the molten steel surface 106*a*.

On the other hand, in the example of FIGS. 49 and 50, since the configuration of the tundish 110 is specified, sufficient rotational force can be obtained with the shifting field generated by the semi-cylindrical coil device 101. However, the configuration of the tundish is not limited to the configuration illustrated in FIGS. 49 and 50, and can be of the configurations as illustrated in FIGS. 53 and 54.

When the coil device 101 is provided for applying the rotational force for the molten steel in the swirl flow bath 110*a* of the tundish 110 in the configuration as illustrated in FIGS. 53 and 54, since the outer periphery of the swirl flow bath 110*a* is divided into two sections by the distribution bath 110*b* at both sides in either case, each coil device 101*a*, 101*b*, 101*c* and 101*d* can not cover the 180° of angular range of the swirl flow bath 110*a*.

Here, discussion will be given for the principle of application of the rotational force for the molten steel with the shifting field in terms of the linear type shifting field generating coil device shown in FIG. 55. The coil generally has two poles so that a magnetic flux 113 flows from an electrode 111 to an electrode 112. 114 denotes an iron core and 115 denotes a winding coil. An eddy current generated by the shifting field is caused in the direction perpendicular to the paper surface. Then, on the molten steel 106, a force 118 in the horizontal direction, which is directed in the shifting direction of the shifting field and a depression force 119 in a direction perpendicular to the shifting direction are exerted. The component of magnetic flux density for generating the force 118 in the horizontal direction is the component 120 in the perpendicular direction to the molten steel 106.

Accordingly, in order to provide effective rotational force for the molten steel 106 by the shifting field, it is necessary to make the magnetic flux density component 120 in the perpendicular direction to the molten steel 106. In order to increase this component, it is generally required to enlarge a pole pitch 121 (in case of the coil having two poles, one half of a coil length 122) of the shifting filed generating coil device and thus to increase the coil length 122.

In case of the coil arrangement as illustrated in FIG. 55, since the length 122 of the coil device is shorter than the arrangement illustrated in FIGS. 49 and 50 as set forth above, the magnetic flux density component 120 in the perpendicular direction to the molten steel 106 becomes smaller. Therefore, the rotational force to be exerted on the molten steel 106 becomes smaller to make it difficult to separate the foreign matter from the molten steel 106.

On the other hand, in the above-mentioned Japanese Unexamined Patent Publications Nos. 01-312024 and 02-217430, the outer shell of the coil device is formed of a metal having small magnetic loss, such as an austenitic stainless steel or so forth, which outer shell is arranged in direct opposition to the molten metal container. The coil device has a coil body 151 within a casing 152 as shown in FIG. 57, for example. The casing 152 is formed of a metal.

Besides, in the method employing a conductive body, such as the metal, for forming the casing of the coil device, the eddy current can be generated within the casing member to cause heat generation to create problems of lowering of strength of the casing or burning out of the coil body within the casing.

On the other hand, when the metal casing of the above-mentioned coil device is exposed, the heat radiated from the tundish of the molten metal is directly received by the metal casing of the coil device to cause failure of the coil device. In addition, when the molten metal overflows from the tundish for the molter, metal, it may cause a problem of melting off of the coil device.

On the other hand, when the coil device is arranged in the close proximity of the circumference of the molten metal container as set forth above, problems of lowering of the casing and lowering of the performance of the coil device due to direct transmission of the radiation heat from the molten metal container, and of rising of the temperature of the molten metal container member for causing lowering of the strength, can be encountered.

Furthermore, as set forth above, as a known method for avoiding penetration of the non-metallic foreign matter into the metal during casting of the molten metal, a method applying a rotational force with a magnetic force for separating and removing non-metallic foreign matter in the tundish and so forth, in order to prevent the non-metallic foreign matter from being entangled in the molten metal flow shorting to a discharge outlet and having high flow velocity (see Japanese Unexamined Patent Publication No. 58-22317).

On the other hand, at the inlet for the container, in view of avoiding striking in of the oxide covering the molten metal surface into the molten metal, a pouring method employing a nozzle submerging the tip end thereof into the molten metal as shown in FIG. 62 is generally employed. In FIG. 62, 181 denotes a molten metal, 182 denotes a ladle, 183*a* denotes a long nozzle, 184 denotes a tundish, 186 denotes a submerged nozzle, 188 denotes an upper lid, and 193 denotes a gate.

However, the swirling molten metal forms the concave at the swirl center, when the nozzle is submerged to the swirl center, if the length of the nozzle 183*a* is excessive in the extent to reach the bottom of the container, it causes increasing of the cost for the refractory and difficulty in maintaining strength. When the nozzle is submerged at the position offset from the swirl center for avoiding the foregoing problem, a possibility of damaging of the nozzle due to rotational force of the molten metal cannot be ignored.

Namely, as exemplarily illustrated in FIG. 63, in the pouring of the molten metal without using the submerged nozzle, a seal pipe 194 used for the purpose of protecting the poured molten metal stream from air oxidation generally, is provided with a diameter four to five or more times greater than the ladle nozzle in view of reduction of the cross-sectional area due to metal splashing. Therefore, upon replacing of the ladle, an opening to communicate with the atmospheric air becomes large to permit air to be contained within the container. The increased oxygen and nitrogen concentration in the container may encounter a problem of degradation of the quality of the cast block at the non-steady state portion, Also, even at the steady state portion, since there are a lot of portions requiring a seal between the ladle and the seal pipe, the seal can becomes incomplete even if the inert gas introduction pipe 189 is provided to similarly cause the problem of penetration of the air.

In addition, an apparatus disclosed in Japanese Unexamined Patent Publication No. 1-278706 is illustrated in FIG. 67, in which the centrifugal force is exerted on the molten steel by applying the horizontal rotational force to the molten steel in the tundish for floating up and separating the foreign matter in the molten steel to the tundish center with the concentric force due to difference of the specific weight. For the molten metal 207 poured through the nozzle 202 from the ladle 201 to the tundish 203 is generated the horizontal swirl flow 206 by the shifting field generating coil 209 to float up and separate the foreign matter and to extract a purified steel via a tundish nozzle at a position offset from the swirl center of the molten steel 207.

In the conventional method illustrated in FIG. 67, the molten steel 207 in the tundish 203 can be provided with a lid thereon for preventing the air from penetrating as much as possible so as to avoid re-oxidation due to contacting with the air and for preventing splashing upon pouring.

In the construction of the conventional apparatus as illustrated in FIG. 67, it is not only difficult to determine the swirling state of the molten steel 207 in the tundish 203 but also is impossible to control the floating state of the foreign matter by providing proper rotational force at respective process state in a sequence of operation pattern (e.g. initial state of casting, steady state period, ladle replacing state) in the continuous casting facility.

It is a primary object of the present invention to solve the problems in the prior art set forth above and to provide a tundish moving apparatus for a continuous casting of a steel in which has the tundish and the associated facilities allow replacing and repairing of the tundish without being constrained by a power source cable for an energization coil for rotating the molten steel in the tundish, or the cooling water, and the associated facilities thereof.

Also, it is another object of the present invention to provide a tundish moving apparatus for a continuous casting of a steel with a construction, in which a coil is preliminarily installed in a moving table (normally called a tundish car) for moving the tundish, and to receive a detachable tundish in opposition to the coil, and the positioning of the molten steel swirl flow portion in the tundish and the coil opposing to the side wall of the former.

A further object of the invention is to solve the problems set forth above and to provide an apparatus for removing non-metallic foreign matter in a molten metal for effectively and economically realizing separation and removal of the non-metallic foreign matter in the molten metal.

A still further object of the invention is to solve the foregoing problems and to provide a tundish for continuous casting for efficiently separating a slag in the molten metal of from small size to large size.

A yet further object of the invention is to solve the foregoing problems and to provide an apparatus for removing non-metallic foreign matter in a molten metal for effectively realizing separation and removal of the foreign matter in the molten steel either at replacing of a ladle or at a steady state.

A still further object of the invention is to solve the above-mentioned problems and to provide a vibration suppressive tundish for separating and removing non-metallic foreign matter in a molten metal.

A yet further object of the invention is to provide a non-metallic foreign matter removing apparatus for a molten metal which prevents vertical reversing flow from being generated even when a heating coil is actuated and thus certainly maintain a function for separating the foreign matter.

A yet further object of the invention to solve the foregoing problems and to provide a tundish which includes a shifting field generating coil device which can avoid oxidation of a molten steel and certainly maintain a foreign matter separating function.

A yet further object of the invention is to provide a tundish which has a shifting field generating coil device which enhances rotational stirring of a molten steel in the tundish for improving a separation effect of foreign matter in the molten steel.

A still further object of the invention is solve the above-mentioned problem and to provide a shifting field generating electromagnetic coil device with enhanced heat insulation or refractoriness.

A yet further object of the invention is to solve the foregoing problems and to provide a shifting field generating coil device which can avoid lowering of performance or burning of the coil.

A yet further object of the invention is to solve the problem and to provide a non-metallic foreign matter removing apparatus for a molten metal which has a device for promoting heat radiation.

Another object of the invention is to overcome the problems set forth above and to provide a casting method, in which can restrict non-metallic foreign matter to be introduced into a tundish from a ladle and stably perform casting by employing means for actively promoting separation and removal of the non-metallic foreign matter in the tundish, and whereby obtain high quality cast block.

A further object of the invention is to solve the foregoing problems and to provide a processing method of a molten steel in a tundish which can provide proper rotational force at respective operation stage in a molten steel processing in the tundish.

DISCLOSURE OF THE INVENTION

In order to accomplish the first object of the invention, a tundish moving apparatus for continuous casting of a steel, according to the first aspect of the invention, comprises a movable tundish having a swirl flow bath and a coil, the coil and the swirl flow bath of the tundish being movable relative to each other for opposing in close proximity to each other.

Here, in is preferred that the tundish is moved by a traveling or pivoting means. On the other hand, it is also preferred that the coil is movable by means of a lifting means or by means of a traveling or pivoting means.

In order to accomplish the above-mentioned second object, a tundish moving apparatus for continuous casting of a steel, according to the second aspect of the invention, comprises a movable base, a tundish mounted at a predetermined position on the movable base and having a swirl flow bath, a coil mounted on the movable base for relative movement for opposing in close proximity to a side wall of the swirl flow bath of the tundish, and a power supply means for the coil.

Here, it is preferred that the tundish moving apparatus for further comprises a guide for positioning the tundish and the coil at predetermined positions.

According to the third aspect of the invention, an apparatus for removing a non-metallic foreign matter in a molten metal, in which horizontal swirl flow is provided for the molten metal for separating and removing the non-metallic foreign matter in the molten metal, comprises a swirl flow bath receiving the molten metal and flowing the molten metal in horizontal swirl fashion, and a floatation bath provided with a flowing out opening in communication with the swirl flow bath and floating up the non-metallic foreign matter in the molten metal, the swirl flow bath having a dimension satisfying $$h \geqq 0.47 \times q^{\frac{1}{3}} \quad (1)$$

$$t_m \geqq 2 \quad (2)$$

h: minimum molten steel level in the swirl flow bath (m);

q: molten steel flowing out amount from the floatation bath (ton/min); and $t_m$: average dwell period of the molten steel in the swirl flow bath (min).

Also, according to the present invention, an apparatus for removing a non-metallic foreign matter in a molten metal, in which horizontal swirl flow is provided for the molten metal for separating and removing the non-metallic foreign matter in the molten metal, comprises a swirl flow bath receiving the molten metal and flowing the molten metal in horizontal swirl fashion, and a floatation bath provided with a flowing out opening in communication with the swirl flow bath and floating up the non-metallic foreign matter in the molten metal, the swirl flow bath and the floatation bath having a dimensions determined based on h derived satisfying $$h = \frac{q \times t_m}{\rho \times \pi \times r^2} - \frac{(r \times \omega)^2}{4g} \quad (3)$$

$$H = \frac{q \times t_c}{\rho(a \times b + \pi \times r^2)} + \frac{(r \times \omega)^2}{4g} + \frac{q \times t_m}{\rho \times \pi \times r^2} \quad (4)$$

h: minimum molten steel level in the swirl flow bath (m);

H: maximum molten steel level in the swirl flow bath (m);

q: molten steel flowing out amount from the floatation bath (ton/min);

$t_m$: average dwell period of the molten steel in the swirl flow bath (min);

$\rho$: specific weight of the molten steel (ton/m$^3$);

r: radius of the swirl flow bath (m);

$\omega$: horizontal rotation speed in the swirl flow bath (rad/min);

g: acceleration of gravity (m/min$^2$)

$t_c$: maximum interrupting period of pouring to the swirl flow bath (min)

a: vertical dimension of the floatation bath (m); and b: lateral dimension of the floatation bath (m).

Furthermore, according to the present invention, a tundish for continuous casting of a molten metal comprises at least a receptacle bath and a swirl flow bath, the molten metal in the swirl flow bath being flown in swirl fashion by a coil, and a partitioning wall having a communication opening at the lower portion thereof being arranged between the receptacle bath and the swirl flow bath.

Also, according to the present invention, a tundish for continuous casting of a molten metal comprises at least a receptacle bath, a swirl flow bath and a flowing out bath, the molten metal in the swirl flow bath being flown in swirl fashion by a coil, the swirl flow bath being provided between the receptacle bath and the flowing out bath, and partitioning walls, each having a communication opening at the lower portion thereof, being arranged between the receptacle bath and the swirl flow bath and between the swirl flow bath and the flowing out bath.

Here, the flowing out bath preferably has a plurality of discharge openings.

Furthermore, according to the present invention, an apparatus for removing a non-metallic foreign matter in a molten metal for separating and removing the non-metallic foreign matter from the molten metal by providing horizontal swirl flow for the molten metal, comprises a swirl flow bath receiving the molten metal and flowing the molten metal in swirl fashion, a floatation bath having flowing out opening in communication with the swirl flow bath and floating up the non-metallic foreign matter in the molten metal, a baffling wall being provided immediately below a partitioning wall separating the swirl flow bath and the floatation bath or projected from the bottom wall at the side of the floatation bath.

Also, according to the present invention, a vibration suppressive tundish assembly has at least a swirl flow bath and flowing a molten metal in the swirl flow bath in swirl fashion by a coil, wherein a member of the swirl flow bath of the tundish in an electromagnetic range applied by the coil is formed of a non-conductive body.

Here, the member formed of the non-conductive body is preferably reinforced by a reinforcement material.

Also, the reinforcement material is preferably an iron reinforcement or carbon fiber.

Furthermore, according to the present invention, an apparatus for removing a non-metallic foreign matter in a molten metal comprises a tundish having at least a swirl flow bath for providing horizontal swirl flow for the molten metal to remove the non-metallic foreign matter from the molten metal, and a plurality of channels of shifting field generation coils arranged vertically in opposition to the circumference of the tundish, the upper channel and lower channel coils being variable of frequency and/or current to be applied thereto.

Also, according to the present invention, a tundish assembly comprises a tundish having at least a swirl flow bath for providing horizontal swirl flow for the molten metal to remove the non-metallic foreign matter from the molten metal, a plurality of channels of shifting field generation coils arranged vertically in opposition to the circumference of the tundish, and a control device therefor, current, frequency or polarity to be applied to the coils being variable so that the rotation speed of the molten metal by the upper coil being at least lower than the rotation speed of the molten metal by the lower coil.

Yet further, according to the present invention, a tundish assembly comprises a tundish having a swirl flow bath and floatation baths at both sides of the swirl flow bath and a coil device arranged in opposition to the outer periphery of the swirl flow bath, the coil device having a plurality of electrodes and arranging the electrodes in positions opposing across the swirl flow bath, and the opposing electrodes being provided different polarities to each other.

Also, according to the present invention, a shifting field generating electromagnetic coil device arranged in opposition to a tundish which has at least a swirl bath for providing horizontal swirl flow for a molten metal for separating and removing a non-metallic foreign matter in the molten metal, wherein an insulating material is provided to the coil device at least on the surface opposing to the tundish.

Furthermore, according to the present invention, a shifting field generating electromagnetic coil device arranged in opposition to a tundish which has at least a swirl bath for providing horizontal swirl flow for a molten. metal for separating and removing a non-metallic foreign matter in the molten metal, wherein a cooling device is provided in the coil device at least on the inner surface opposing to a molten metal container and/or in the tundish at least on the portion opposing no the coil device.

Here, the cooling device is preferably a water jacket or a water pipe panel.

Also, according to the present invention, an apparatus for removing a non-metallic foreign matter in a molten metal has a tundish having a swirl flow bath and floatation baths at both sides of the swirl flow bath and a coil device arranged in opposition to the tundish, wherein a cooling device is provided for discharging cooling fluid into a gap between the tundish and the coil device.

Here, the cooling fluid is preferably the air or air with water mist.

Furthermore, according to the present invention, a casting method of a molten metal for pouring a molten metal from a ladle to a mold via a tundish, comprises the steps of: (a) providing horizontal swirl flow for the molten metal in the tundish by a magnetic force, (b) providing a lid having high sealability for the tundish and replacing the interior of the container with an inert gas before casting and during casting; and (c) pouring the molten metal into the tundish from the lower portion of the ladle through a refractory nozzle having a length extending into the interior of the tundish enclosed by the lid and not submerging into the swirling molten metal.

In addition, according to the present invention, a processing method for a molten metal in a tundish comprises the steps of forming a concaved surface of the molten metal by rotating stirring employing a shifting field generation coil, while processing the non-metallic foreign matter in the molten metal in the tundish, in which the concaved surface is formed, detecting the height of the concaved surface of the molten metal at the center portion and the outer circumference, calculating the rotation speed of the molten metal based on the detected value, and controlling the rotation speed of the molten metal based on the calculated value.

BEST MODE FOR IMPLEMENTING THE INVENTION

Hereafter will be discussed in detail a system for removing non-metallic foreign matter in a molten metal according to the present invention.

Figure 1:
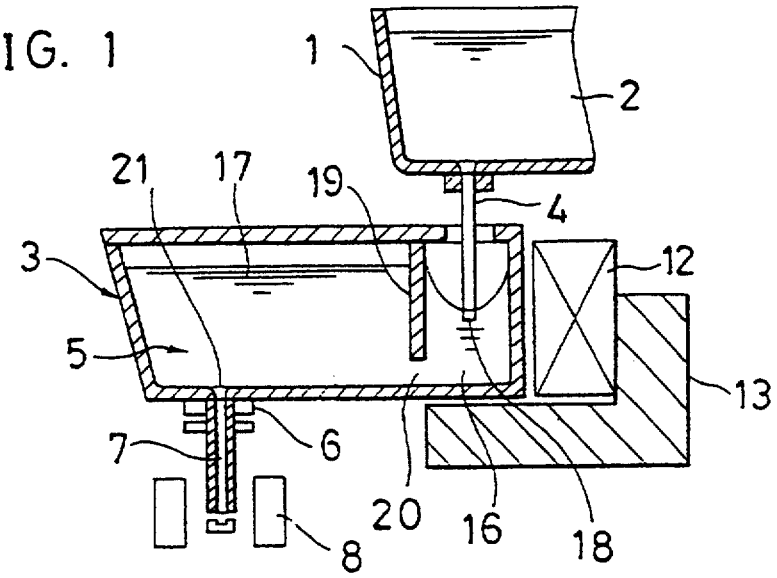
FIG. 1 is a fragmentary illustration of one embodiment of a continuous casting apparatus, to which a tundish moving apparatus for continuous casting of a steel according to the present invention is applied.

FIG. 1 is a diagrammatic illustration diagrammatically showing one embodiment of a continuous casting of a steel, for which one embodiment of a tundish moving apparatus for the steel continuous casting, according to the present invention, is applied.

At first, brief discussion will be given for the steel continuous casting, to which one embodiment of the tundish moving apparatus according to the invention is applied, with reference to FIG. 1. In an apparatus combining a ladle 1, a tundish 3 and a mold 8, a molten steel 2 within the ladle 1 is poured through an air seal pipe 4 into a swirl flow bath 16 in the tundish 3 which has the swirl flow bath 16 and a distribution bath 17.

In the swirl flow bath 16, a rotational force is applied to the molten steel in the swirl flow bath 16 by means of a rotational force generating apparatus (coil) 12. A part of the molten steel circulated therein is transferred to the distribution bath 17 from a flow opening 20 at the bottom of the swirl flow bath 16 and then poured into the mold 8 via a sliding nozzle 6 and an immersion nozzle 7 to be casted in a predetermined dimension.

Accordingly, in such process, non-metallic foreign matter is removed from the molten steel in the swirl flow bath 16, and the purified molten steel 5 is poured into the mold 8 via the distributing bath 17.

Figure 2:
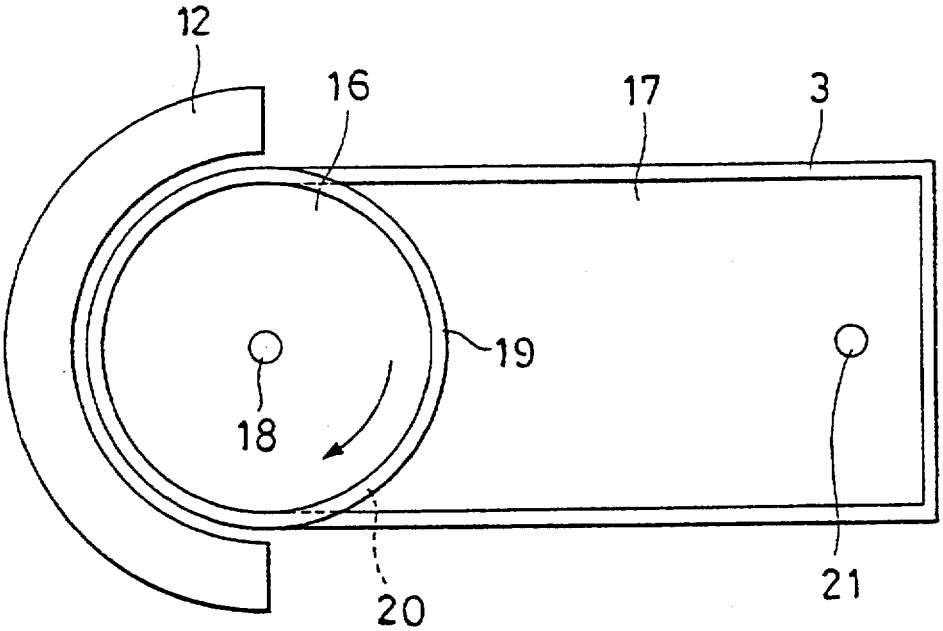
FIG. 2 is a plan view of a tundish in FIG. 1.

FIG. 2 shows a plan view of the tundish 3. The molten steel 2 in the ladle 1 is poured through an inlet 18 located substantially at the center of the swirl flow bath 16, and applied the rotational force by the coil 12 to flow in swirl fashion as indicated by an arrow. Between the swirl flow bath 16 and the distribution bath 17, a partitioning wall 19 is provided. A part of the molten steel is poured into the mold 8 through a discharge output 21 via a flow opening 20 formed in the partitioning wall 19, and the distribution bath 17.

Most of the foreign matter in the molten steel 2 poured in the swirl flow bath 16 is aggregated and separated in the swirl flow bath 16, and remainder is almost completely floated up and separated in the distribution bath 17.

Here, in the present invention, the tundish 3 and the coil 12 are separated from each other. At least one of these can move relative to the other. In one aspect of the present invention, a moving means for the tundish 3 and a moving means for the coil 12 are separated to each other so that the tundish 3 and the coil 12 may move independently of the other. In the second aspect of the invention, the tundish 3 and the coil 12 are mounted on a common moving base (for example, tundish car), but separated to each other so that the coil 12 is rigidly secured on the moving base and the tundish 3 is detachable from the moving base to permit relative movement to each other.

At first, discussion will be given for the first aspect of the tundish moving apparatus for the steel continuous casting, according to the present invention.

In the first aspects of the invention, a coil 12 is arranged in the vicinity., of a pouring floor, which coil has a moving device 13 enabling movement in back and forth, up and down, and left and right by traveling or pivoting, or is rigidly fixed. By,making smaller or eliminating the magnitude of movement of the coil, restriction by the power source cable or so forth can be avoided. In the shown aspect, after driving the tundish 3 to a casting position by a driving device (tundish driving system) different from the coil moving device 13, the coil 12 is shifted to approach to an iron skin of the tundish 3 by the moving device 13. In the alternative, the coil 12 is shifted to a predetermined position in the casting position by the moving device 13, and fixed in place and thereafter, the tundish is moved to the fixed coil 12 by the above-mentioned tundish drive system. In the further alternative, with respect to the coil initially fixed at the predetermined position of the casting position, the iron skin of the tundish 3 is approached. To this movement, the power source for the coil and the cooling water have to follow. This can be accomplished by installing a supply device (for example, a cable bearer including a coil power source cable and a cooling water cable and so forth as illustrated by represented by the reference numeral 32 of FIG. 7) provided with expanding and contracting function or rotating function.

This provides rotational force for the molten steel in the tundish during casting. The tundish can be moved by the tundish drive system without interference with the coil. Even in the case that the coil interferes with the movement of the tundish, it is possible to temporarily shift the coil away from the tundish in advance of moving the tundish in traveling or rotating by the tundish driving system. According to the present invention, the coil is applied to the tundish only at the casting position. Namely, since the coil is only required to be attached or detached by the coil moving device, it becomes possible to perform operation with an minimum one coil which have been required in the corresponding number to the tundish in the prior art.

Figure 5:
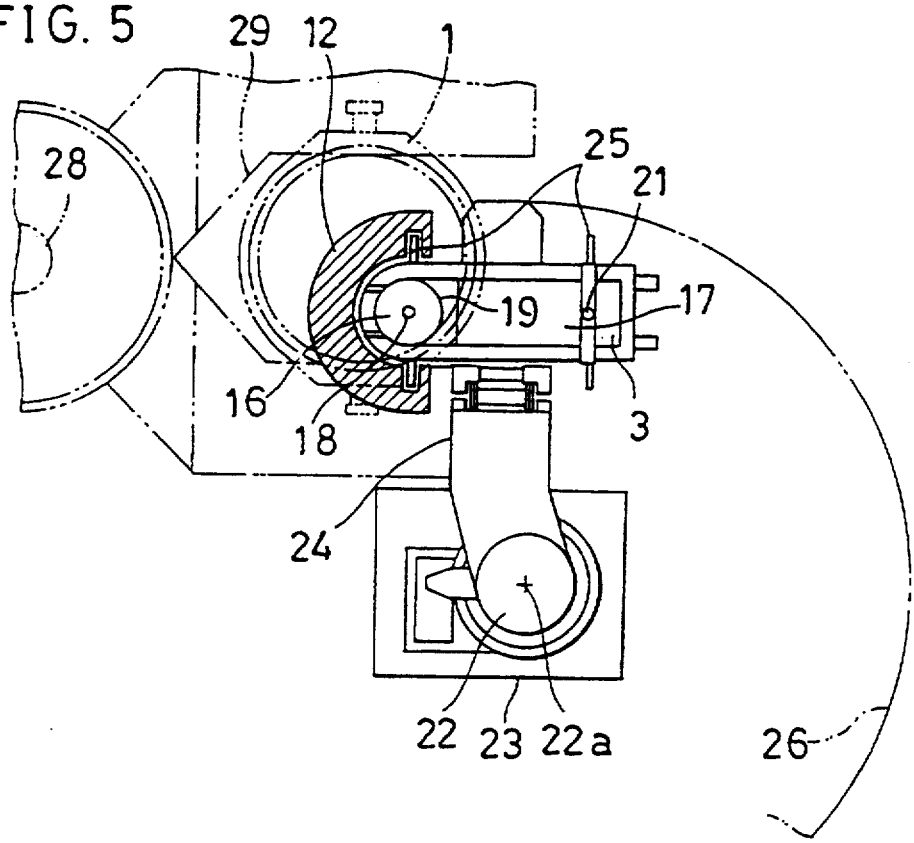
FIG. 5 is a plan view of one embodiment of a tundish moving apparatus for continuous casting of the steel according to the invention.
Figure 8:
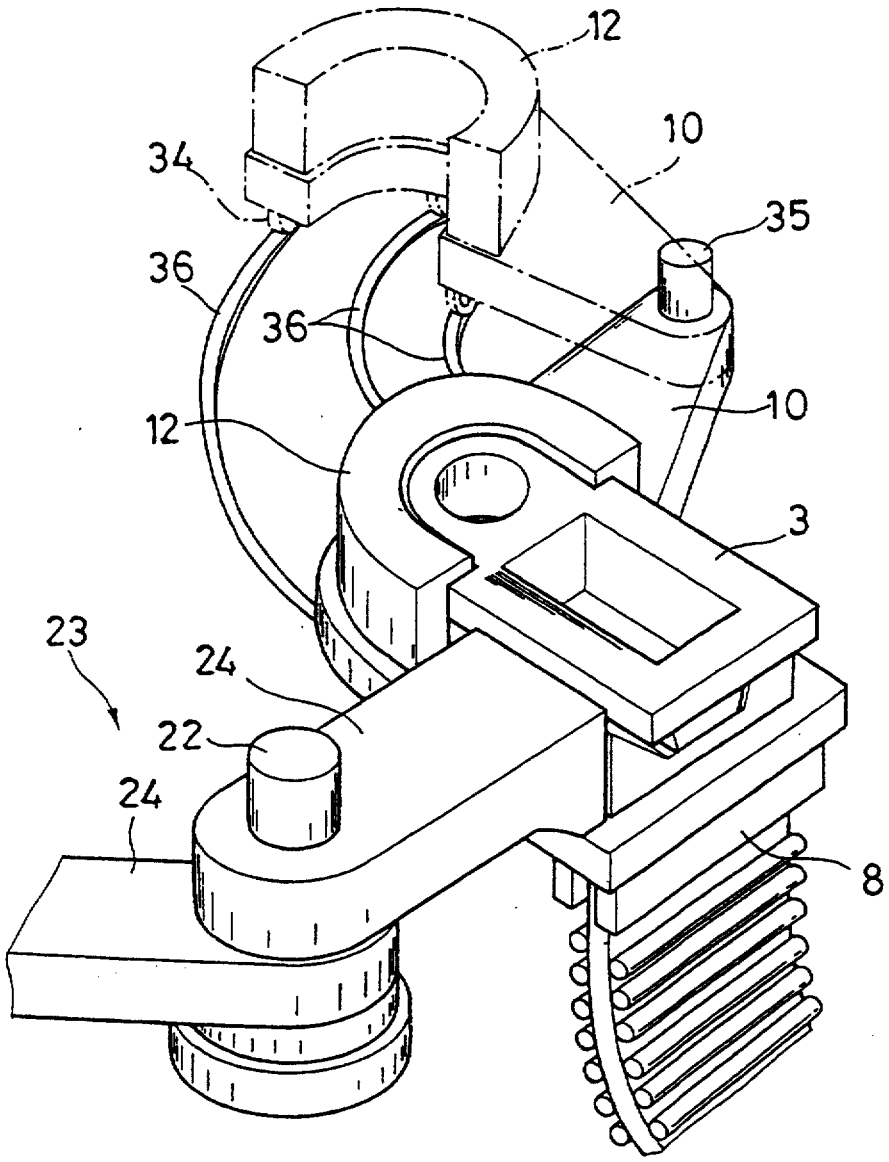
FIG. 8 is a perspective view of a further embodiment of the apparatus of the invention.
Figure 9A:
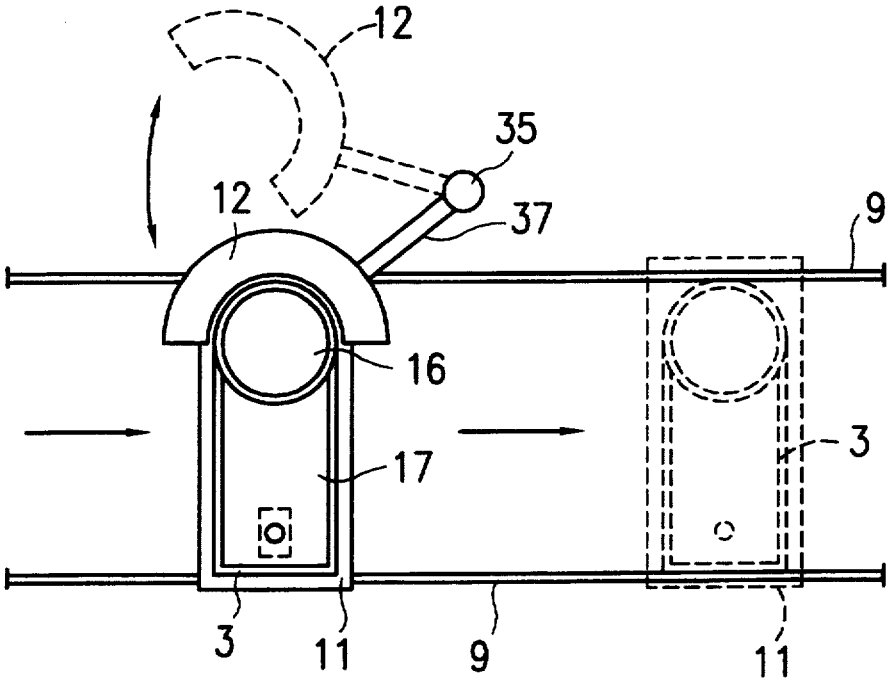
FIGS. 9*a* and 9*b* are diagrammatic plan views of the further embodiment of the apparatus of the invention.
Figure 9B:
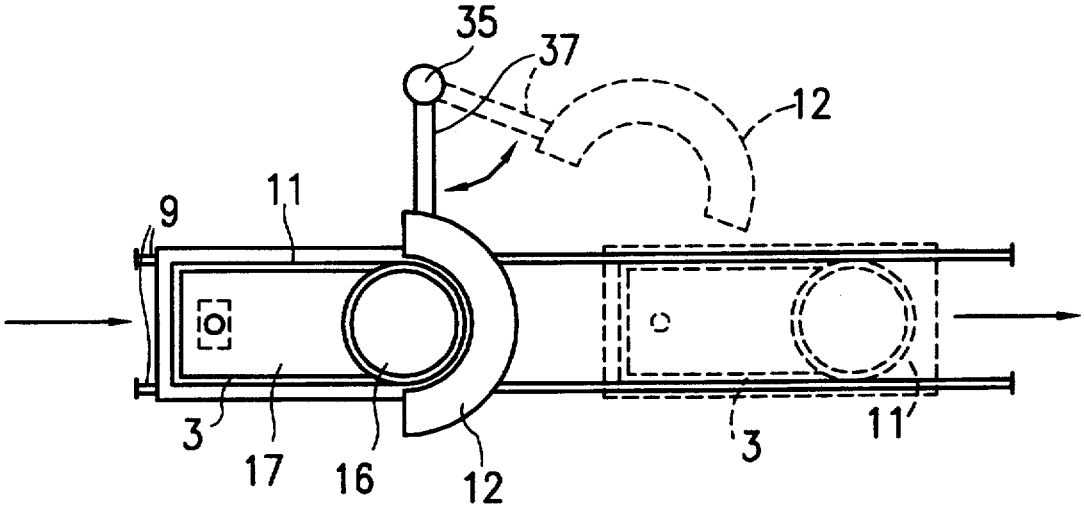
Figure 18A:
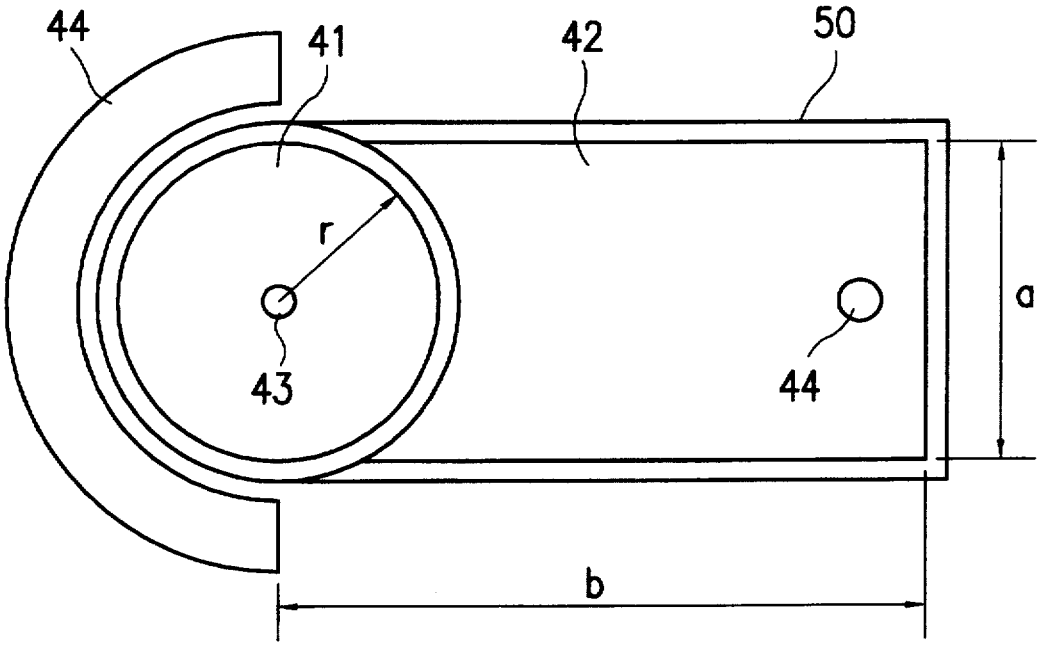
FIGS. 18*a* and 18*b* are diagrammatic illustrations of a non-metallic foreign matter removing apparatus having a swirl flow bath and a floating up bath of the invention, in which (a) is a plan view and (b) is a cross section.
Figure 18B:
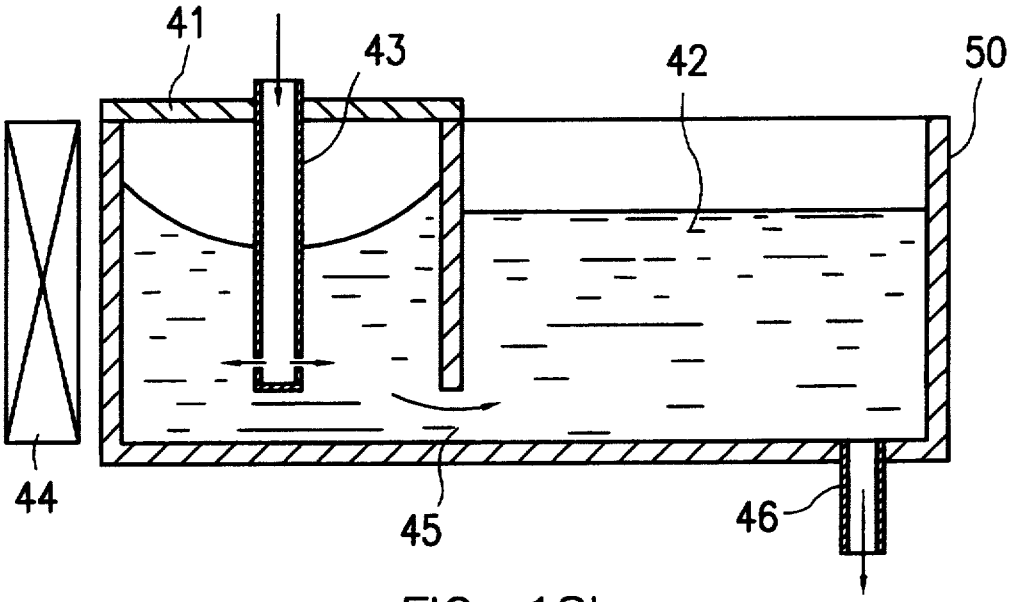

The tundish drive system employed in the present invention is not particularly specified, and it is possible to form the tundish driving system for moving the tundish 3 with a railway (tundish car rail) 9, on which a tundish moving carriage 11 is mounted and is driven by a not shown driving power source, such as a motor, to travel, as shown in FIG. 9. Needless to say, since the tundish moving carriage 11 such as that illustrated in FIG. 7 does not require to mount the coil 12, it can be smaller than the tundish moving carriage 11 illustrated in FIG. 18. Also, it is of course possible to employ a turret type transporting platform as illustrated in FIG. 5 or FIG. 8 which will be discussed later. In addition, as far as applicable for tundish driving system, driving systems which drive laterally, driving systems which drive for elevating up and down and so forth may be employed. Furthermore, when the coil 12 is preliminarily fixed at the predetermined position of the casting position, the tundish driving system which permits fine adjustment of the distance between the coil 12 and the tundish 13 is preferred.

Next, discussion will be given for the coil moving device 13 which is the most particular coil moving means of the shown aspect.

Figure 3:
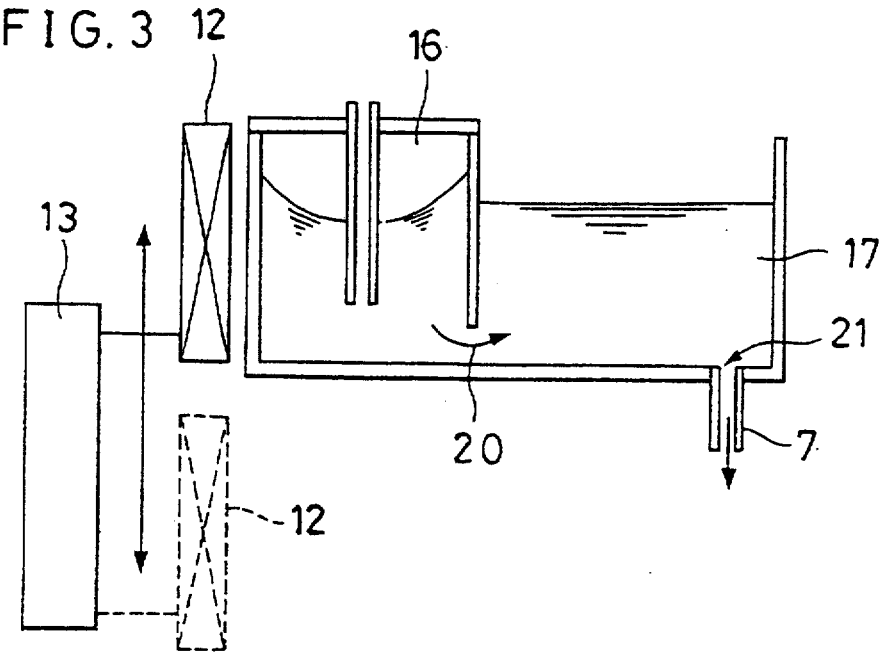
FIG. 3 is an explanatory illustration showing a relationship between elevating of a coil and the tundish in the tundish moving apparatus for the continuous casting of steel according to the invention.
Figure 4:
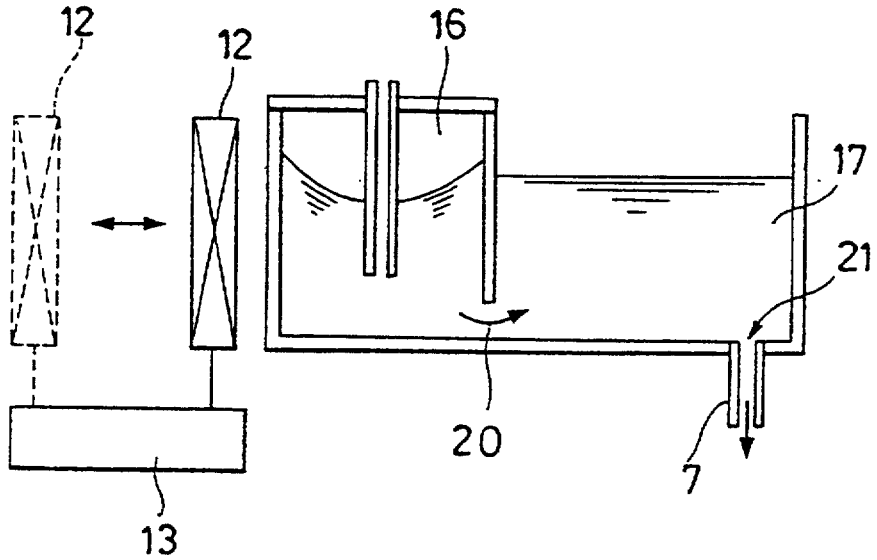
FIG. 4 is an explanatory illustration showing a relationship between horizontal shifting of the coil and the tundish in the tundish moving apparatus of the invention.

In case of the coil moving device 13 illustrated in FIG. 3, the coil 12 is moved (lifted) in vertical direction to approach to the iron skin of the tundish 3. In case of the coil device 13 illustrated in FIG. 4, the coil 12 is approached to the iron skin by .horizontal movement, such as traveling or pivoting. In these cases, as the coil moving device 13, a mechanisms for generally moving heavy weight articles, such as a hydraulic device, screw jack and so forth can be employed, and thus is not particularly specified. On the other hand, the utilities, such as water, power source cable, air and so forth may be coupled through coupling means (for example, the coil power source cable as represented by the reference numeral 32 in FIG. 7), such as cable bearer, rotary joint, slip ring or so forth.

Next is a concrete discussion for a practical embodiment of the tundish moving apparatus for the continuous casting of the steel, in which the coil moving device is incorporated.

Figure 6:
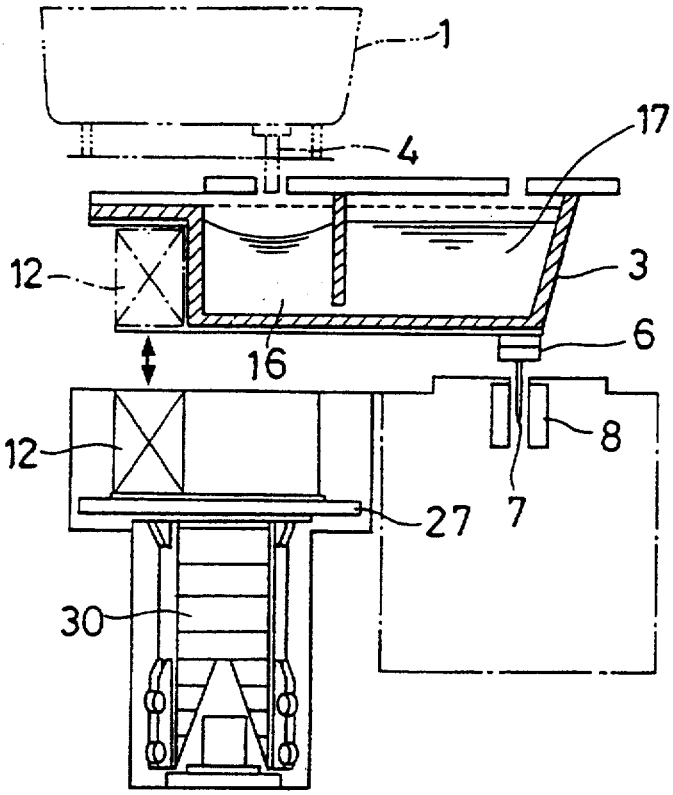
FIG. 6 is a partially sectioned front elevation of the apparatus of the invention illustrated in FIG. 1.

FIGS. 5 and 6 show one practical embodiment of the present invention. The apparatus according to the present invention as illustrated in FIGS. 5 and 6 is designed to move the tundish 3 by a pivoting means, and to move the coil 12 by an lifting means. In FIG. 5, there is illustrated an example, in which the turret type tundish transporting platform moving the tundish 3 with the pivoting means is employed as the tundish driving system. In this case, a tundish turret 23 is provided at a pivoting center 22*a*. The tundish 3 is supported on an arm 24 of the tundish turret so that the arm 24 is pivoted about the pivoting center shaft 22 to move at a predetermined position within a path 26 of the tundish. Here, the reference numeral 25 denotes a hanger for the tundish 3, the reference numeral 28 denotes a pivoting center of the ladle 1, and the reference numeral 29 denotes a swing tower of the ladle 1.

Illustrating one example of the lifting means for the coil 12, as shown in FIG. 6, for example, a lifting base (coil base) 27 is provided below the tundish 3. A vertical drive device 30 is attached below the lifting base 27. The coil 12 is fixedly mounted on the lifting base 27 so that it may be approached for applying the magnetic field to the molten steel in casting, by operation of the known hydraulic cylinder or so forth it should be noted, in FIG. 6, the tundish drive system has been omitted from illustration. Since the coil 12 is lowered in conjunction with lowering of the lifting base 27, the tundish 3 can be pivoted without causing interference.

Figure 7:
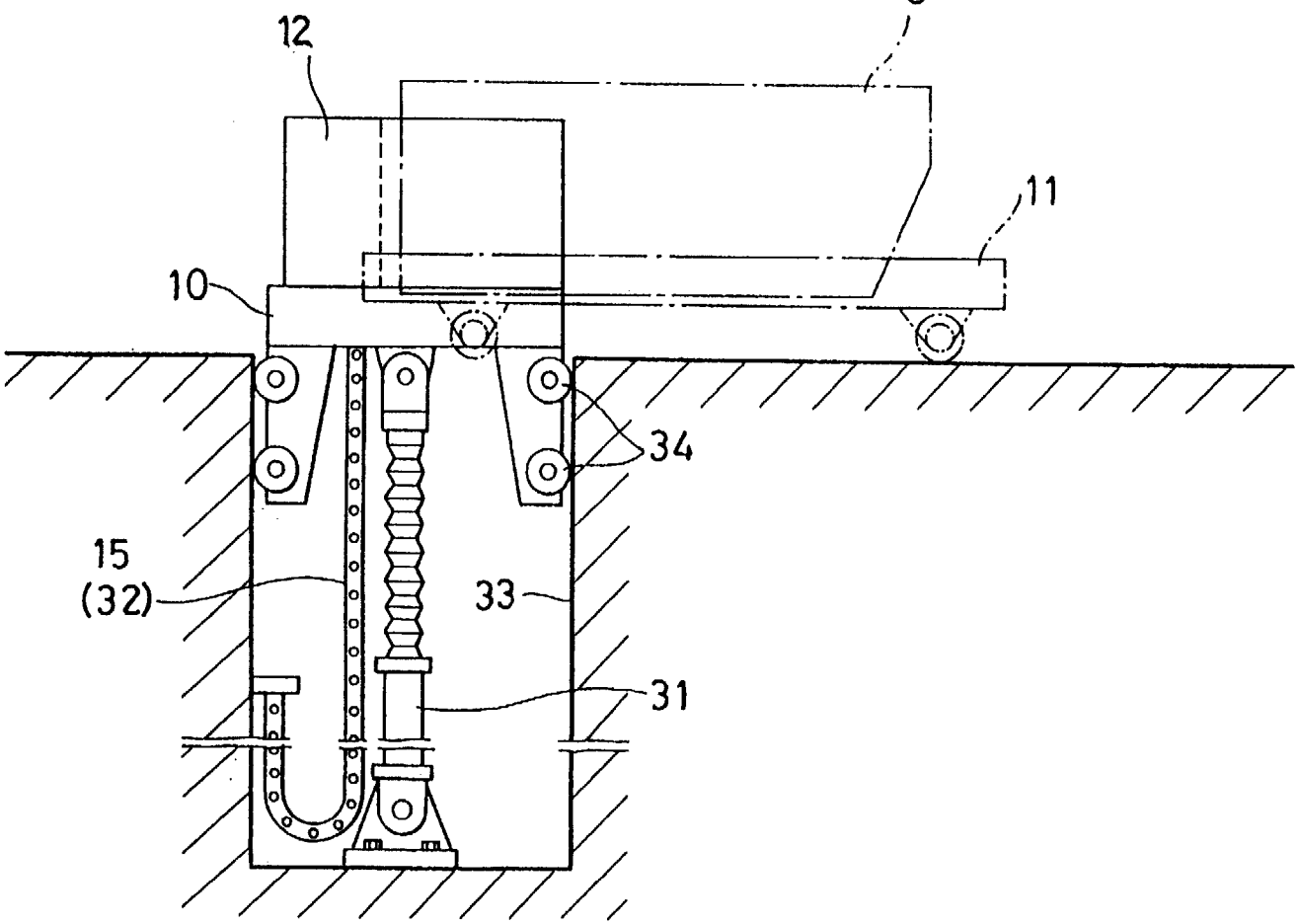
FIG. 7 is a front elevation of another embodiment of a coil elevating means of the apparatus of the invention.

Next, in FIG. 7, there is shown a sectional diagrammatic illustration of another embodiment of the apparatus according to the present invention, in which the tundish 3 is moved by a traveling means and the coil 12 is moved by the lifting means.

Here, the coil 12 is mounted on a coil carriage 10 and lifted up and down by a hydraulic cylinder 31. On the carriage 10, wheels 34 for smoothly moving the carriage 10 along the inner peripheral surface 33 are mounted. Also, a coil power source cable 32 for connecting the coil 12 to the power source is connected via the carriage 10. The cable 32 has sufficient length for permitting up and down motion of the carriage 10. At the lowered position of the carriage, it may be suspended in the U-shaped fashion. In addition, the utilities, such as water, air and so forth necessary for the coil 12, are also attached to the coil 12 via the carriage 10 in vertically movable fashion by known means similarly to the cable 32. On the other hand, the tundish 3 is constructed to mounted on a tundish carriage (tundish moving carriage) 11 which has wheels 34 to travel on a not shown railway (tundish rail). Here, the mold is omitted from illustration.

Also, FIG. 8 is a perspective view showing a further embodiment of the apparatus according to the present invention, in which the tundish 3 is moved by a pivoting means and the coil 12 is moved by a pivotally traveling means. Here, the tundish 3 is mounted on the arm 24 of the tundish turret 23 so as to be pivotally moved about the pivoting center shaft 22, On the other hand, the coil 12 is fixedly mounted on a coil carriage 10 which has wheels 34 so as to be moved by traveling on a railway (coil car rail) about a pivoting shaft 35. With the shown construction, after pivotally moving the tundish 3 to the continuous casting position where the mold 8 is provided by the tundish turret and fixed in place, the coil 12 can be approached to the iron skin of the tundish by pivotal movement by the carriage 10.

Although the practical examples have been discussed in terms of the practical embodiments with respect to the moving means of the tundish 3 and the moving means of the coil 12, the present invention should not be specified to those embodiments. For instance, the moving means of the tundish 3 and the coil 12 can be a traveling means, such as a railway traveling type or so forth, a pivoting means, such as the turret type or so forth, or a lifting means, or, in the alternative, of any combination of the foregoing means. On the other hand, as long as the tundish 3 can be easily detached from the coil 12 upon replacing, the present invention may include the construction, in which the coil 12 is fixed at the position where the mold 8 is arranged, and the coil 12 and the swirl flow bath 16 of the tundish 3 are placed in opposition in close proximity by the moving means of the tundish 3. Since the energization coil 12 can be shifted away relative to the tundish 3 without conflicting with the tundish 3 upon replacing new and old tundishes 3, only one energization coil 12 is required. Also, the tundish carriage (turret arm) 11 can be small one. In addition, in the foregoing each embodiment, it may be possible to position the coil 12 opposing no the swirl flow bath 16 of the tundish in the close proximity thereto by moving the coil with the coil moving means, after positioning the tundish 3. Conversely, it is also possible to initially position the coil 12 and to subsequently position the tundish.

For example, as diagrammatically illustrated in the simplified form in FIGS. 9(*a*) and 9(*b*), it is possible to attach and detach the coil 12 by driving the tundish carriage 11 mounting the tundish 3 on a rail 9 (traveling railway) and pivoting the coil 12 with an arm 37 about the pivoting shaft 35, so that the coil is opposed to the iron skin in the close proximity thereof, Here, in FIG. 9(*a*), the tundish carriage 11 travels in a shorter axis direction perpendicular to the longitudinal axis direction on the rail 9 with not shown wheels mounted in the vicinity of both of the longitudinal ends of the tundish.

Conversely, in FIG. 9(*b*), the tundish carriage 11 travels on the rail 9 in the longitudinal direction of the tundish.

Figure 10:
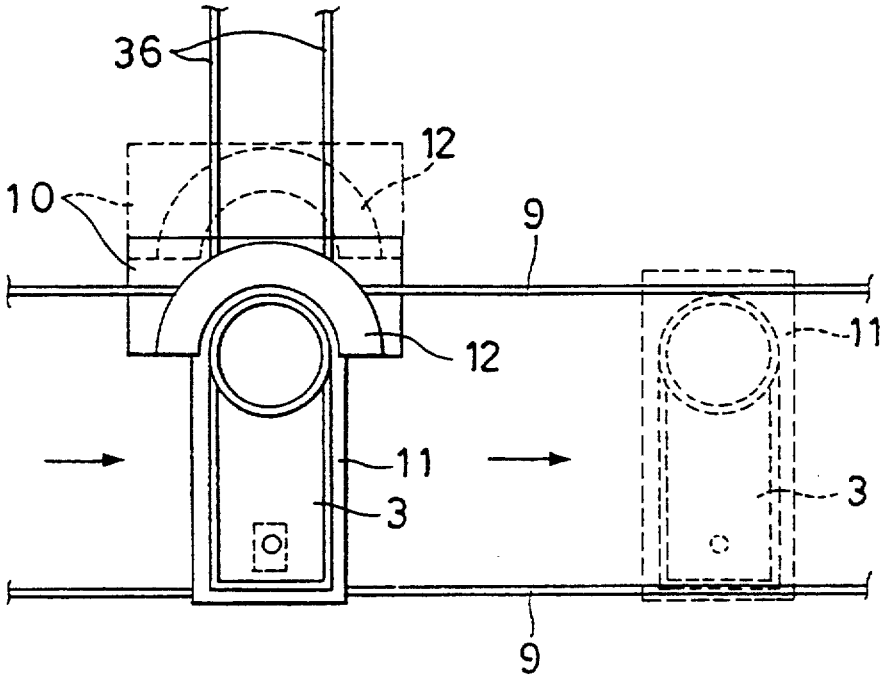
FIG. 10 is a diagrammatic plan view of a still further embodiment of the apparatus of the invention.
Figure 11:
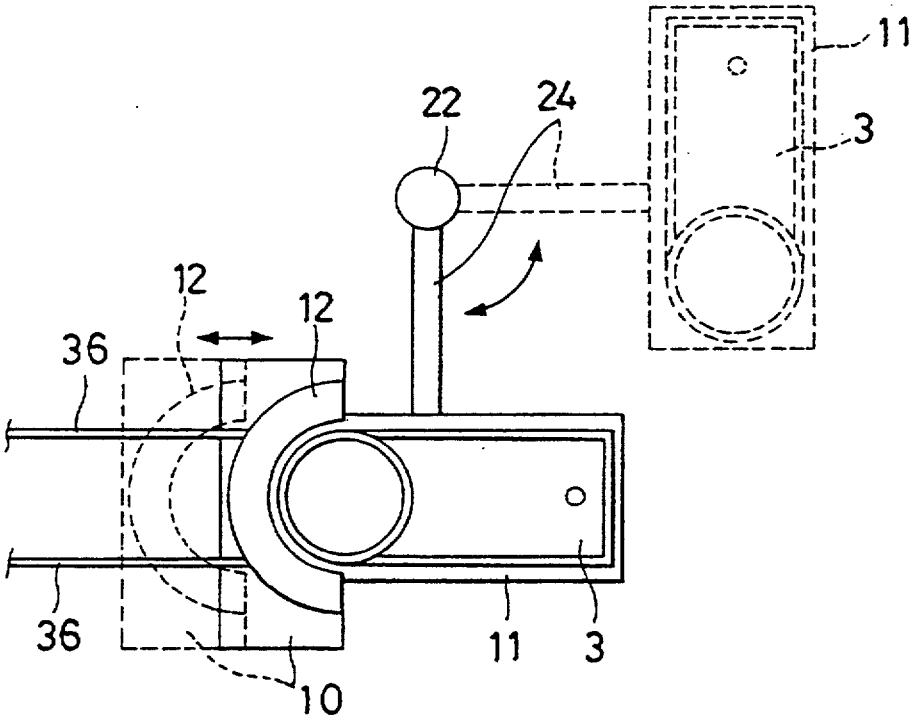
FIG. 11 is a diagrammatic plan view of a yet further embodiment of the apparatus of the invention.

On the other hand, as shown in FIG. 10, it is possible to have such a construction that the tundish carriage 11 mounting the tundish 3 travels on the rail 9 in the direction perpendicular to the longitudinal direction thereof, and, the coil carriage 10 mounting the coil 11 travels on the rail 36 in the longitudinal direction of the tundish 3. Also, as shown in FIG. 11, it may be constructed to attach the arm 24 to the tundish carriage 11 mounting the tundish 3 to pivotally move the tundish 3 about a pivoting shaft 22, and to mount the coil 12 on the carriage 10 for traveling on the rail 36, so as to attach and detach the coil 12 to the tundish 3.

Figure 12A:
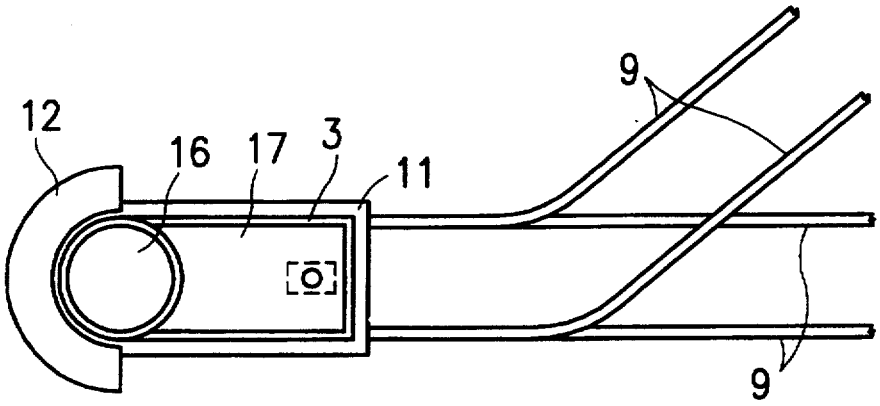
FIGS. 12*a* and 12*b* are diagrammatic plan views of a yet further embodiment of the apparatus of the invention.
Figure 12B:
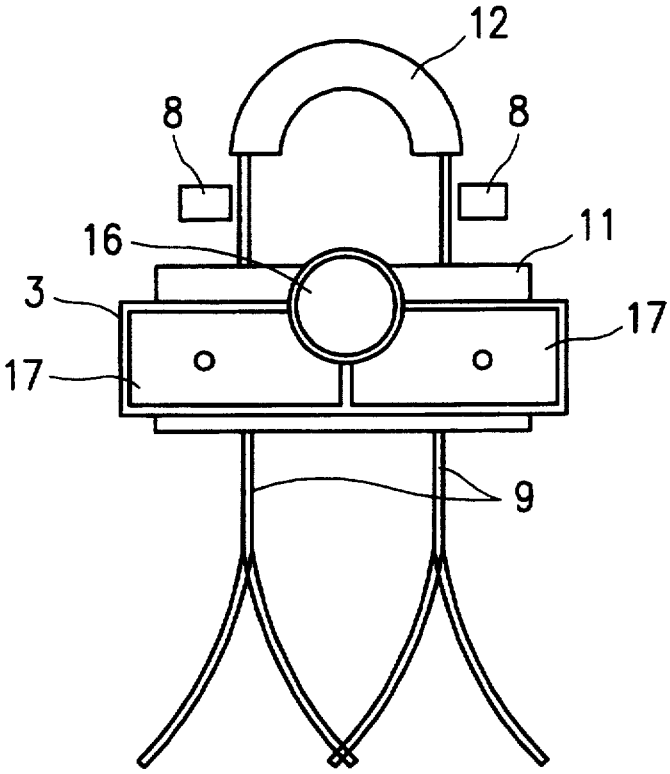

Although the foregoing discussion has been directed to move the tundish 3 and the coil 12 independently of each other, it is possible to have a construction, in which the coil 12 is fixed at the mold position and only the tundish 3 is moved to place the coil 12 in opposition to the iron skin of the tundish in the close proximity to the later. For example, as shown in FIGS. 12(*a*) and (*b*), it is possible to mount the tundish 3 on the tundish carriage 11 to travel on the rail 9. Here, while the tundish 3 having respective one swirl flow bath 16 and the floatation bath 17 is mounted on the tundish carriage 11 in FIG. 12(*a*), it may be possible to mount a tandem tundish 3 having one swirl flow bath 16 and two floatation baths 17 as shown in FIG. 12(*b*). Furthermore, when the coil 12 is fixed as shown in FIGS. 12(*a*) and (*b*), the rail 9 to travel the tundish carriage 11 has to be branched into two directions at the terminating end so as to enable setting thereto and shifting away therefrom.

Figure 13:
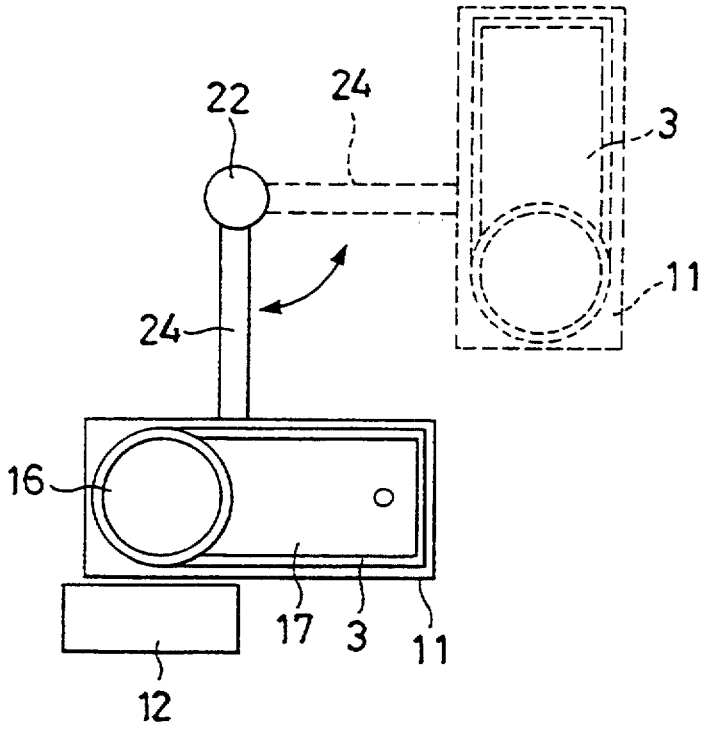
FIG. 13 is a diagrammatic plan view of a yet further embodiment of the apparatus of the invention.

On the other hand, as shown in FIG. 13, it is further possible to have a construction to pivot the tundish carriage 11 mounting the tundish 3 with the arm 24 attached thereto about the pivot shaft 22 to approach the iron skin to oppose with the coil 12 which is placed at the fixed position, or to shift away Here, the coil 12 is not necessary to cover the semi-cylindrical iron skin of the swirl flow bath 16 of the tundish and can be of any configurations which permit to be placed at the side of the swirl flow bath in opposition to the iron skin in the close proximity thereto for applying the rotational force for the molten steel in the tundish 3. Also, the coil can be in the separated form, or a different type of coil. For instance, a superconducting coil and so forth can be suitably employed.

Although various practical embodiments have been discussed with respect to the first aspect of the tundish moving apparatus for steel continuous casting according to the invention, they should not be taken to be limitative to the invention. It should be honed that the configuration and number, mounting method, moving direction of the tundish to be mounted on the tundish carriage, and configuration and number of coils, the configuration, the mounting method and moving direction of the coil carriage and so forth should be selected appropriately depending upon necessities.

Next, the second aspect of the tundish moving apparatus for the continuous casting of the steel according to the invention will be discussed in terms of the embodiment illustrated in FIGS. 14 to 17.

Figure 14:
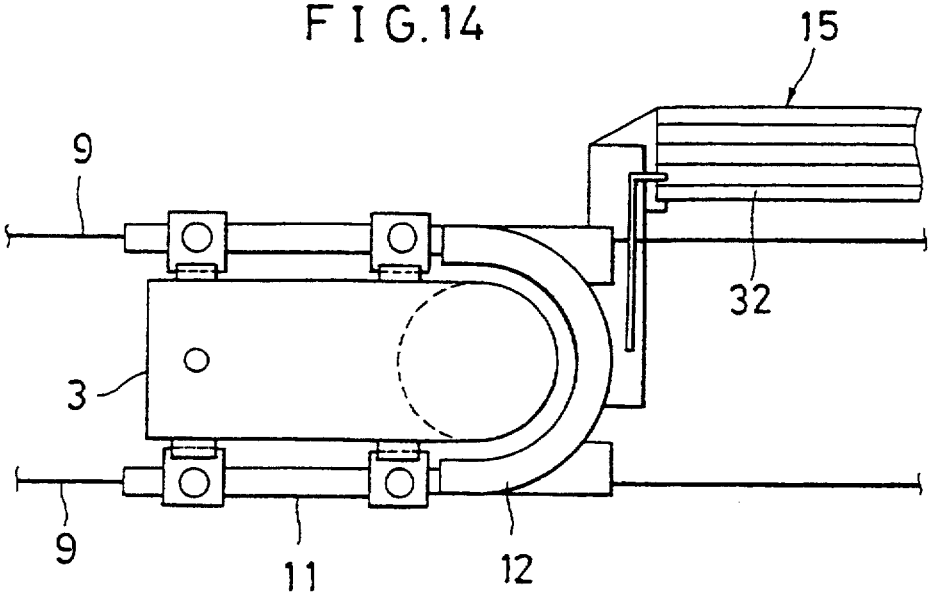
FIG. 14 is a plan view showing another embodiment of a tundish moving apparatus for continuous casting of the steel according to the invention.
Figure 17:
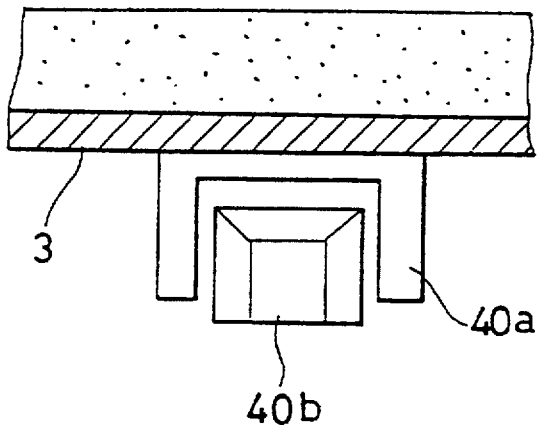
FIG. 17 is a paretically sectioned plan view seeing in a direction along line IV—IV of FIG. 16.

As shown in FIGS. 14 and 17, the tundish 3 is mounted on a movable base driven to travel on a rail 9 by a drive device 38, such as a motor or so forth. For example, the movable base can be a tundish mounting base 39 on the tundish car 11. The tundish mounting base may comprise a worm jack device for lifting the tundish, for example. The tundish mounting base is adapted to move the tundish 3 to the position above the mold 8 from the mounting position with maintaining the tundish 3 in a position mounted on the tundish car 11. It is preferred to initially lift up the mounting base by the warm jack, then the tundish is mounted on the mounting base 39 by means of a crane, and the mounting base is lifted down after moving the moving base at a position above the mold. It is also possible to use a part of the tundish car 11 common to the tundish mounting base and to mount the tundish at the position above the mold.

On the tundish car 11, a coil 12 is preliminarily mounted at a position opposing to the side wall of the swirl flow bath 16 so that part of or all of the molten steel in the swirl flow bath 16 of the tundish can flow in swirl fashion. To this coil 12, a water cooling cable 37 is connected via a table bearer 15. On the other hand, the tundish 3 and the coil 12 can be separated completely, it is not necessary to detach the coil 12 at every occurrence of replacing of the tundish 3.

However, it is effective for applying the electromagnetic force to the molten steel to make the gap between the coil 12 and the tundish 3 narrower than a gap required for attaching and detaching tundish 3 (normally, approximately 100 mm).

Figure 16:
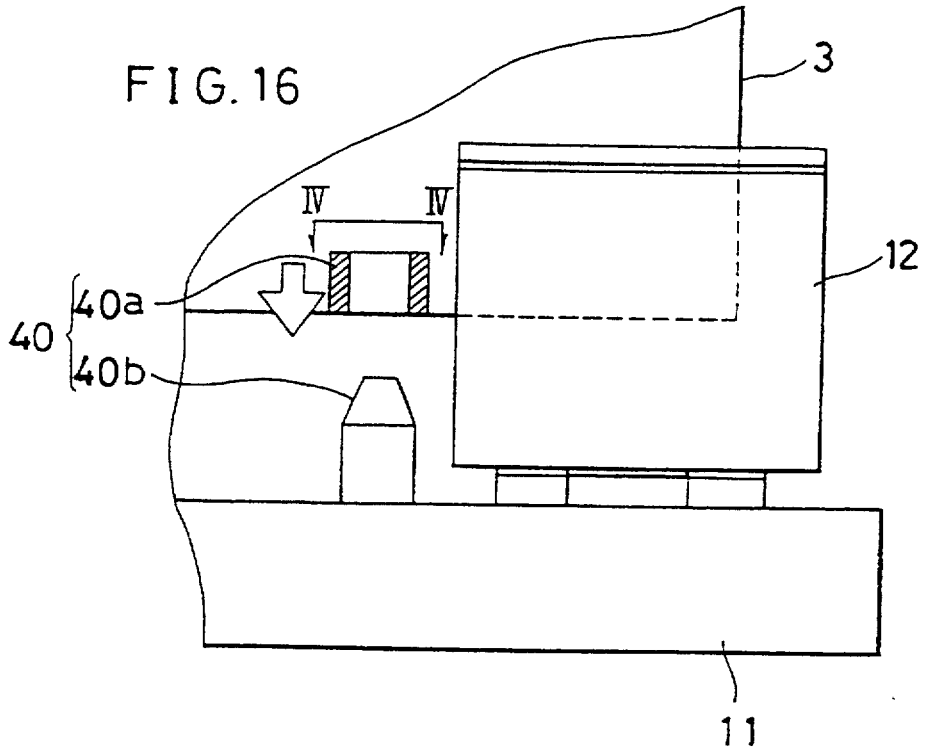
FIG. 16 is an illustration showing arrangement of a guide for accurately positioning the tundish and the coil.

Therefore, a guide 40 as shown in FIGS. 16 and 17, may be provided for facilitating positioning upon mounting the tundish 3 onto the tundish car 11 so that the tundish 3 can be quickly and certainly attached and detached by hanging down or hanging up the tundish with the crane or so forth along the guide 40. 40*a* denotes a guides at the side of the tundish.

With the shown aspect, the period required for replacing tundish 3 can be shortened for about 50 minutes in comparison with the case where the coil 12 is fixed with the tundish 3 as in the prior art. The major factor for this resides on connecting operation of the cable 32. For absorption of the heat in the coil due to the Joule heat, the coil 12 is cooled by the water, and, in addition, the cable 32 therefor has not so high flexibility. Therefore, connecting operation of this cable is a heavy load work. In contrast to this, according to the present invention, since the cable 32 can be connected to the coil 12 through a cable bearer 15 upon preliminarily fixing the coil 12 on the tundish car 11, it is advantageous to only require replacing operation of the tundish 3. Also, upon repairing of the tundish 3, since it is required to replace only the tundish 3 mounted on the tundish car 11, it requires minimum one coil, and can be several even in consideration of efficiency of operation, which have been required in the corresponding number to the tundishes.

On the other hand, with the foregoing constructions, the maintenance capability of the tundish 3 can be improved. Namely, the tundish 3 has to be replaced with the repaired tundish after several charges or several tens of charges at the longest, due to melting of a lining brick or so forth. At this occasion, if the tundish 3 is handled in the position where the coil 12 is attached thereto, the following problems will be encountered.

(1) damaging of the coil; and (2) degradation of insulation of the coil.

By fixing the coil 12 on the tundish car 11 as in the shown aspect, the problems associated with the above-mentioned manner of handling can be solved.

On the other hand, an accurate positioning of the relative position of the coil 12 and the tundish 3 can be achieved by providing the guide 40 directly on the moving base 11 or via the tundish mounting base in order to certainly determine the relative position between the coil 12 and the tundish 3.

Since the first aspect of the invention is constructed as set forth above, it is suitable for the tundish having the swirl flow bath for swirling the molten steel and enables operation with replacing and repairing of the tundish. In addition, frequency of connecting operation for the cable, water, air and so forth is lowered so that the connecting operation becomes unnecessary except for the case where the cable per se is to be repaired. By this, this type of the tundish becomes possible to be practically used. Namely, by the present invention, it is possible to provide rotating force for the tundish during casting, and to temporarily shift the coil away from the tundish when the tundish is moved by pivoting or traveling. According to the present invention, the coil is applied to the tundish only at the casting position. Therefore, casting operation can be performed with one coil at minimum while corresponding number of coils to the number of tundishes have been required in the prior art.

On the other hand, according to the shown aspect, since the tundish and the coil are approached only at necessary position and only at necessary times, it becomes very easy to move to the positions other than the casting position upon replacing of the tundish or repairing of lining of the tundish and can be operated in the equivalent manner to the tundishes having no coil.

Since the second aspect of the invention is constructed as set forth above, the following effects can be achieved by fixing the coil which provides swirl flow for the molten steel, on the moving base and enabling it to travel with the tundish.

(1) The connecting operation of the coil and the cable is required only upon mounting of the coil to facilitate replacement of the tundish.

(2) It is not necessary to detach the coil upon maintenance of the tundish.

(3) Damaging during handling will never be caused.

As set out in detail, the apparatus for removing the non-metallic foreign matter in the molten steel comprises separately constructed tundish and the coil. Therefore, discussion will be given, at first, for designing and construction of the tundish and then for the coil.

(A) Designing of Tundish

An apparatus (tundish) 50 for removing the non-metallic foreign matter in the molten metal, according to the present invention, includes a swirl flow bath 41 and a floatation bath 42. To the swirl flow bath 41, the molten steel is poured from the ladle (not shown) though a nozzle 43 as indicated by an arrow in FIG. 18. The poured molten steel is preferably flown in the horizontal swirl fashion by a rotating or shifting field generating device 44. By this, the non-metallic foreign matter in the molten steel or the non-metallic foreign matter due to melting of the refractory of the tundish 50 is separated and floated on the parabolic swirl flow in the swirl flow bath.

The molten steel thus purified flows into the floatation bath 42 through a communication opening 45 at the bottom of the swirl flow bath 41. The residual non-metallic foreign matter in the statically placed molten steel floats up in the floatation bath 42 and thus separated. The molten steel thus further purified is poured into the mold (not shown) via a discharge output 46 and produced as a casted product.

It has been desired to optimally design the non-metallic foreign matter removing apparatus having such swirl flow bath and the floatation bath. Especially, a problem is encountered in the height of the swirl flow bath due to parabolic proturburance of the molten steel by the swirl flow in the time range of steady state, namely while the molten steel is poured into the swirl flow bath from the ladle. Also, it is important to prevent the non-metallic foreign matter floating on the swirl flow bath from flowing out to the mold through the discharge opening 46 via the communication opening 45 of both baths in a time range of non-steady state, namely while the molten steel is only flowing out through the discharge opening during ladle replacement. More particularly, prevention of the above-mentioned problem to be encountered in the non-steady state is absolutely necessary.

As a result of energetic study in design of the non-metallic foreign matter removing apparatus in view of the problems as set forth above, the inventors have found the following condition through computer simulation, water model experiments and preliminary experiments in the scale of actual facility. The conditions are as expressed by the following equations (1), (2), (3) and (4). Methods of derivation of these formulae will be discussed herebelow.

Figure 19:
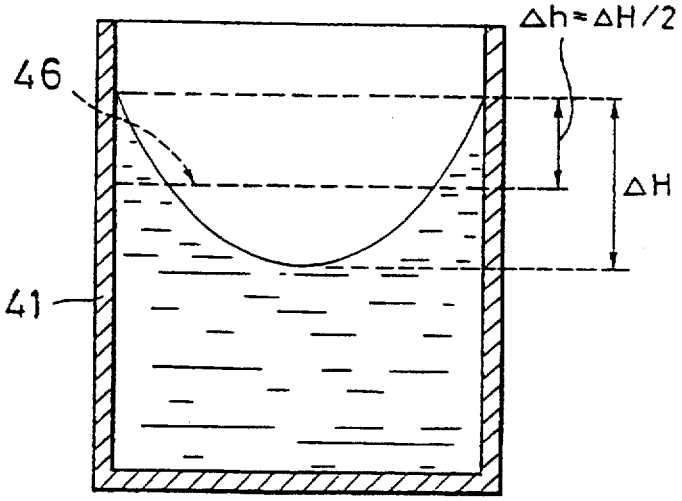
FIG. 19 is an illustration showing configuration of a meniscus when a molten metal is horizontally rotated.

When the molten metal is horizontally rotated, the surface thereof is formed into the parabolic configuration relative to the static bath surface 46, as shown in FIG. 19. The height ΔH of the proturburance is expressed by the following equation:

$$\Delta H = \frac{(r \times \omega)^2}{2g} \tag{5}$$

where r: radius of the swirl flow bath (m);

ω: horizontal rotation speed in the swirl flow bath (rad/min);

g: acceleration of gravity (m/min$^2$).

On the other hand, at the ladle replacement, by the flowing out of the molten steel, the molten steel level in the container will be lowered in a magnitude as expressed in the following formula. **

$$\frac{q \times t_c}{\rho(a \times b + \pi \times r^2)} \tag{6}$$

where q: molten steel flowing out amount (ton/min) from the floatation bath (ton/min);

$t_c$: maximum pouring interruption period for the swirl flow bath (min);

a: vertical dimension of the floatation bath (m);

b: lateral dimension of the floatation bath (m);

ρ:specific weight of the molten steel (ton/m$^3$).

On the other hand, in order to achieve foreign matter separating and removing effect by the horizontal rotation, the necessary molten steel level required for certainly maintaining the necessary minimum average dwell period $t_m$ (=amount of molten steel in the swirl flow bath÷molten steel following out amount at unit period) in the swirl flow bath can be expressed by the following formula:

$$\frac{q \times t_m}{\rho \times \pi \times r^2} \tag{7}$$

Figure 20:
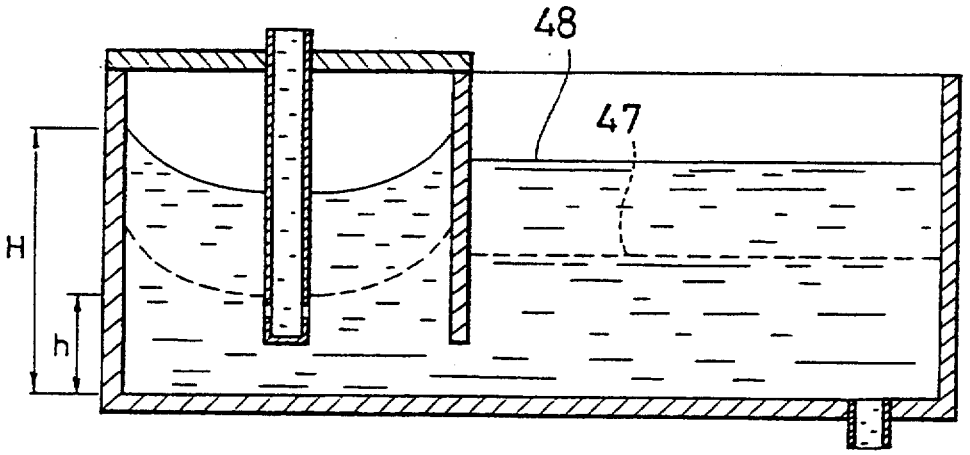
FIG. 20 is a diagrammatic illustration showing condition below molten metal surface upon replacing of a ladle.

Accordingly, with taking the buffer function during ladle replacement, the necessary maximum molten steel level H (see FIG. 20) in the swirl flow bath while the molten steel is steadily flowing in and out, becomes the height of the sum of the minimum molten steel level, the proturburance height of the molten steel surface and the level lowering magnitude during ladle replacement and can be expressed by the following equation. It should be noted that, in FIG. 20, 47 denotes the molten steel level in the floatation bath corresponding to the minimum molten steel level in the swirl flow bath, and 48 denotes a molten steel level corresponding to the maximum molten steel level in the swirl flow bath.

$$H = \frac{q \times t_c}{\rho(a \times b + \pi \times r^2)} + \frac{(r \times \omega)^2}{4g} + \frac{q \times t_m}{\rho \times \pi \times r^2} \tag{4}$$

On the other hand, the minimum molten steel level h (see FIG. 20) required during ladle replacement can be expressed by the following equation.

$$h = \frac{q \times t_m}{\rho \times \pi \times r^2} - \frac{(r \times \omega)^2}{4g} \tag{3}$$

Here, the necessary minimum average dwell period in the swirl flow bath and the necessary minimum molten steel level necessary for achieving foreign matter separating and removing effect by the horizontal rotation are obtained through a water model experiments. As a result, it has been found that the necessary minimum average dwell period $t_m$ is 2 min irrespective of the molten steel flowing out velocity, and the necessary minimum molten steel level $h_{min}$ is proportional to $\frac{1}{3}$ power of the molten steel flowing out velocity and can be expressed by the following equation:

$$h_{min} = 0.47 \times q^{\frac{1}{3}} \tag{8}$$

By this, the following conditions are found for achieving the foreign matter separating and removing effect with maintaining the buffer function of the molten steel in the ladle replacement:

$$h \geqq 0.47 \times q^{\frac{1}{3}} \tag{1}$$

$$t_m \geqq 2 \tag{2}$$

Namely, in order to prevent the non-metallic foreign matter from reaching the mold from the swirl flow bath via the discharge opening of the floatation bath, it becomes necessary to satisfy the formulae (1) and (2).

In the range satisfying the formulae (1) and (2), the range of radius of the swirl flow bath satisfying the minimum molten steel level required in the non-steady state, such as ladle replacement and so forth is determined by the equation (3). By selecting the radius of the swirl flow bath within the range of the radius, as shown in the equation (4), at which the necessary maximum molten steel level becomes minimum, it becomes possible to design the non-metallic foreign matter removing apparatus with minimum height of the facility with achieving the targeted non-metallic foreign matter separating and removing effect.

According to the present invention, the apparatus for effectively removing the non-metallic foreign matter which can be a cause for defects in the products, such as sheet can be formed without excessive enlarging of the facility. Furthermore, by employing the apparatus, the non-metallic foreign matter can be steadily removed even in the non-steady state, such as during ladle replacement and so forth to lower the fault ratio of the product and to enable substantial improvement of the yield, Also, as a result, it becomes possible to produce highly purified steel without requiring significant equipment investment and at low cost.

(B) Example I of Construction of Tundish

Figure 24:
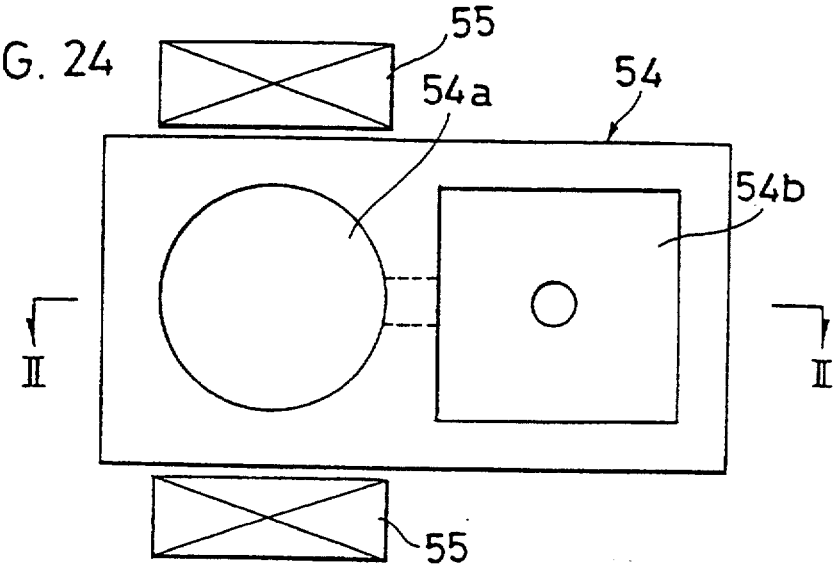
FIG. 24 is a plan view of an intermediate container for the continuous casting of the molten metal showing the one embodiment of the first invention.
Figure 25:
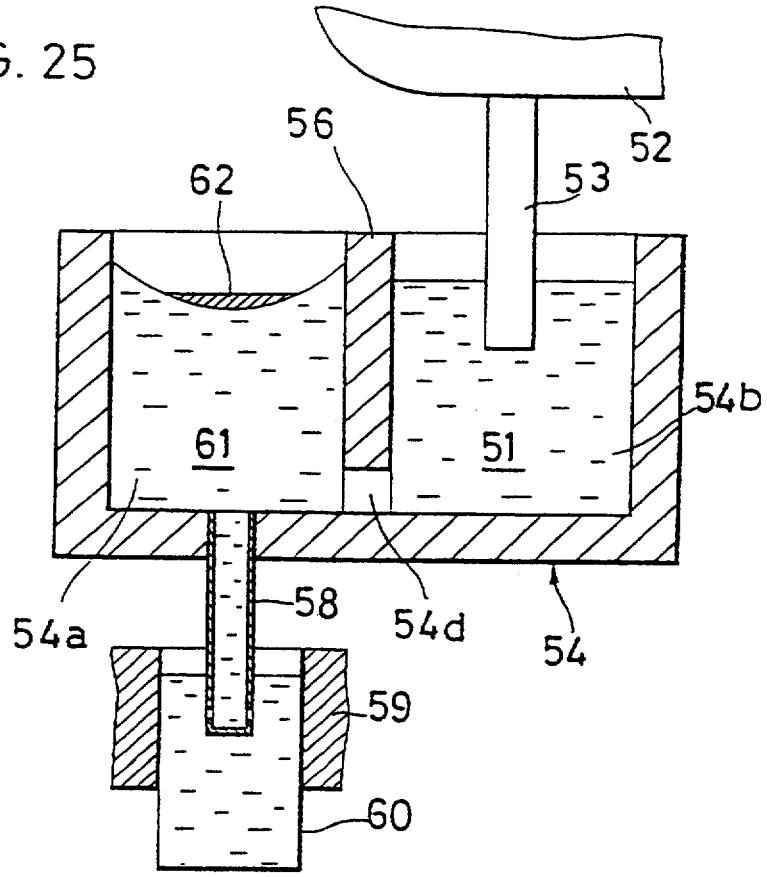
FIG. 25 is a section as viewed along line II—II of FIG. 24.

FIGS. 24 and 25 shows another embodiment of a tundish for continuous casting of the molten metal, according to the present invention.

A tundish 54 has a swirl flow bath 54*a* partitioned by a wall 56. A ladle nozzle 53 extending from the bottom of a ladle 52 is inserted into a receptacle bath 54*b* which is positioned right side of the wall 56 seeing in FIG. 25.

An opening 54*d* for communicating the receptacle bath 54*b* and the swirl flow bath 54*a* is defined below the wall 56.

Opposing to the outer wall of the swirl flow bath 54*a*, a rotating field generation coil 55 is arranged.

A tundish nozzle 58 is provided at the bottom of the swirl flow bath 54*a* so that the molten metal is poured into a mold 59 arranged therebelow. A sliding gate or a stopper for controlling the molten metal flowing out amount is provided in the tundish nozzle 58.

Figure 26:
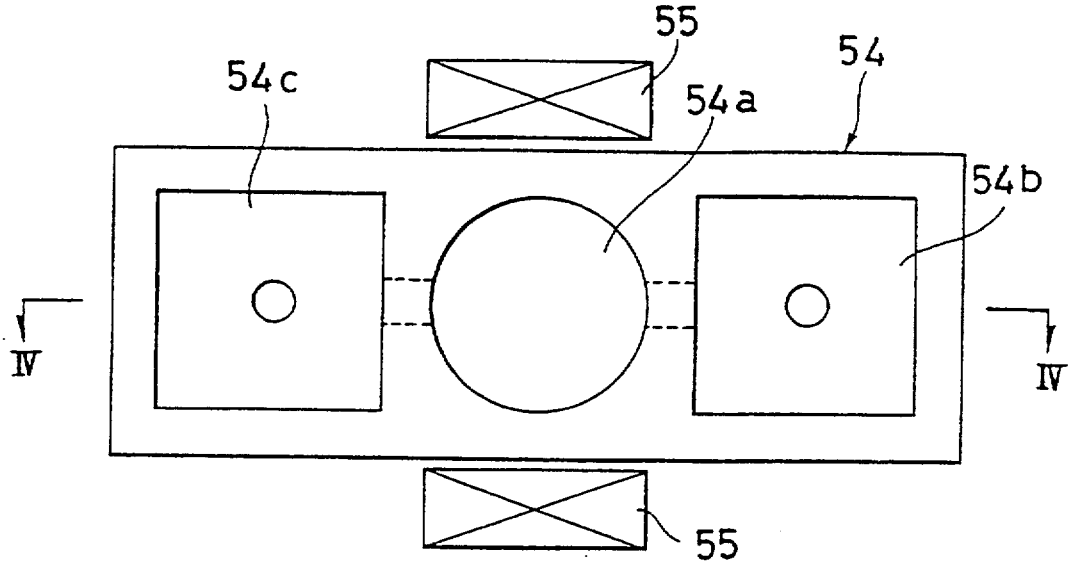
FIG. 26 is a plan view of an intermediate container for the continuous casting of the molten metal showing the one embodiment of the second invention.
Figure 27:
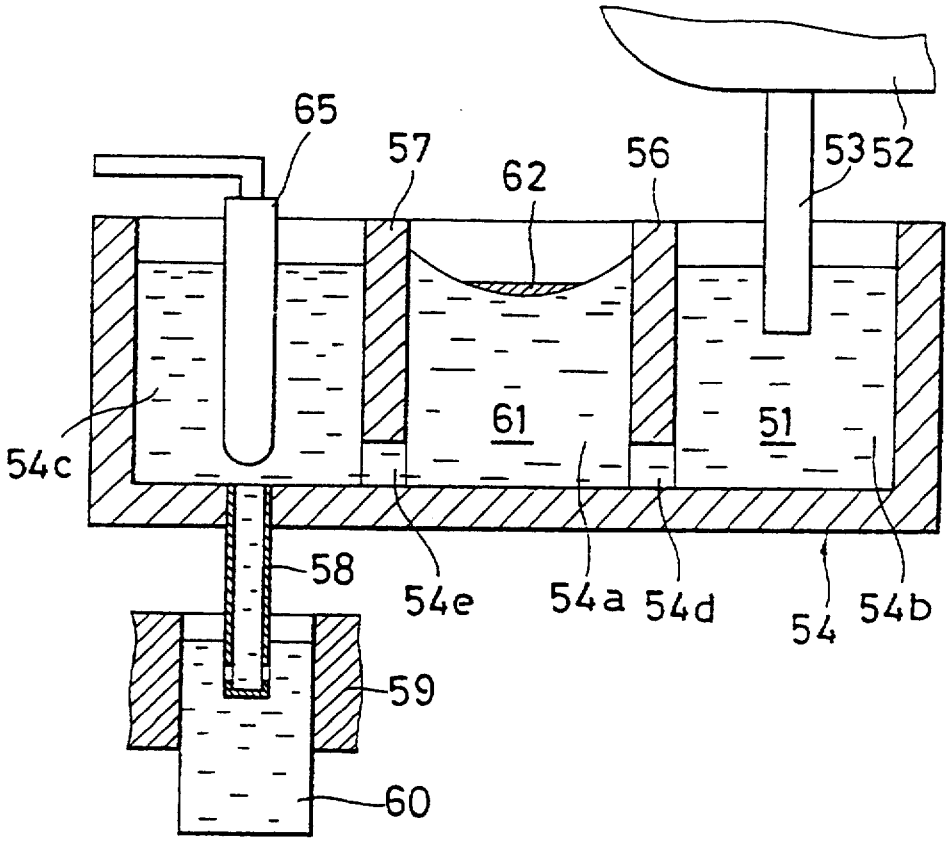
FIG. 27 is a section taken along line IV—IV of FIG. 26.

FIGS. 26 and 27 shows one embodiment of the tundish for continuous casting of the molten metal according to the second invention.

The tundish 54 has the swirl flow bath 54*a* defined by walls 56 and 57 at the center thereof. A ladle nozzle 53 extending from the bottom of a ladle 52 is inserted into a receptacle bath 54*b* which is positioned right side of the wall 56 seeing in FIG. 27.

An opening 54*d* for communicating the receptacle bath 54*b* and the swirl flow bath 54*a* is defined below the wall 56.

Opposing to the outer wall of the swirl flow bath 54*a*, a rotating field generation coil 55 is arranged.

At the left side of the wall 57, a flowing out bath 54*c* communicating with the swirl flow bath 54*a* via an opening 54*e* is provided. A tundish nozzle 58 is provided in the flowing out bath 54*c* so that the molten metal is poured into a mold 59 arranged therebelow. 65 denotes a stopper for controlling molten metal flowing out amount through the tundish nozzle 58.

Figure 28:
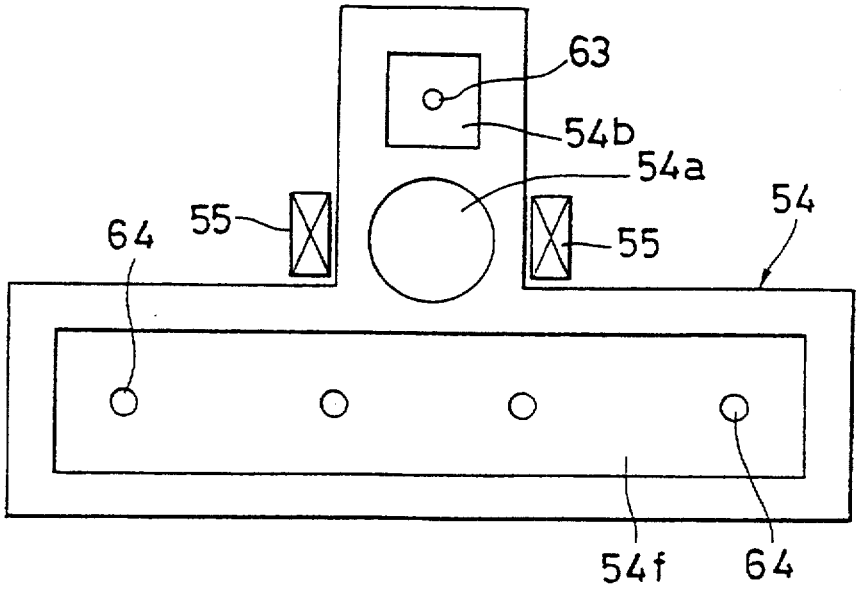
FIG. 28 is a plan view showing one example of the intermediate container applied for a plurality of strands.
Figure 29:
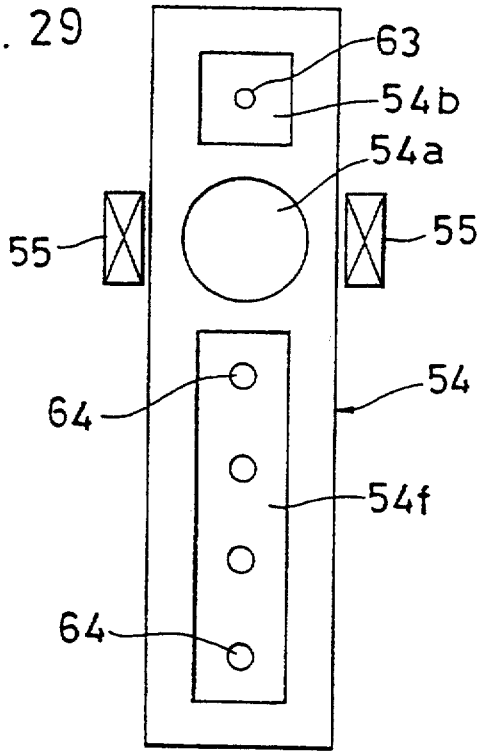
FIG. 29 is a plan view showing another example of the intermediate container as applied to a plurality of strands.

Although the foregoing are the case where the single tundish nozzle is provided, the present invention is applicable for continuous casting multi-stranders. Namely, in case of the multi-stranders, it have been generally required rotating field generation devices (coils) in the corresponding number to the stranders. However, it becomes possible to place the coil at one position. FIGS. 28 and 29 show the example thereof.

In FIG. 28, a distribution bath 54*f* of substantially rectangular configuration is provided in place of the above-mentioned flowing out bath at a position perpendicular to the receptacle bath 54 and the swirl flow bath 54*a*. A plurality of flowing out openings 64 are provided at the bottom of the distribution bath 54*f*. In this case, the coil 55 is required to be placed at one position. 63 is an induction opening of the molten metal poured from the ladle (not shown).

On the other hand, in FIG. 29, the distribution bath is provided on the extension of the receptacle bath 54*b* and the swirl flow bath 54*a*. In this case, the coil is required to be placed at only one position.

Next, an example of operation of the tundish according to the present invention will be discussed with reference to FIGS. 26 and 27. The molten metal 51 is poured into the receptacle bath 54*b* of the tundish 54 via the ladle nozzle 53 from the ladle 52. In the receptacle bath 54*b*, the molten metal does not flow in swirl fashion. Therefore, melting of the ladle nozzle due to flow velocity can be significantly decreased and breaking of the nozzle will never been caused. In addition, even at the occurrence of floating slag is admixed with the molten metal upon ladle replacement or so forth, the slag can be separated in the swirl flow bath as the next bath. The received molten metal 51 passes through the opening 54*d* through the wall 56. Then, with the magnetic field generated by the rotating field generation coil 55, the molten metal in the swirl flow bath 54*a* is flown in horizontal swirl fashion. The molten metal purified by separating the slag 62 reaches the flowing out bath 54*c* through the opening 54*e* of the wall 57. The molten metal then reaches the tundish nozzle 58 after naturally floating the residual non-metallic foreign matter in the flowing out bath 54*c*. Namely, variation of the molten metal surface due to flow velocity of the molten metal 61 in the swirl flow bath 54*a* rotated by the rotating field generation coil 55 is restricted by the walls 56 and 57. Also, it can prevent the slag separated and floating from flowing out to the downstream side.

In cases of FIGS. 24 25 and 28, 29, the separation of the slag from the molten metal reaching the swirl flow bath 54*a* from the receptacle bath 54*b* is identical to the above.

Since the present invention is constructed as set forth above, the casting with high quality can be done efficiently by providing the swirl flow bath separated from the receptacle bath of the molten metal by the wall, in the tundish, generating the horizontal swirl flow in the swirl flow bath and thus performing slag separation.

(C) Example II of Construction of Tundish

An apparatus (tundish) 80 for removing the foreign matter in the molten steel, according to the present invention, has the swirl flow bath 71 and a floatation bath 72. The molter, steel 77 is poured to the swirl flow bath 71 as illustrated by an arrow in FIG. 37 through a nozzle 73 from the ladle (not shown). The poured molten steel is preferably flown in swirl fashion in the horizontal direction as illustrated by an arrow in FIG. 36 by a rotating or shifting field generation device (hereafter referred to as coil) 74. By this, the foreign matter in the molten steel 77 or the foreign matter due to melting of the tundish 80 can be separated and float on the parabolic swirl flow in the swirl flow bath.

Here, the molten steel stays in the swirl flow bath 71 over a certain period and then flows into the floatation bath 72 through a communication opening 75 provided in a partitioning wall 78. Most of the foreign matter is aggregated and separated in the swirl flow bath 71. The remainder can be almost completely floated in the floatation bath 72. Subsequently, the molten steel is introduced into the mold (not shown) via a flowing out opening 76. On the other hand, concerning the position of the communication opening 75 for communication from the swirl flow bath 71 to the floatation bath 72, there is shown an example, in which the communication opening is shown at a position on a line extending through the induction opening 73 and the flowing out opening 76. However, the position is not limited to that illustrated.

Figure 38:
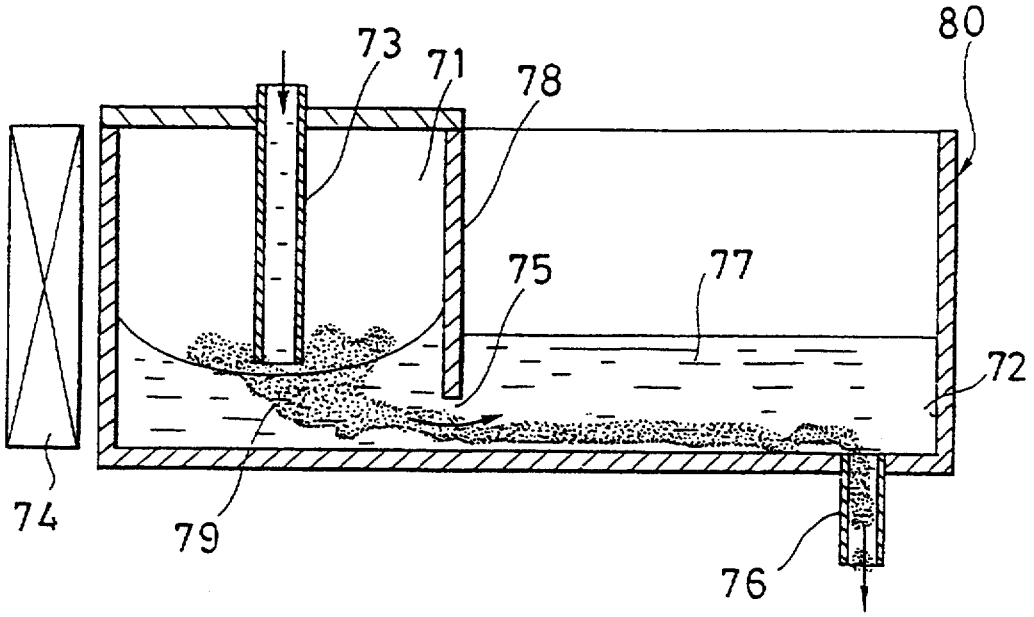
FIG. 38 is an explanatory illustration showing movement of the foreign matter in the tundish when a communication opening is directly formed on the bottom wall of the swirl flow bath.

In the present invention, it is necessary to space the lower end position of the communication opening 75 away from the bottom wall of the swirl flow bath 71 in a height of h by providing a baffling wall 78*a*. Even at substantially high foreign matter separation ability, if the communication opening 75 is directly provided at the bottom wall of the swirl flow bath 71, it has been confirmed that a certain proportion of the accumulated matter of the foreign matter and the slag 79 may flow into the floatation bath 72 despite of the presence of the centrifugal separation effect, when the level of the molten steel 77 is lowered such as in the ladle replacement, as shown in FIG. 38.

Figure 39:
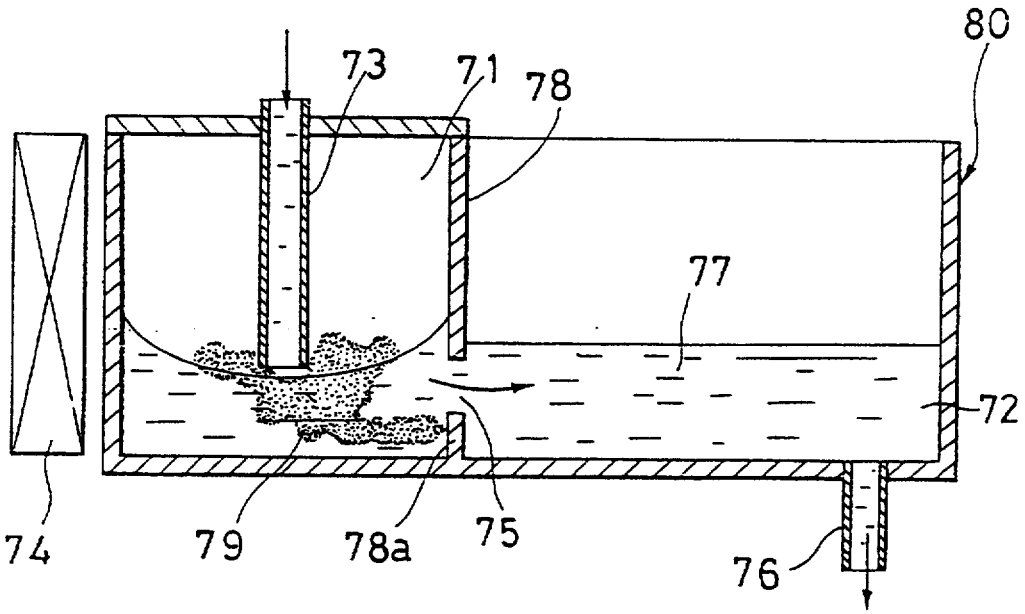
FIG. 39 is an explanatory illustration showing movement of the foreign matter in the tundish according to the present invention.

In contrast to this, in FIG. 39, flowing out of the foreign matter and the slag into the floatation bath 72 can be prevented even when the level of the molten steel 77 is lowered unless the level is excessively lowered or excessive amount of the foreign matter and the slag is accumulated in the swirl flow bath 71, as shown in FIG. 39.

Figure 40:
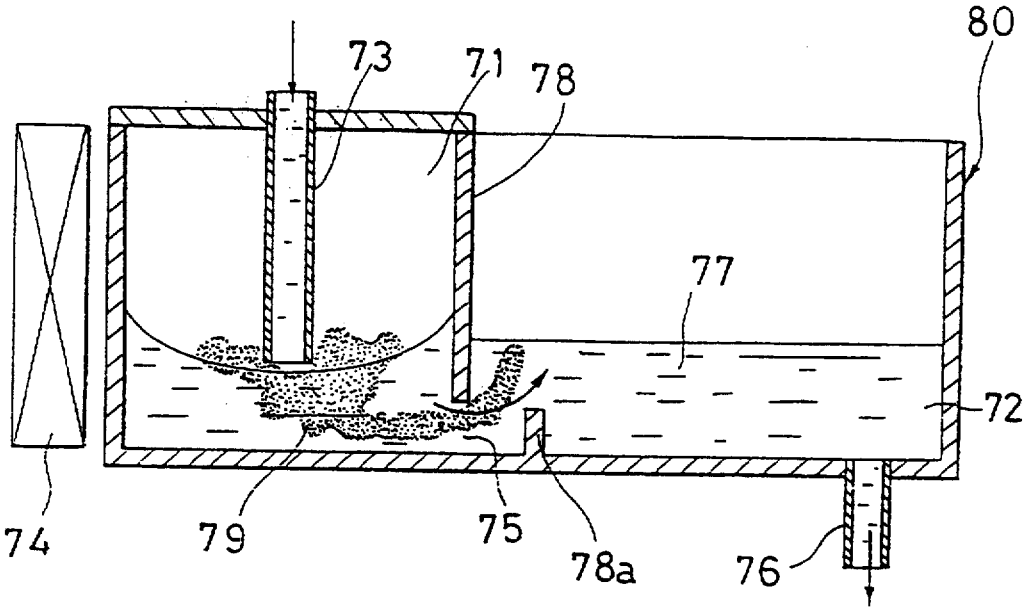
FIG. 40 is an explanatory illustration showing movement of the foreign matter in the tundish, in which a baffling wall is provided on the bottom wall of the floating bath.

Also, it is possible to position the communication opening 75 at the bottom wall of the swirl flow bath 71 and to provide a baffling wall. 78*a* on the bottom wall of the floatation bath 72, as shown in FIG. 40.

A horizontal distance between the baffling wall 78*a* and 78 is desired to be approximately 300 mm. When the baffling wall 78*a* is presented in the vicinity of the flowing out opening 76 to the mold, flowing out of the foreign matter or slag 79 cannot be prevented and substantially all amount will flow out.

Namely, the present invention provides the buffer function of the molten metal in the non-steady state, such as ladle replacement or so forth, by separating the swirl flow bath 71 and the floatation batch 72 without increasing the dimension of the rotating portion. Also, by certainly providing floating period, the enhanced foreign matter separation effect can be achieved. Furthermore, by specifying the position of the communication opening 75 between the swirl flow bath 71 and the floatation bath 72, flowing out of the foreign matter by short circuit can be prevented to further ensure the foreign matter separation effect.

Figure 36:
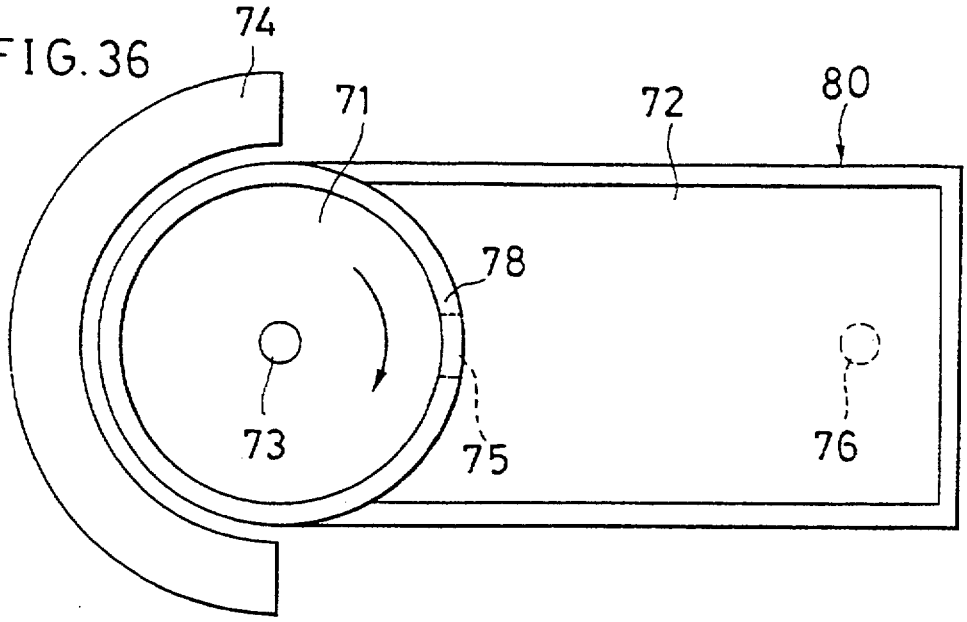
FIG. 36 is a plan view of an apparatus for removing non-metallic foreign matter in the molten metal showing one embodiment of the invention.

Namely, in FIG. 36, the molten steel purified in the swirl flow bath 71 flows into the floatation bath 72 through the communication opening 75 from the swirl flow bath 71 and statically placed therein so that the residual foreign matter will float up and separated in the floatation bath 72. The molten steel thus further purified is poured into the mold (not shown)to be formed into the casted product via the flowing out opening 76.

Since the present invention is constructed as set forth above, the apparatus for effectively removing the foreign matter which can be a cause of defect in the product, such as a sheet, without excessively increasing the size of the facility. In addition, by using such apparatus, the steady foreign matter removing effect can be obtained even at the non-steady state, such as during ladle replacement to lower fault ratio of the product and thus significantly improve the yield.

Also, as a result thereof, the highly purified steel can be obtained without substantial equipment investment and thus at low cost.

(D) Example III of Construction of Tundish

Figure 41:
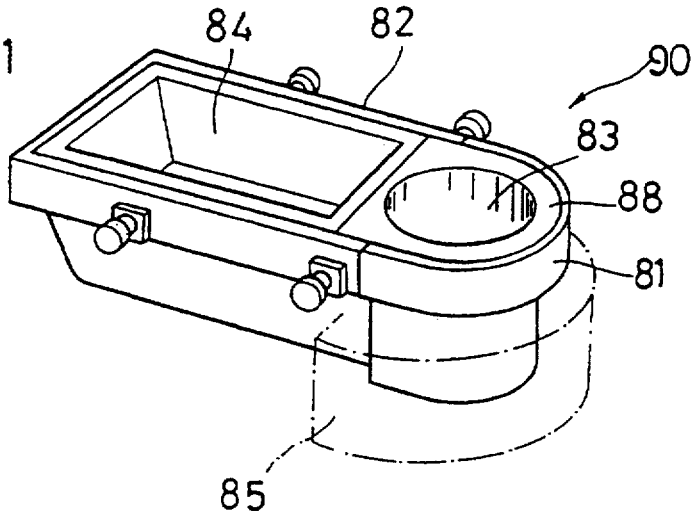
FIG. 41 is a perspective view showing one embodiment of the tundish according to the invention.

Next, as another example of the tundish applying the electromagnetic coil device according to the present invention, the case of the continuous casting of the steel will be briefly discussed. For example, in the system, in which the ladle, the tundish and the mold are combined, the molten metal in the ladle is poured in a swirl flow bath 83 of a tundish 90 having the swirl flow bath 83 and a distribution bath 84 as shown in FIG. 41.

In the swirl flow bath 83, a rotational force is applied to the molten metal in the swirl flow bath 83 by a shifting field generating electromagnetic coil 85 no flow in the swirl fashion. A portion of the molten metal is transferred from the bottom portion of the swirl flow bath 83 to the distribution bath 84 and then poured into the mold through the bottom portion of the tundish 90 to be cased into a predetermined dimension. 82 denotes an iron skin, and 88 denotes a refractory material.

Accordingly, in the process set forth above, the non-metallic foreign matter is separated from the molten metal in the swirl flow bath 83, and the purified molten metal is poured into the mold via the distribution bath 84.

The present invention forms the container portion of the tundish in the region placed within the magnetic field of the coil 85, of a non-conductive body.

In the conductive body placed within the shifting field, a force is generated by co-action of a magnetic field generated by an eddy current and the shifting field. By forming the body to be placed in the shifting field of the electrically non-conductive body, generation of the eddy current can be prevented to suppress generation of the unnecessary force.

According to the present invention, since the member of the non-conductive body container portion 81 of the tundish to be placed within the shifting field is formed of the electrically non-conductive body, such as ceramic or so forth, the eddy current will never be produced and thus the force will not be generated. Therefore, unnecessary force will not be generated in the tundish 90 by the shifting field in the electromagnetic field range applied by the coil 85 to suppress vibration and whereby to make metering of the molten steel in the tundish stable. Also, since the stabilization of the flow at the surface of the molten steel can be promoted to allow avoidance of the penetration of the impurity, such as the non-metallic foreign matter to achieve stable casting operation and production of high steel quality.

In addition, since the vibration can be suppressed, loosing of the joint of the refractory material 88 can be avoided to eliminate possibility of steel leakage.

Figure 43:
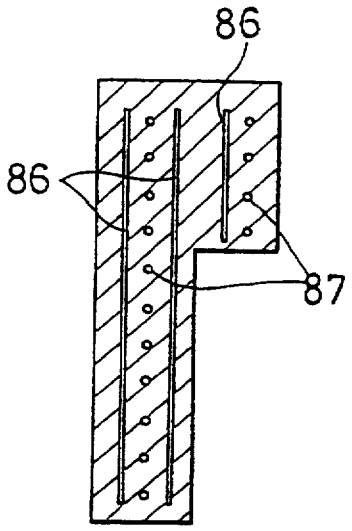
FIG. 43 is a section taken along line III—III of FIG. 42.

FIGS. 41 and 43 show another construction of the non-conductive body container portion 81 of the tundish 90. Although metallic wires are used in the non-conductive body container portion 81 for the purpose of reinforcement, magnitude of the eddy current is minimized by arranging the vertical metal wires 86 and the lateral metal wires 87 to avoid electrical contact between the reinforcement wires; suppression of the vibration force is thereby enabled.

As the reinforcement material 86 and 87, an iron reinforcement, carbon fiber are preferred. However, it can be an engineering plastics.

Although the foregoing discussion is given for the molten steel as the molten metal, the invention should not be limited thereto.

It should be noted that, in the present invention, the coil device is an electromagnetic coil device which is generally used and generates shifting field, and can be a coil for a linear motor.

Since the present invention is constructed as set forth above, by forming the member of the swirl flow bath of the tundish to be placed within the electromagnetic field applied by the coil, with the non-conductive body, unnecessary force will not be created in the tundish to provide effect of suppression of vibration. Also, with this, stable operation and product quality can be obtained.

In addition, by reinforcing the material forced of the non-conductive body with the reinforcement material, loosing of the joint between the refractory material in the tundish can be prevented to avoid danger of leakage of the molten metal.

(E) Example I of Construction of Coil

Further detailed discussion will be given herebelow for the apparatus for removing the non-metallic foreign matter in the molten metal, according to the present invention, with reference to FIG. 44.

At first, as one example of the shown aspect of the non-metallic foreign matter removing apparatus, the case of the continuous casting of the steel will be discussed briefly. As shown in FIG. 44, for example, in the system of combination of a ladle (not shown), a tundish 91 and a mold (not shown), a molten steel 94 in the ladle is poured into the tundish 91.

In the tundish 91, rotational force and heat is provided for the molten steel 94 in the tundish 91 by switching of the frequency of the shifting field generation coil 93 so as to promote floating and separation of the non-metallic foreign matter. Here, the molten metal 94 flown in the swirl fashion is poured into the mold via a nozzle 97 provided at a position of the bottom portion of the tundish 91 offset from the rotation center and casted into a predetermined dimension.

Accordingly, in such process, the non-metallic foreign matter is separated from the molten steel 94 in the tundish and the purified molten steel is poured in the mold.

Figure 44:
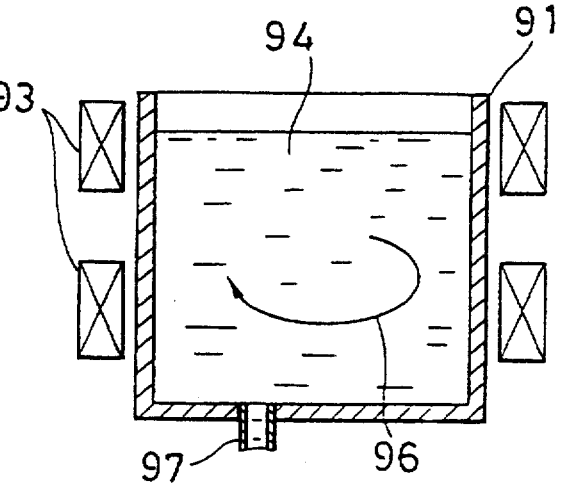
FIG. 44 is a section of the apparatus for removing the non-metallic foreign matter in the molten metal showing one embodiment of the invention.
Figure 45:
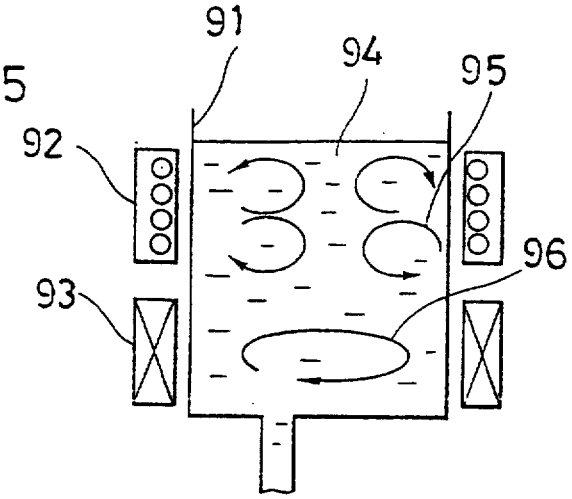
FIG. 45 is an explanatory illustration of a flow pattern of the molten steel in the conventional apparatus for removing the non-metallic foreign matter in the molten metal.
Figure 46:
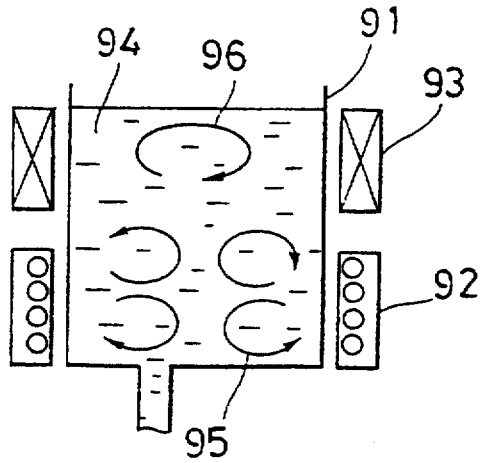
FIG. 46 is an explanatory illustration showing a flow pattern of the molten metal in another example of the conventional apparatus for removing the non-metallic foreign matter in the molten metal.

The present invention can generate necessary horizontal swirl flow 96 and maintain the desired molten steel temperature for the molten steel 94 in the tundish 91 by providing a plurality of channels of coils 93 which are arranged vertically on the outer periphery of the tundish and independent of each other(in FIG. 44, upper and lower two channels of coils 93 are provided). At this time, even when both of the upper and lower coils 3 are actuated simultaneously, a vertical reversing flow by heating will never be generated.

Here, in case of two channels of the coils 93 are provided, one can be used for heating and the other for rotating, or vise versus. The frequency of the coil for heating is desirably 50 to 100 Hz, and the frequency of the coil for rotating is desirably 0.5 to 10 Hz.

In case of reduction of the molten steel amount, such as during non-steady state, the lower channel coil may be switched to operate for heating.

By providing vertically arranged coils and appropriately switching the frequency or current, more delicate adjustment depending upon the molten steel amount, or depending upon the molten steel temperature and the amount of the foreign matter can be performed.

Since the coil condition can be varied in such a manner that, in case of the frequency, switching is made between heating and rotation speed, and in case of the current, the intensity of the magnetic field is varied, heating of the molten steel and the rotating stirring of the molten steel in the swirl flow bath can be freely controlled.

It should be noted that the molten metal to which the present invention is applied is not specified to the molten steel. Also, with respect to the tundish, the configuration should not be specified as long as it has at least the swirl flow bath.

According to the present invention, as shown in FIG. 44 a plurality of channels of shifting field generation coils 93 are arranged in the vertical direction of the swirl flow bath of the tundish so that one of the coils is used as a coil primarily for rotating stirring and the other of the coils is used as a coil primarily for heating to apply the frequency suitable for heating the molten steel. By this, the vertical reversing flow 95 to be generated by the conventional heating coil can be eliminated. Therefore, with maintaining the foreign matter separating function by the rotating stirring flow 96, temperature drop of the molten steel 94 can be certainly prevented by heating.

Since the present invention is constructed as set forth above, horizontal swirl flow can be obtained in conjunction with heating to achieve separation of the foreign matter. Therefore, high cast block quality can be obtained.

(F) Example II of Construction of Coil

A tundish having the shifting field generation coil according to the present invention will be discussed herebelow in detail with reference to FIG. 47.

At first, brief discussion will be given for the case of the continuous casting of the steel as one example of removal of the non-metallic foreign matter by the tundish according to the present invention. For example, in the system combining a ladle (not shown), a tundish 110 and a mold (not shown), as shown in FIG. 47, a molten steel 106 in the ladle is poured into the tundish 110.

With the tundish 110, rotational force is applied to the molten steel 106 in the tundish 110 by shifting field generation coils 101*a* and 101*b*. Then, a part of the molten steel 106 flowing in swirl fashion is poured into the mold through a nozzle 107 (not shown) provided through the bottom of the tundish 110 and casted into a predetermined dimension.

Accordingly, in the process set forth above, the non-metallic foreign matter is separated from the molten steel 106 in the tundish 110, and purified molten steel is poured into the mold.

The present invention includes a plurality of channels of the mutually independent shifting field generation coils, e.g. coils 101*a* and 101*b*, arranged vertically on the outer periphery of the tundish 110. By this, necessary horizontal swirl flow 109 can be induced in the molten steel 106 in the tundish, and can maintain the thin depth of the concaved surface on the molten steel surface (FIG. 47 shows upper and lower two channels of coils 101*a* and 101*b*). At this time, the upper and lower coils 101*a* and 101*b* can be actuated simultaneously, or one of those can be actuated depending upon the necessity.

Here, the coils 101*a* and 101*b* are adjusted in current and frequency, or the polarity to be applied to the coils by an appropriate control device (not shown) in such a manner that the flow velocity of swirl flow 109*a* of the molten steel induced by the coil 101*a* is lower than the flow velocity of the swirl flow 109*b* induced by the coil 101*b*. The control device may be a power source device comprising a thyristor invertor or a cycloconverter, for example.

Although the foregoing example arranges the coil in the upper channel and the lower channel, it can be three, four or more. At this time, the coil current, frequency or polarity may be modified so that the flow velocity of the swirl flow is gradually lowered from the lower coil to the upper coil.

By providing vertically arranged multi-channel coils with appropriately adjusting the current, frequency or the polarity, delicate adjustment depending upon the amount of molten steel in the swirl flow bath, or depending upon the amount of the foreign matter can be performed.

Modification of the coil condition is adapted to modify the magnetic field intensity in case of the current, the rotation in case of the frequency and generation of the shifting field in case of the polarity, rotating stirring and the concave depth of the surface of the molten steel in the swirl flow bath can be freely controlled.

Here, with respect to modification of the polarity, by setting the swirling direction to be induced by the lower channel to be opposite to the swirling direction to be induced by the upper channel, braking effect will be active on the swirling direction of the molten steel to reduce the flow velocity of swirling molten steel in the upper phase.

It should be noted that the molten metal, to which the present invention is applied, is not specified to molten steel. Also, with respect to the tundish, the configuration is not specified as long as at least the swirl flow bath is provided.

According to the present invention, since the shifting field generation coils 109*a* and 109*b* are provided at the upper and lower portions of the swirl flow bath 110*a* of the tundish 110, to permit independent control of the swirling velocity in the height direction of the molten steel, the concave depth (Z) due to swirl flow can be reduced at the upper phase of the molten steel. Therefore, a submerged nozzle 107 for pouring the molten steel 106 from the ladle 105 may be required to have the length substantially equivalent to that in the conventional one which is adapted for the case where the molten steel is not flown in the swirl fashion. Therefore, increasing of cost for the nozzle and frequency of the breakage of the nozzle can be avoided. Also, since the area of the molten steel surface can be maintained at the conventional level, it becomes possible to maintain the oxidation of the molten steel at the conventional level. Furthermore, at the lower phase of the molten steel, sufficiently high swirling velocity for ensuring the foreign matter separation function can be obtained.

Since the present invention provides the upper and lower shifting field generation coil to enable independent control of the flow velocities of the swirl flow at upper and lower regions in the height direction of the molten metal, in the tundish, the length of the submerged nozzle can be shorter in comparison with the conventional case where only one shifting magnetic field coil is employed for inducting the swirl flow. Also, it minimizes oxidation of the molten metal and certainly provide the foreign matter separating function.

(G) Example III of Construction of Coil

Further detailed discussion will be given herebelow with respect to the tundish having a shifting magnitude generation coil according to the present invention.

Figure 51:
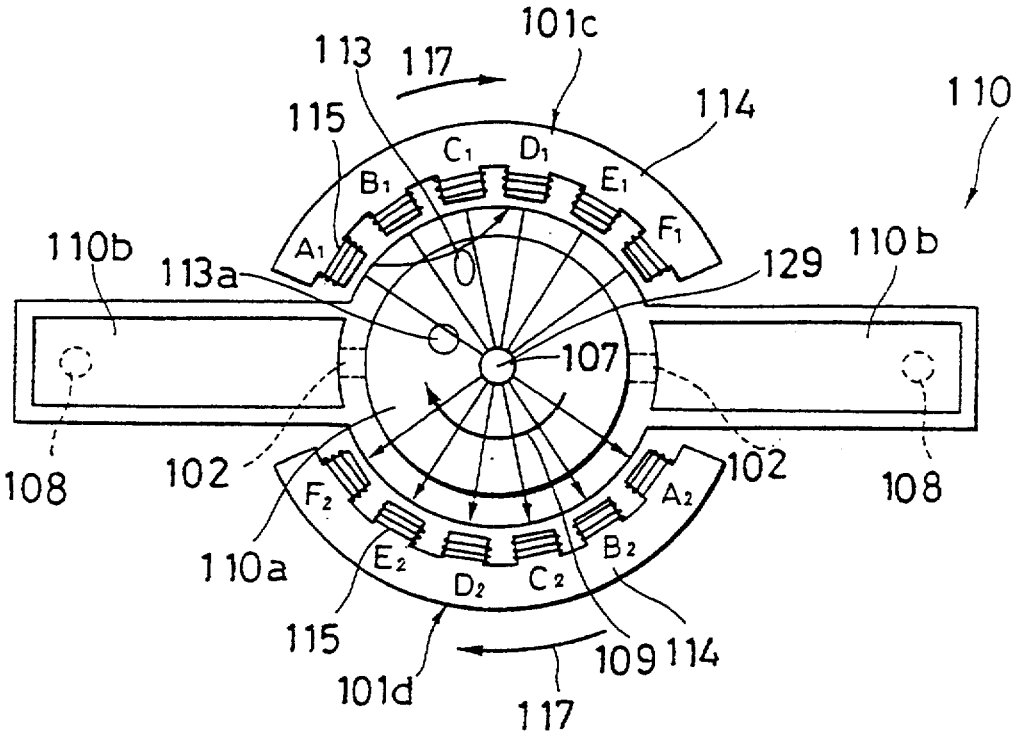
FIG. 51 is an explanatory illustration showing stirring of the molten steel in the tundish according to the invention.

In the present invention, the coil device is separated into a pair by the floatation baths at both sides of the tundish. Namely, the tundish has a central swirl flow bath 110*a* and floatation baths 110*b* at both sides thereof, as shown in FIG. 51. Since the outer periphery of the swirl flow bath 110*a* is separated by the floatation baths 110*b* at both sides, the coil device also becomes the pair of 101*c* and 101*d*.

Each coil device 101*c* and 101*d* is formed by arranging the winding coils 115 on an arc-shaped iron core 114. The number of the coils 115 in the coil devices 101*a* and 101*b* becomes equal to each other when the floatation baths 110*b* are aligned on a line extending trough the swirl center 129 of the molten steel in the swirl flow bath 110*a*, as shown in FIG. 51. Also, respective of the winding coils 115 are arranged in substantially symmetric positions with respect to the swirl center of the molten steel in the swirl flow bath 110*a*.

Figure 55:
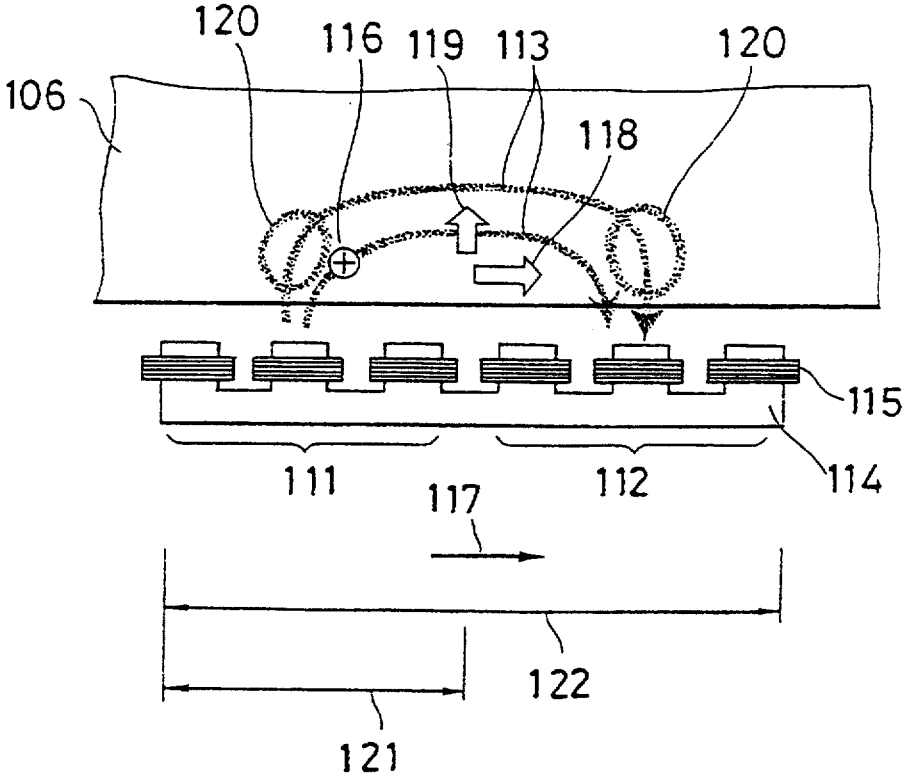
FIG. 55 is an explanatory illustration showing manner of providing a force for moving for the molten steel by a shifting field.

Here, in the present invention, the electrodes forming the coil devices 101*c* and 101*d* are arranged as $A_1$, $B_1$, $C_1$, $D_1$, $E_1$ and $F_1$, and $A_2$, $B_2$, $C_2$, $D_2$, $E_2$ and $F_2$ and the coil winding direction or the current to be charged are differentiated so that the polarity of respective symmetric position may be different from each other (for example, when $A_1$ has N pole, $A_2$ becomes S pole). By this, as discussed with reference to FIG. 55, with respect to the magnetic flux density component 120 in the vertical direction to the molten steel in the coils 101*c* and 101*d*, a magnetic flux also acts on the swirl center 129 of the molten steel in the swirl flow bath 110*a* so as to increase the density of the magnetic flux for generating the rotational force in the molten steel to obtain large rotational force. Namely, in FIG. 51, from the electrode $A_1$, a magnetic flux 113 directed to the electrode $D_1$ and a magnetic flux 113*a* directed to the symmetric pole $A_2$ across the swirl center 129 of the molten steel are generated.

Figure 53:
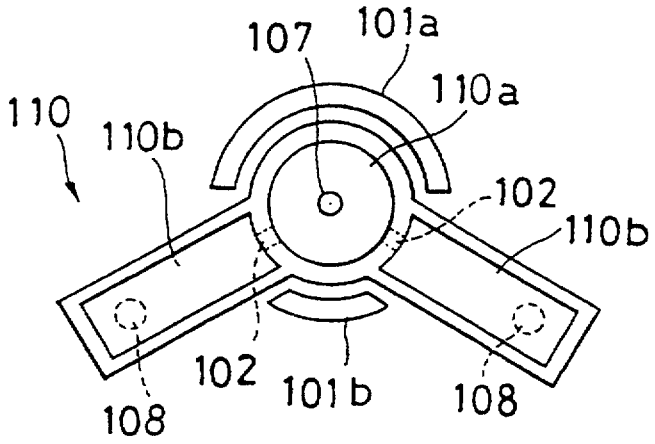
FIG. 53 is an illustration showing one example of arrangement of the coil in the tundish having distributing baths at both sides of the swirl flow bath.
Figure 54:
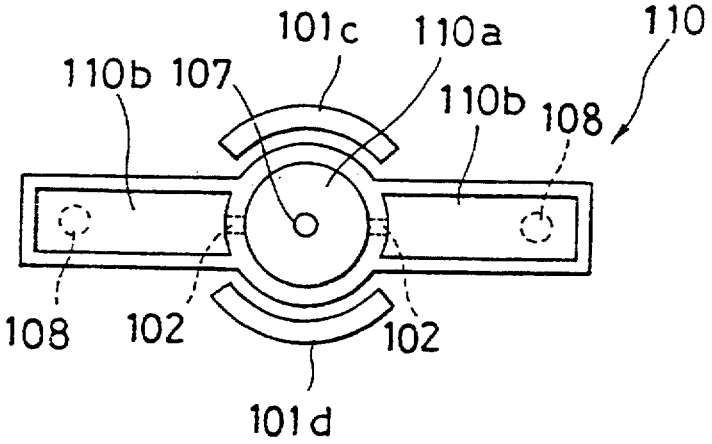
FIG. 54 is an illustration showing another example of arrangement of the coil in the tundish having distributing baths at both sides of the swirl flow bath.

It should be noted, although discussion is given for the example of FIG. 51, namely for the example, in which the coil devices are arranged as illustrated in FIG. 54, similar effect can be obtained even in the case that the coil devices are arranged as illustrated in FIG. 53.

It should be also noted that the molten metal in the present invention is not specified to be molten steel.

Since the present invention is constructed as set forth above, rotating stirring of the molten metal in the tundish can be strengthened and thus the foreign matter separation effect can be enhanced so that good quality of cast block can be obtained.

(H) Example of Construction of the Coil Device

The shifting field generating electromagnetic coil device according to the present invention will be discussed herebelow in detail with reference to FIG. 56.

At first, brief discussion will be given for the case of the continuous casting of the steel as one example of the tundish, to which the electromagnetic coil device according no the present invention is applied. For example, as shown in FIG. 56, in the apparatus combining a ladle 135, a tundish 140 and a mold (not shown), a molten metal 136 in the ladle 135 is poured in a swirl flow bath 140*a* of the tundish 140 which has the swirl flow bath 140*a* and the floatation bath 140*b*.

In the swirl flow bath 140*a*, the rotational force is provided to the molten metal 136 in the swirl flow bath 140*a* by the shifting field generating electromagnetic coil device 131. At this time, a part of the molten metal 136 flowing in swirl fashion is transferred to the floatation bath 140*b* from the bottom portion of the swirl flow bath 140*a*, and then poured in the mold through a sliding nozzle 137 and a immersion nozzle 138 provided through the bottom of the tundish 140 to be casted in a predetermined dimension. 133 denotes an iron skin, and 134 denotes a refractory material.

Accordingly, in the process set forth above, the non-metallic foreign matter is separated from the molten metal 136 in the swirl flow bath 140*a*, and the purified molten metal is poured into the mold via the floatation bath 140*b*.

The present invention is directed to the coil device 131 arranged in opposition to the swirl flow bath 140*a* of the tundish 140, and has a heat insulation material 132 on the outer surface of the coil device 131 opposing to the swirl flow bath 140*a* of the tundish 140.

As the heat insulation material 132, the material which can withstand the radiation heat temperature from the tundish, such as a refractory, can be used.

As the above-mentioned refractory, $Al_2O_3$ type castable refractory and so forth can be used, and the thickness may be approximately 10 to 50 mm.

It is preferred to provide the heat insulation material 132 on the outer surface of the coil 131 at the position opposing to the outer periphery molten metal container and the upper surface thereof.

According to the present invention, since the heat insulating material 132 is provided on the portion of the coil device opposing to the molten metal container, i.e. tundish 140, the radiated heat from the molten metal container 140 will never been transmitted directly to the electromagnetic coil for avoiding failure of the electromagnetic coil. Namely, the surface of conductive wires of the coil is covered with an insulation material. When the temperature of the coil is risen, the insulation material can cause fatigue resulting in shorting. Accordingly, it is desirable to maintain the temperature of the coil device lower than or equal to 170° C. Also, even when molten metal overflows from the molten metal container, it may not directly contact with the electromagnetic coil to avoid failure of the electromagnetic coil due to melting.

It should be noted that the molten metal of the present invention is not particularly specified, and can be steel, for example.

On the other hand, in the present invention, the coil device is a generally used electromagnetic coil device for generating the shifting field, and can be a coil for a linear motor.

Since the present invention is constructed as set forth above, and since the heat insulating material is provided on the electromagnetic coil for generating the shifting field to create the horizontal swirl flow in the molten metal, at the portion opposing to the molten metal container, the radiation heat from the molten metal container can be shut off. Also, the leaking molten steel will never contact with the electromagnetic coil. Therefore, the performance of the electromagnetic coil can be steadily maintained.

(I) Example I of Cooling of Coil

The shifting field generating electromagnetic coil according to the present invention will be discussed hereafter in further detail with reference to the drawings.

Figure 57:
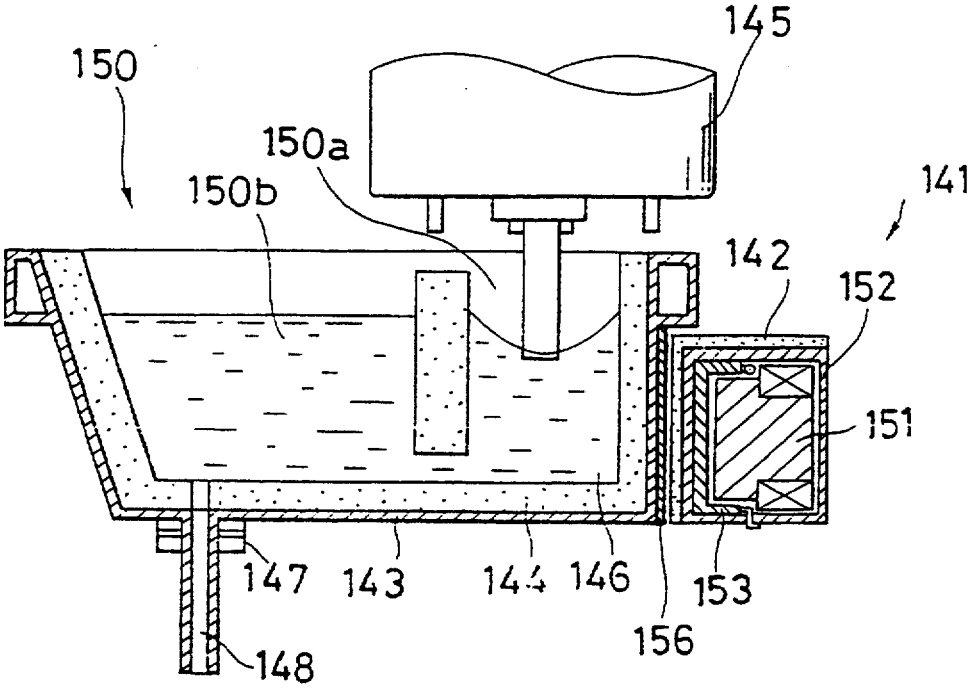
FIG. 57 is a section of the tundish, to which the coil device showing one embodiment of the invention is provided.

At first, brief discussion will be given for the case of the continuous casting of the steel as one example of the tundish, to which the electromagnetic Coil device according to the present invention is applied. For example, as shown in FIG. 57, in the apparatus combining a ladle 145, a tundish 150 and a mold (not shown), a molten metal 136 in the ladle 145 is poured in a swirl flow bath 150*a* of the tundish 150 which has the swirl flow bath 150*a* and the floatation bath 150*b*.

In the swirl flow bath 150*a*, the rotational force is provided to the molten metal 146 in the swirl flow bath 150*a* by the shifting field generating electromagnetic coil device 141. At this time, a part of the molten metal 146 flowing in swirl fashion is transferred to the floatation bath 150*b* from the bottom portion of the swirl flow bath 150*a*, and then poured in the mold through a sliding nozzle 147 and a immersion nozzle 148 provided through the bottom of the tundish 140 to be casted in a predetermined dimension. 143 denotes an iron skin, and 144 denotes a refractory material.

Accordingly, in the process set forth above, the non-metallic foreign matter is separated from the molten metal 146 in the swirl flow bath 150*a*, and the purified molten metal is poured into the mold via the floatation bath 150*b*.

The present invention is directed to the coil device 141 arranged in opposition to the swirl flow bath 150*a* of the tundish 150, and has a cooling device 153 on the inner periphery of a casing 152 of the coil device 141 opposing to the swirl flow bath 150*a* of the tundish 150. Preferably, as shown in FIG. 57, a cooling device 156 may be arranged at the portion of the tundish 150 at least opposing to the coil device 141.

As cooling device 153, one which can cool within the casing 152 which is heated by the heat of the iron skin 143 generating the heat by eddy current, can be used. For example, the cooling device illustrated in FIG. 58 or 59 can be used.

Figure 58:
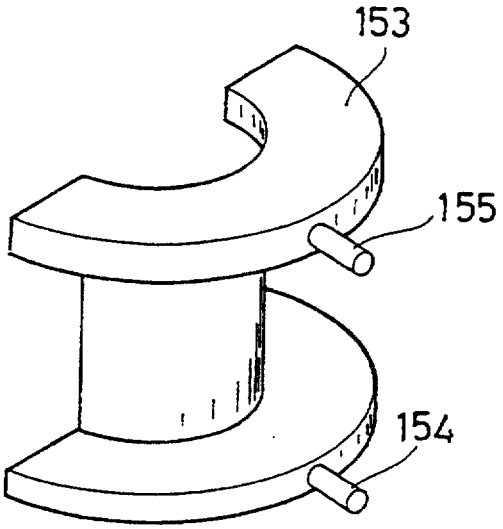
FIG. 58 is a perspective view showing one embodiment of cooling apparatus to be employed in the present invention.

The cooling device of FIG. 58 is a generally used water jacket in which the cooling water is introduced from an inlet 154 and discharged from an outlet 155.

Figure 59:
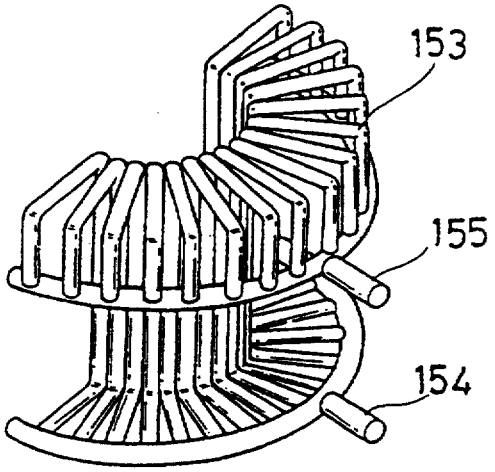
FIG. 59 is a perspective view showing another example of the cooling apparatus to be employed in the present invention.

On the other hand, the cooling device of FIG. 59 is a known water tube panel, in which the cooling water is introduced through the inlet 154, passes through a panel form water tube and is discharged through the outlet 155.

These cooling device 153 is arranged at least in opposition to the swirl flow bath 150*a* of the tundish 150 on the inner periphery of the casing 152, as shown in FIG. 57.

Particularly, when the outer periphery and the upper surface of the casing 152 of the coil device 141, opposing to the swirl flow bath 150*a*, is provided with a lining of the heat insulating material 142 as shown in FIG. 57, the above-mentioned cooling device 153 becomes more necessary since radiation of the casing 152 can be bordered.

It should be noted that the molten metal of the present invention is not particularly specified, and can be steel, for example.

On the other hand, in the present invention, the coil device is a generally used electromagnetic coil device for generating the shifting field, and can be a coil for a linear motor.

Since the present invention is constructed as set forth above, and since the cooling device is provided on the inner periphery of the casing of the electromagnetic coil for generating a shifting field for inducting horizontal swirl flow in the molten metal at the portion opposing to the molten metal container, the heat ,in the casing can be absorbed so that the strength of the casing will not be lowered by the heat, and burning of the coil body can be prevented. Therefore, the performance of the electromagnetic coil device can be steadily maintained.

(J) Example II of Cooling of Coil

The apparatus for removing the non-metallic foreign matter in the molten metal according to the present invention will be discussed hereafter in further detail.

Figure 60:
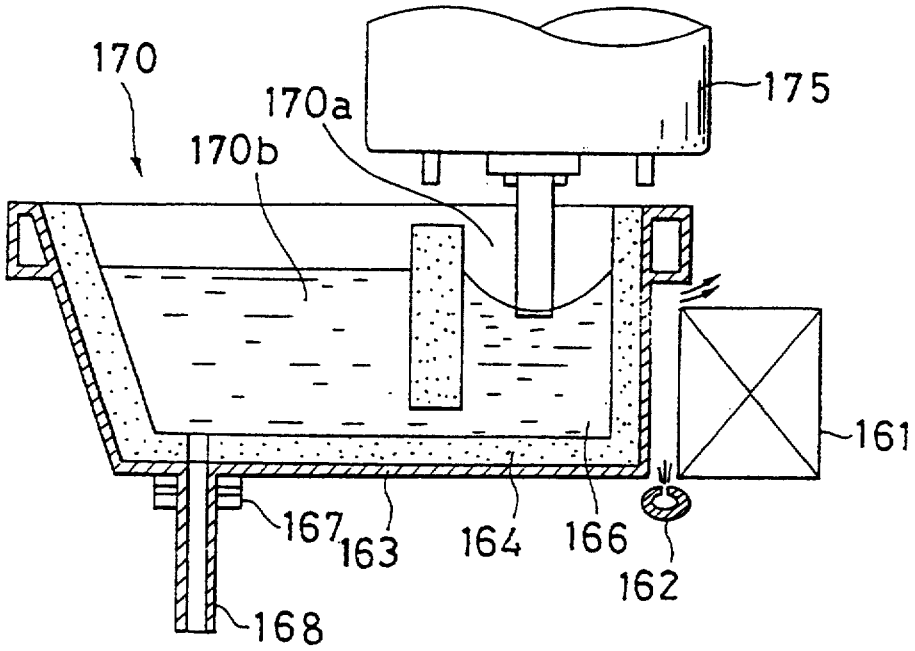
FIG. 60 is a section of non-metallic foreign matter removing apparatus showing one embodiment of the invention.

At first, brief discussion will be given for the case of the continuous casting of the steel as one example of the apparatus for removing the non-metallic foreign matter in the molten metal according to the present invention is applied. For example, as shown in FIG. 60, in the apparatus combining a ladle 175, a tundish 170 and a mold (not shown), a molten metal 166 in the ladle 175 is poured in a swirl flow bath 170*a* of the tundish 170 which has the swirl flow bath 170*a* and the floatation bath 170*b*.

In the swirl flow batch 170*a*, the rotational force is provided to the molten metal 166 in the swirl flow bath 170*a* by the shifting field generating electromagnetic coil device 161. At this time, a part of the molten metal 166 flowing in swirl fashion is transferred to the floatation bath 170*b* from the bottom portion of the swirl flow bath 170*a*, and then poured in the mold through a sliding nozzle 167 and an immersion nozzle 168 provided through the bottom of the tundish 140 to be casted in a predetermined dimension 163 denotes an iron skin, and 164 denotes a refractory material.

Accordingly, in the process set forth above, the non-metallic foreign matter is separated from the molten metal 166 in the swirl flow bath 170*a* , and the purified molten metal is poured into the mold via the floatation bath 170*b*.

The present invention includes a cooling device 162 for discharging a cooling fluid through a gap between the swirl flow bath 170*a* of the tundish 170 and the coil device 161 arranged in opposition to the former.

Figure 61:
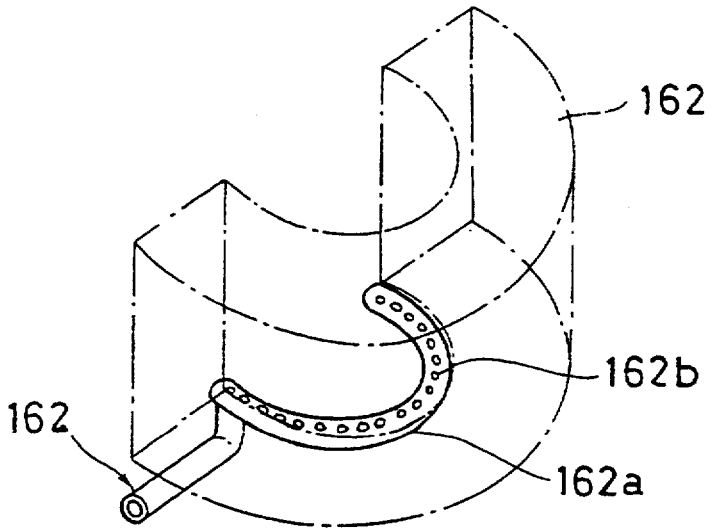
FIG. 61 is a perspective view showing one example of the cooling apparatus to be employed in the present invention.

The cooling device 162 may be constructed as shown in FIG. 61, for example, with a fluid injecting nozzle header 162*a* provided along the lower end of the side surface of the coil device 161 opposing to the tundish 170, which nozzle header directs nozzle holes 162*b* upwardly.

To the above-mentioned cooling device 162, a fluid, such as air, is supplied to be discharged through the nozzle holes 162*b* to cool the outer peripheries of the iron skin 163 of the tundish 170 and the coil device 161. The surface of the conductive wires of the coil is covered with an insulation material. When the temperature of the coil is risen, the insulation material can cause fatigue to resulting in shorting. Accordingly, it is desirable to maintain the temperature of the coil device lower than or equal to 170° C.

It is preferred to use the air with a water mist for high cooling effect.

The flow velocity of the fluid may be selected depending upon the degree of rising of the temperature at the outer peripheries of the iron skin 163 and the coil device 161 and the degree of heat resistances thereof, and may be approximately 10 m/s when the air is used.

On the other hand, in the present invention, the coil device is a generally used electromagnetic coil device for generating the shifting field, and can be a coil for a linear motor.

Since the present invention is constructed as set forth above, and since the cooling fluid is discharged through the gap between the molten metal container, in which the horizontal swirl flow of the molten metal is generated by the shifting field, and the electromagnetic coil device, the heat will not be transmitted to the electromagnetic coil from the molten metal container. Therefore, lowering of the performance or failure of the electromagnetic coil can be eliminated. Also, the temperature of the molten metal container member will non be risen so as to avoid lowering of the strength thereof.

(K) Operation of Apparatus for Removing Non-Metallic

Foreign Matter in Molten Steel

Concrete casting method according to the present invention will be discussed with reference to FIG. 64. A molten metal 184 is poured into a tundish 184 through a semi-long nozzle 183 from a ladle 182. In the tundish 184, the molten metal 191 flows in horizontal swirl fashion by a magnetic field generated by a coil 185.

Figure 62:
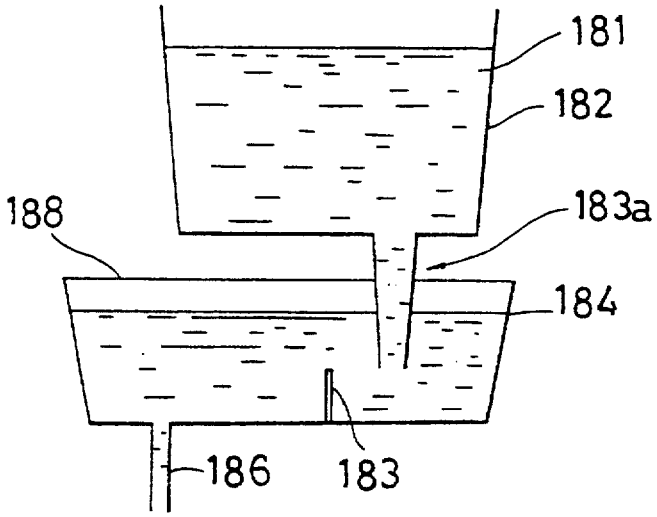
FIG. 62 is an illustration to be used for discussion of the conventional pouring method.

Conventionally, in order to avoid hitting the slag and so forth into the molten metal by the pouring flow from the ladle 182 and to avoid pollution of air due to pouring flow, a submerged type nozzle 183*a* as shown in FIG. 62 has been used. Such type of nozzles tends to cause a trouble in breakage due to rotational force of the molten metal, as set forth above. Therefore, by employing a non-submerged type semi-long nozzle 183, such trouble can be completely avoided. In addition, since the size of the nozzle can be reduced, it also becomes possible to reduce the cost for refractory.

On the other hand, it is possible to separate and remove the non-metallic foreign matter in the tundish 184 by flowing the molten metal 191 in swirl fashion by the magnetic field of the coil 185. Also, by shifting the molten metal pouring position, i.e. the nozzle position, away from the foreign matter and slag concentrated at the center by the rotational force, hitting of the slag due to pouring can be reduced. Therefore, it has been considered appropriate to pour the molten steel from the ladle to the tundish at a position offsetting from the swirl center. However, it has been found when the molten metal is poured from the ladle to the tundish at the position offset from the swirl center, the molten steel flow velocity from the above becomes active to disturb the smooth swirl flow to lower the effect. Conversely, by pouring to the center, even though hitting of slag is caused, since the smooth horizontal swirl flow can be obtained, the slag type foreign matter detected in the cast block 190 can be remarkably reduced in comparison with the prior art. In addition, since the shorting flow which can guide the foreign matter toward the submerged nozzle 186 in the container, and has been a problem in the prior art, can be prevented by the rotational force, so that the tundish can be made much smaller. Also, it can produce high quality cast block without requiring extra gate 193 and thus can contribute for cost down for the refractory.

Figure 63:
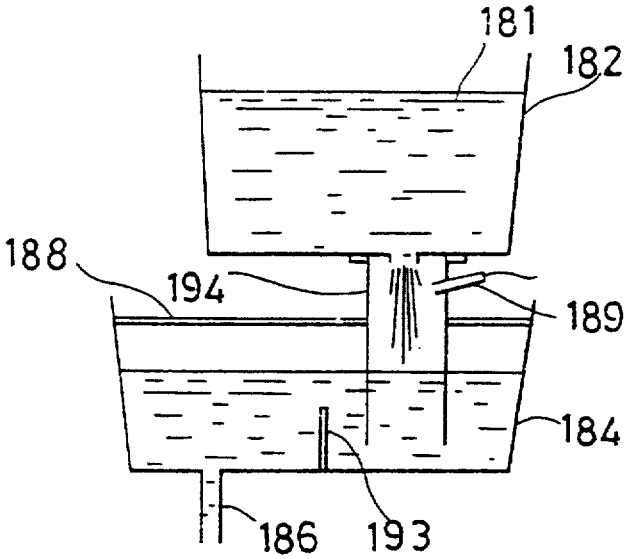
FIG. 63 is an illustration for explanation of the conventional method employing a seal pipe instead of employing a nozzle.

In addition, since the pouring from the ladle 182 to the tundish 184 is performed by employing the nozzle 183 which can be inserted interior space of the tundish, the area of opening portion formed in a lid 188 of the tundish can be made small. Accordingly, seal of the pouring flow can be easily achieved by employing a seal jig 192 or so forth. Furthermore, since the pressure in the tundish 184 can be certainly maintained by gas purging during replacement of the ladle, penetration of the air can be successfully prevented. Therefore, in comparison with the conventional sealing method employing a seal pipe 189 as illustrated in FIG. 63, oxidation of the molten steel and absorption of nitrogen can be remarkably reduced to achieve the seal method equivalent to the case of employing the submerged nozzle.

The present invention achieves the following effect in the casting of the molten metal pouring the molten metal from the ladle to the mold via the tundish, 1) providing horizontal rotational force for the molten metal by a magnetic force in the tundish;
2) the molten steel is poured into the swirl center position of the molten steel in the tundish employing a non-submerged nozzle which can be inserted into the container, in pouring of the molten steel from the ladle to the tundish; and
3) employing a casting method for establishing a seal by an inert gas, separation and removal of the foreign matter can be promoted with preventing oxidation of the molten steel so that contamination of the cast block by the foreign matter can be significantly reduced. Therefore, the defect in the produce can be remarkably improved to improve the yield in the final product.

Additionally, since the method of the present invention permits the tundish too be in small size, it may provide an effect in combination with the reduction of the size of the nozzle to lowering of the cost for refractory.

Figure 66:
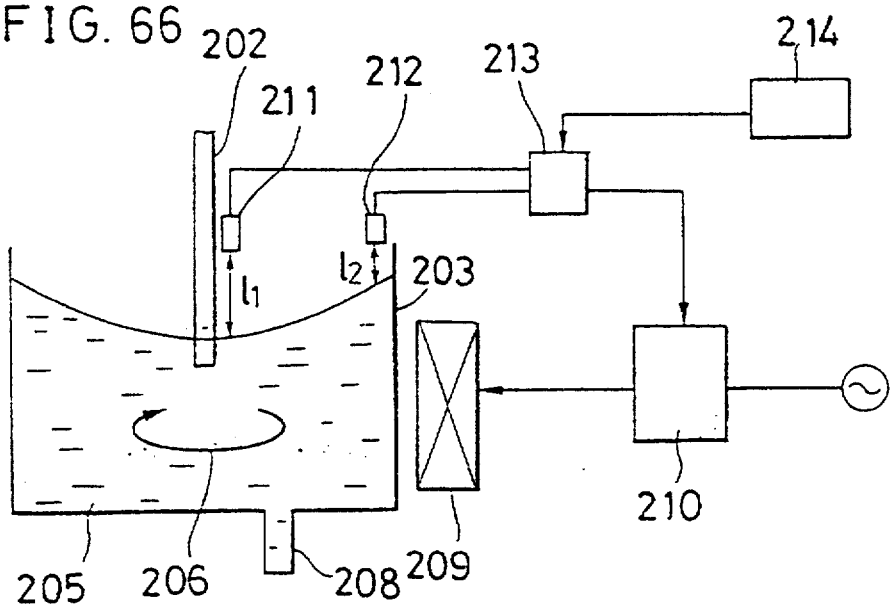
FIG. 66 is a flow diagram showing one embodiment of a molten steel processing apparatus employing the method according to the invention.
Figure 67:
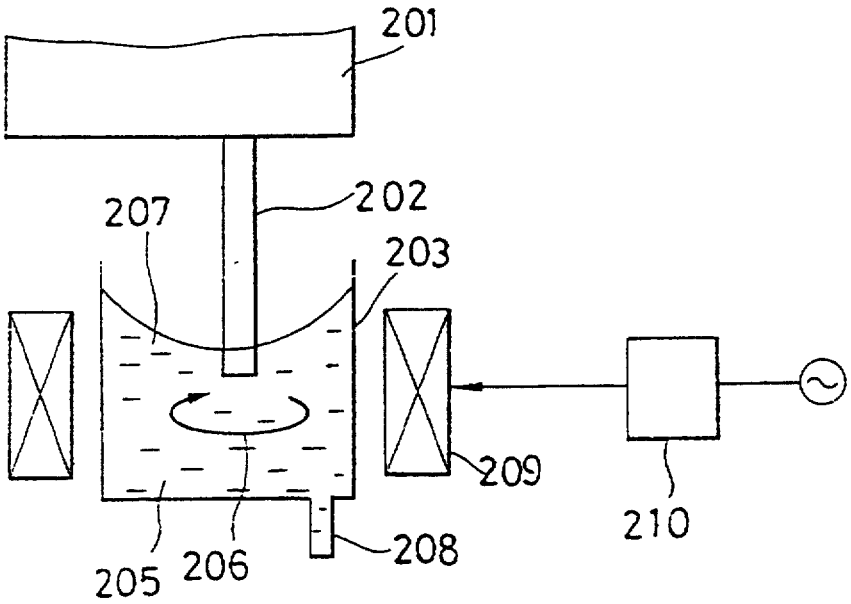
FIG. 67 is a flow diagram showing one example of the conventional molten steel processing apparatus.

(L) Control of Apparatus for Removing Non-Metallic Foreign Matter in Molten Steel At first, brief discussion will be given for the case of the continuous casting of the steel as one example of the non-metallic foreign matter removing apparatus employing the molten steel processing method in the tundish according the present invention. For example, as shown in FIG. 66, in the apparatus combining a ladle (not shown), a tundish 203 and a mold (not show), a molten metal 207 in the ladle is poured in the tundish 203.

In the tundish 203, the rotational force is provided to the molten metal 297 in the tundish 203 by the shifting field generating electromagnetic coil 209. At this time, a part of the molten metal 207 flowing in swirl fashion is poured in the mold through a nozzle 208 provided through the bottom of the tundish 203 to be casted in a predetermined dimension.

Accordingly, in the process set forth above, the non-metallic foreign matter is separated from the molten metal 207 in the tundish 203, and the purified molten metal is poured into the mold.

The construction of the present invention will be discussed with reference to FIG. 66. Sensors 211 and 212 for detecting distance to the molten steel surface are provided above the swirl center and the outer peripheral edge of the molten steel in the tundish 203.

Assuming that the distances to the molten steel surface are $l_1$ (m) and $l_2$ (m), the depth Z (m) of the concaved surface due to swirl flow of the molten steel can be expressed by:

$$Z = l_1 - l_2 \quad (1)$$

The relationship between the depth Z (m) of the concaved surface and the rotation speed N (r.p.m.) of the molten steel can be expressed by the following equation with the radius of the swirl flow bath 205 of the tundish being r (m) and the gravitical weight being g:

$$N = \frac{30\sqrt{2gZ}}{\pi r}$$

Accordingly, by knowing the depth Z of the concaved surface formed by swirl flow of the molten steel 207, the rotation speed N (r.p.m.) can be calculated.

Thus, by employing this method for detecting the rotation speed, it becomes possible to control the rotational speed appropriate at respective stage of operation.

As the sensors 211 and 212, microwave level gauges can be employed.

On the other hand, as a method for controlling the rotation force, there is a method, in which a controller 213 and a setting device 214 are employed; a pattern of appropriate rotation speeds at respective stages of operation based on the operational experience is preliminary input to the setting device 214; the rotation speed N is calculated by inputting the signals from the sensors 211 and 212 to the controller 213 and compared with the output signal from the setting device 214; and a power source device 210 is controlled on the basis of the result.

Since the present invention is constructed as set forth above, appropriate rotation speeds can be provided for the molten steel at respective stages of operation in processing the molten steel in the tundish by detecting the rotation speed of the molten steel. Therefore, throughout the overall period of casting, good slab quality can be obtained.

(M) Others

It should be noted that when the molten steel is poured into the swirl flow phase in the tundish from the nozzle of the ladle, it can be poured to the swirl center of the swirl flow phase or at a desired position offset from swirl center. Also, the nozzle of the ladle may be submerged or not submerged into the swirl flow phase in the tundish.

Concrete discussion for the present invention will be given herebelow in terms of examples.

Example 1

The tundish moving apparatus according to the first aspect of the invention, as illustrated in FIGS. 5 and 6 was employed. Initially, the tundish 3 was positioned, and then the coil 12 is positioned in opposition at close proximity to the former. Then, ten continuous charges of pouring of the molten steel (tin plate material) was performed for the same tundish 3, and then the tundish 3 was replaced. In this replacement, no abnormality was caused on the coil. The replacing operation, which conventionally took 80 minutes, could be completed in 30 minutes. Therefore, the period for the replacing operation can be shorted for approximately 50 minutes. In the foregoing embodiment, the similar effect could be obtained even when the coil 12 is initially positioned and the tundish 3 is positioned thereafter.

With the shown aspect, the period for the tundish replacing operation can be shorted for approximately 50 minutes in comparison with the tundish operation in the conventional tundish 3 mounted thereon the coil 12. The primary factor of this resides on connecting operation of the cable. For absorbing heat of the coil due to Juele heat, the coil is cooled by the water. Furthermore, the cable does not have sufficient flexibility. Therefore, the cable connecting operation has been considered as lead load work. Accordingly, when the coil is moved according to the present invention, since the cable can be connected through the cable bearer, it can provide an advantage that the replacement of only the tundish 3 body is required.

On the other hand, with the construction set forth above, the maintenance of the tundish can be facilitated. Namely, tundish 3 is required to be replaced with a repaired tundish due to melting of the lining brick or so forth after several charged or several tens charged at the longest. At this time, by handling the tundish with the moving means according to the present invention, problems associated with handling of the tundish could be solved. The tundish replacement operation means replacing of the used tundish on the arm 24 with a new tundish. For this, it may be effective to provide two arms 24 and the tundishes are replaced by pivotal motion thereof.

Example 2

Figure 15:
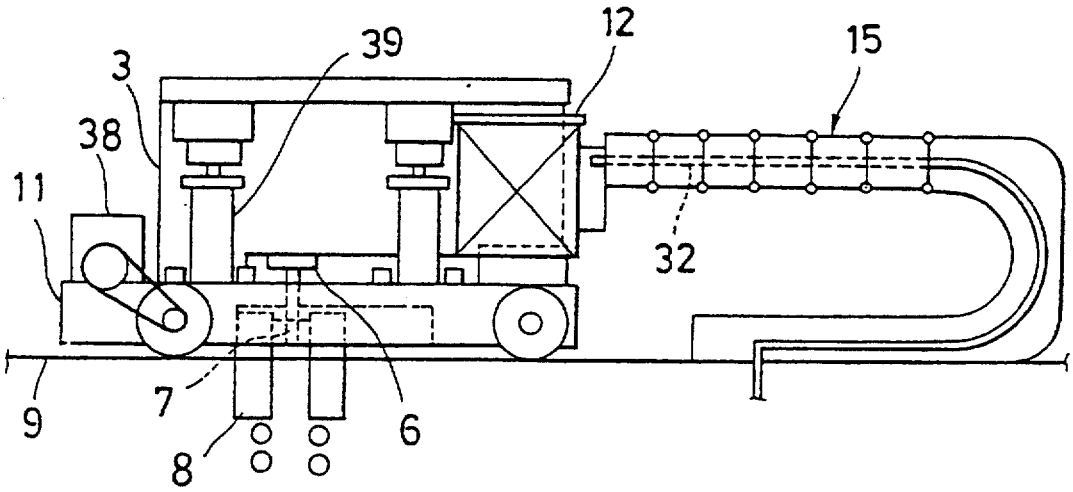
FIG. 15 is a side elevation of the moving apparatus of FIG. 14.

The second aspect of the tundish moving apparatus as illustrated in FIGS. 14 and 15 is employed. The ten continuous charges of pouring of the molten steel (tin plate material) was performed for the same tundish 3, and then the tundish 3 was replaced. In this replacement, no abnormality was caused on the coil. The replacing operation, which conventionally took 80 minutes, could be completed in 30 minutes. Therefore, the period for the replacing operation can be shorted for approximately 50 minutes. It should be noted that the each condition of the moving apparatus was as set out below.

Moving Base: The moving base having the tundish mounting base with the lifting means;
Tundish Capacity: 15 tons;
Diameter of Swirl Flow Bath: 1000 mm
Coil: Dynamic field generating coil
Cable Bearer: Caterpillar type Example 3

Figure 21A:
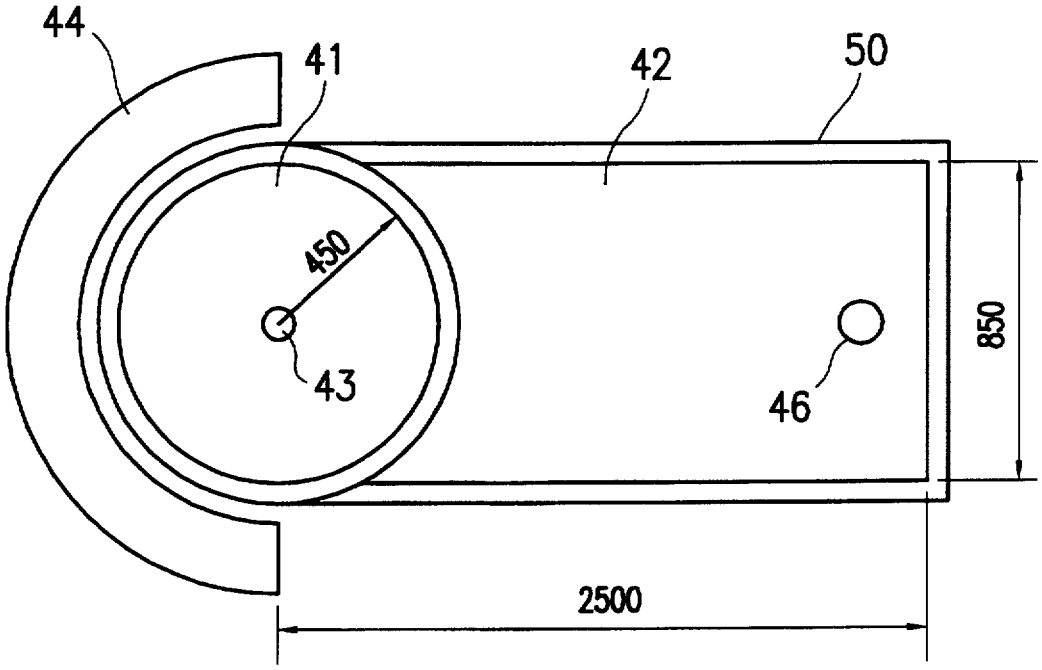
FIGS. 21*a* and 21*b* are diagrammatic illustrations showing dimensions of the facility according to the present invention used in the embodiment, in which (a) is a plan view and (b) is a cross section.
Figure 21B:
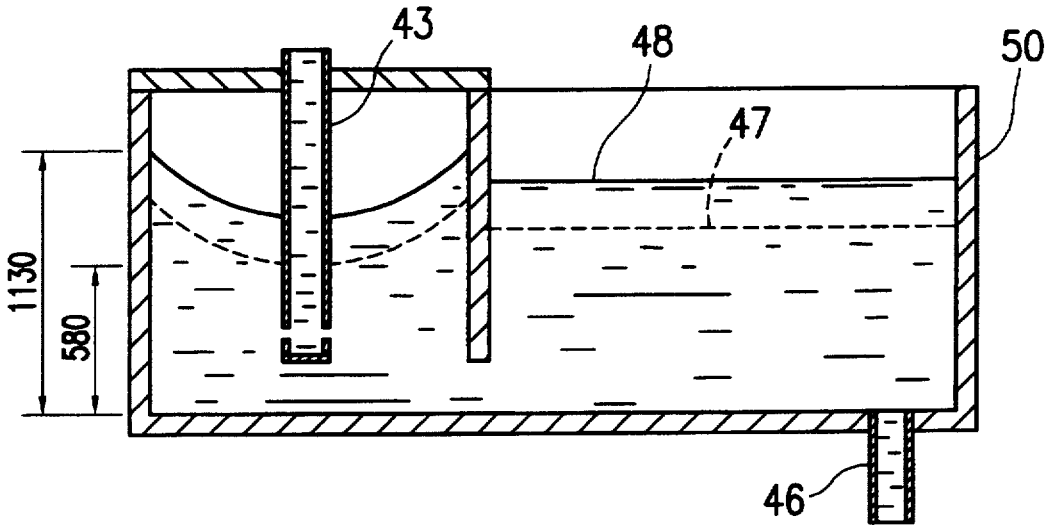

One example (invention) of the non-metallic foreign matter removing apparatus having the swirl flow bath of the invention and the floatation bath, which is greatly improved by the use of formulae (1) and (8) in order to satisfy the operating condition shown in table 1, is illustrated in FIG. 21 with dimensions (unit: mm).

Figure 22:
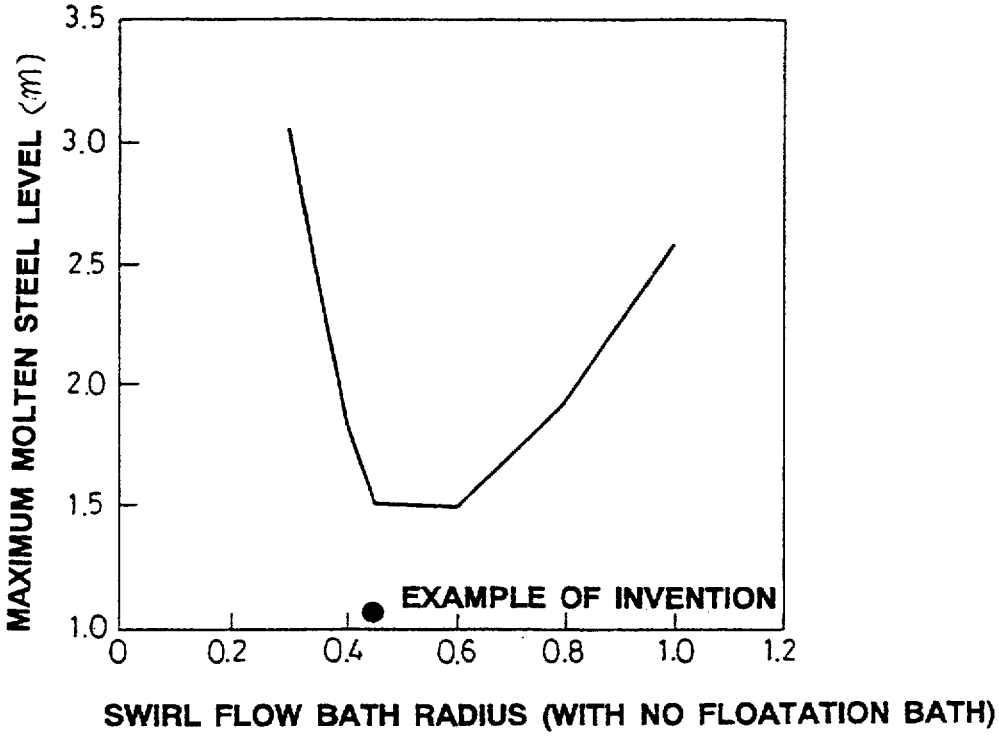
FIG. 22 is an illustration showing a relationship between a radius of the swirl flow bath and a maximum molten metal level in case of a facility solely having the swirl flow bath.

Conversely, under the condition of table 1, in case of the facility (comparative example) illustrated in FIG. 19, which does not have the floatation bath, with taking the minimum molten metal level being higher than or equal to 0.5 m ($=0.47\times1.2^{\frac{1}{2}}$), in order to certainly maintain 3 minutes of the set dwell period in the swirl flow bath, the height has to be determined based on the constraint of set dwell period in the swirl flow bath in case that the swirl flow bath radius is smaller than or equal to 0.46 m, and based on the constraint of the minimum molten metal level upon the ladle replacement in case that the swirl flow bath radius is greater than or equal to 0.46 m from the formulae (1) and (3). Therefore, in case of the comparative example, the height of the facility as illustrated in FIG. 22 is required. Even at the minimum height in FIG. 22, the maximum level of the molten steel reaches 1.52 m. Therefore, the height of the facility has to be approximately 400 mm higher than the example of the invention illustrated in FIG. 21. Increasing of the height of the tundish causes substantial increase of the cost for facility due to increasing of the height of building. Also, when it is applied to the existing continuous casting facility, it often becomes impossible to realize due to constraint of the facility. Furthermore, when the radius of the swirl flow bath to minimize the facility is employed, only about d tons of molten steel can be obtained to encounter the problem to make it difficult to certainly maintain the molten steel level.

In contrast to this, according to the example of the invention, it becomes possible not only to lower the necessary height than that in the comparative example, but also to adjust the molten steel capacity by the size of the floatation bath.

Figure 23:
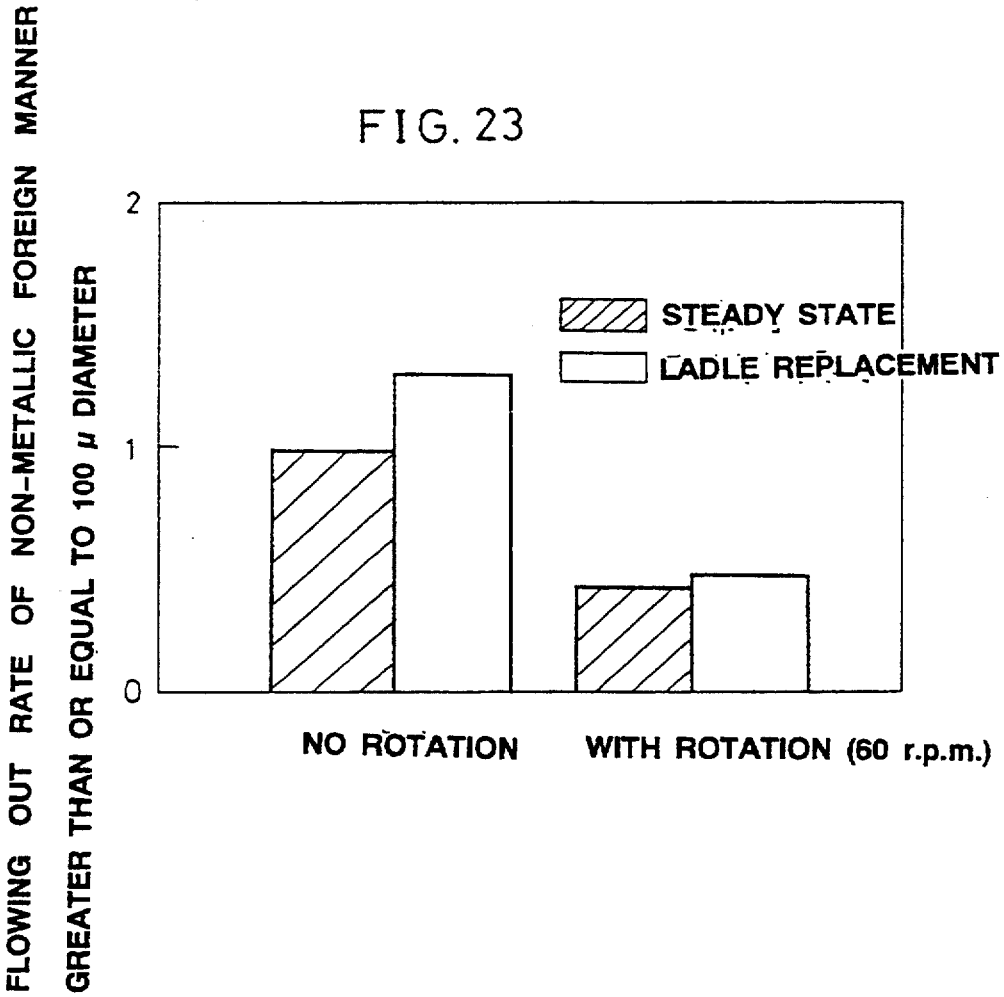
FIG. 23 is an illustration showing results of experiments performed on the embodiment.

In the experiments, number of non-metallic foreign matter was measured by analyzing the samples obtained at the discharge opening during casting in the condition illustrated in FIG. 21 and the table 1. In FIG. 23, there is shown the comparison of the ratio of the non-metallic foreign matter in cases swirl flow in the swirl flow bath is provided and not provided.

From FIG. 23, it can be seen that the substantial amount of the non-metallic foreign matter in the molten steel can be removed by the removing apparatus according to the present invention and the effect can be maintained even at the ladle replacement.

TABLE 1

| Item | Content |
|---|---|
| Ladle Capacity | 100 tons |
| Kind of Casting Steel | Ferrite type Stainless Steel (SUS 430) |
| Molten Steel Flowing Out Amount | 1.2 tons/min |
| Molten Steel Rotation Speed in Swirl Flow Bath | 60 r.p.m. (1.20 $\pi$rad/min) |
| Ladle Replacing Period | 2 min |
| Set Dwell Period in Swirl Flow Bath | 3 min |

Example 4

Employing the tundish illustrated in FIGS. 26 and 27, the continuous casting of the molten steel (tin plate material) was performed for producing a cast block. The conditions of production are set as shown in the following table.

TABLE 2

| Type of Caster | Vertical Bending Type |
|---|---|
| Ladle Container | 160 tons |
| Tundish Capacity | 25 tons |
| Slab Size | 200 × 1240 mm |
| Molten Steel Pouring Speed | 1.5–4.0 ton/min |

Figure 30:
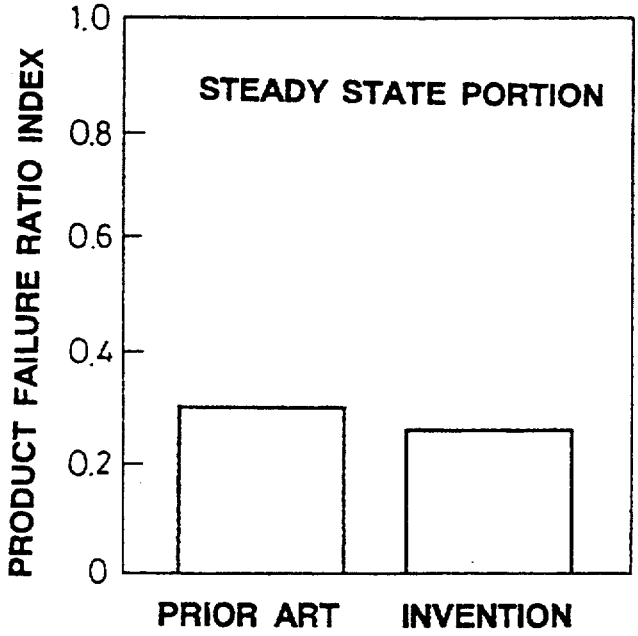
FIG. 30 is a graph showing a product fault rate index at the steady state portion.
Figure 31:
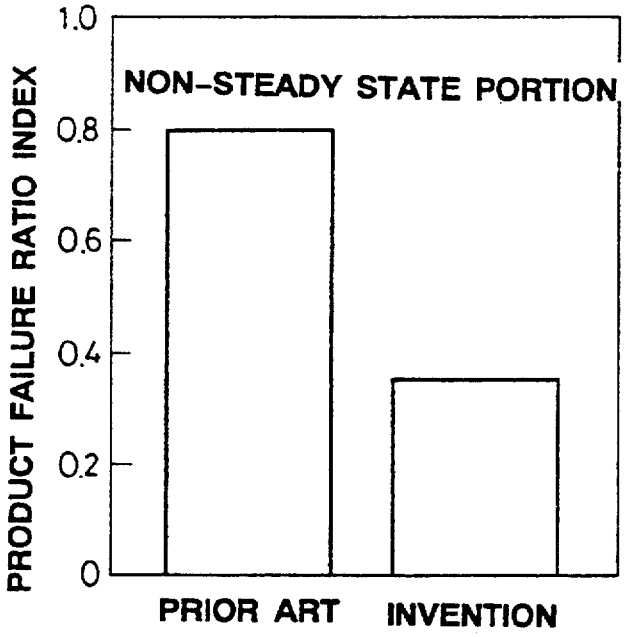
FIG. 31 is a graph showing a product fault rate index at the non-steady state portion.
Figure 32:
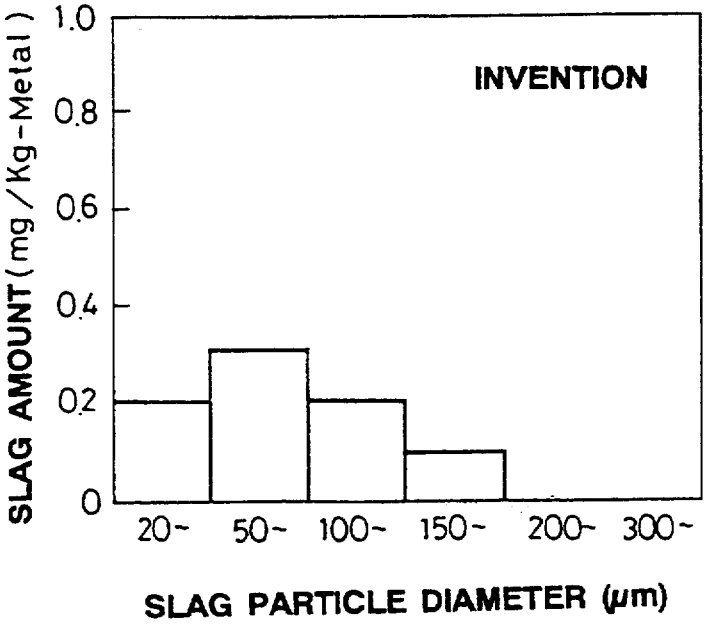
FIG. 32 is a chart snowing grain distribution in a slag in the method of the present invention.
Figure 33:
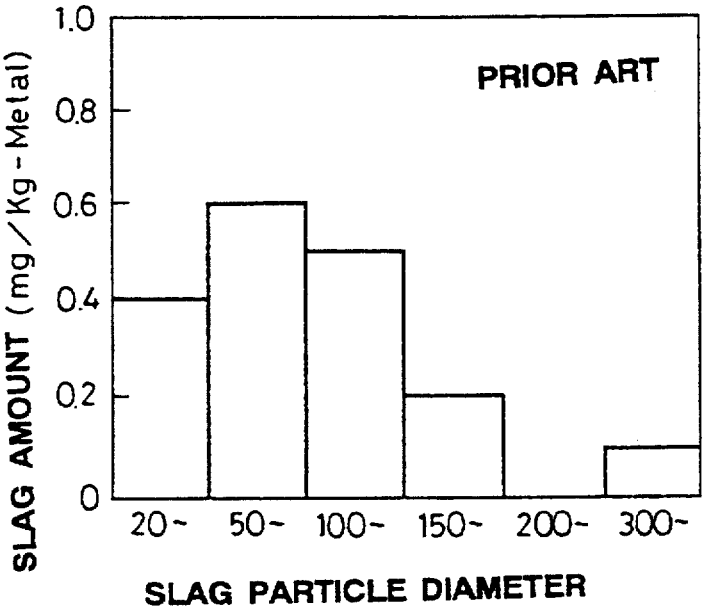
FIG. 33 is a chart showing grain distribution in the slag in the conventional method.
Figure 34:
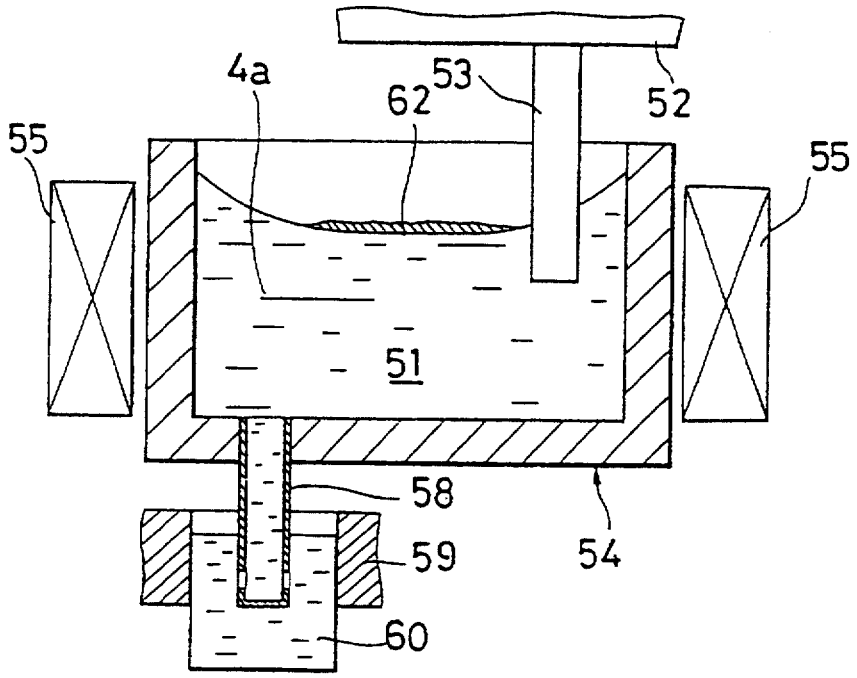
FIG. 34 is a section showing one example of the conventional intermediate container.
Figure 35:
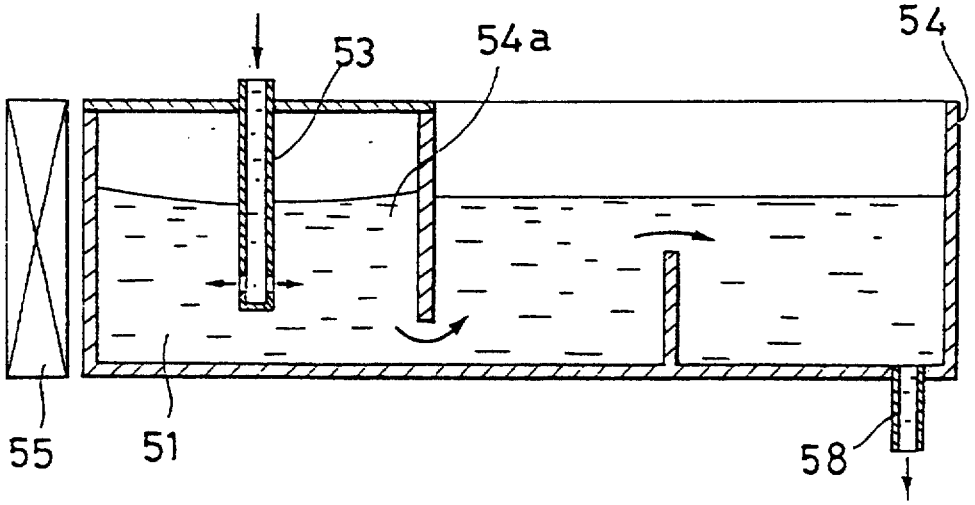
FIG. 35 is a section showing another example of the conventional intermediate container.

In FIGS. 30 and 31, a ,result of a magnetic flaw detecting inspection in production for the cold rolled sheet material. For comparison, the conventional method is shown in FIG. 34. With respect to the product fault index, no substantial difference could be seen at the steady state portion. However, at the non-steady state, it can be found that the index in the method of the invention is much smaller in than that in the conventional method. Also, samples at the same charge was obtained by slime extraction. Comparison of the slag amount therein is shown in FIGS. 32 and 33. Clearly, the slag amount is reduced in the method of the present invention in comparison with the conventional method and it can be appreciated that the foreign matter can be effectively floated and separated by the method of the invention.

Example 5

Figure 37:
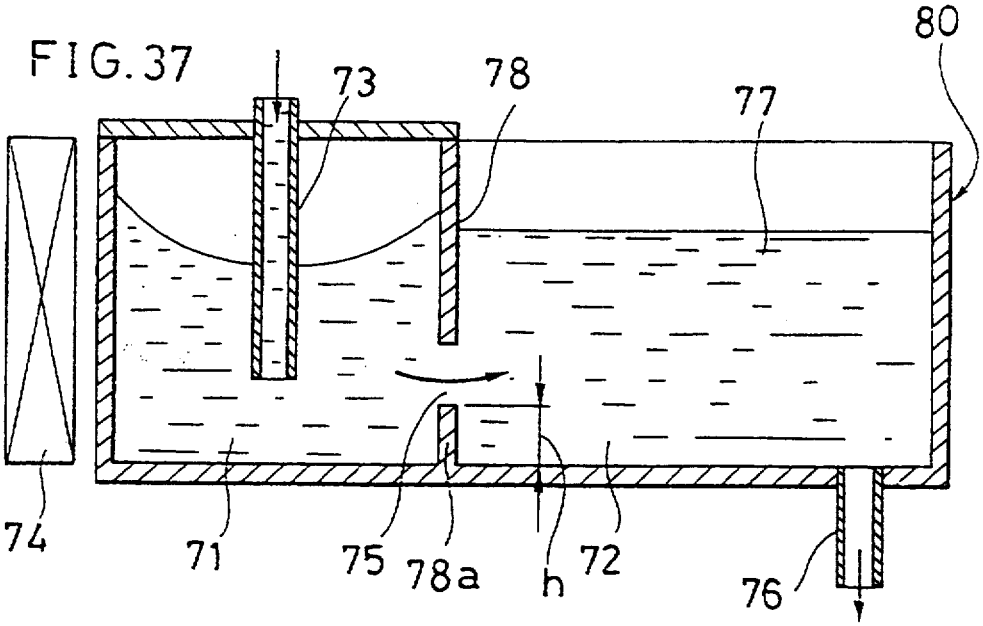
FIG. 37 is a longitudinal section of the apparatus of FIG. 36.

Employing the tundish shown in FIGS. 36 and 37, the molten steel (tin plate material) was continuously poured to the same tundish for 10 charges.

Each condition is as set out below.

| | |
|---|---|
| Flow Rate from Swirl Flow Bath to Floatation Bath (t/min) | 3.0 |
| Height of Baffle (h) (mm) | 50 |
| Flow Velocity (m/sec) | 0.1 |
| Baffle Position | Immediately below Partition |
| Molten Steel Density (t/m$^3$) | 7.2 |

From this result, the amount of the foreign matter in the molten steel after flowing out from the tundish was very small, i.e. 0.05 mg/kg.

Example 6

Employing the tundish 90 and the coil device 85, the molten steel (tin plate material) was continuously poured to produce a cast block. Each condition is as set out below.

Figure 42:
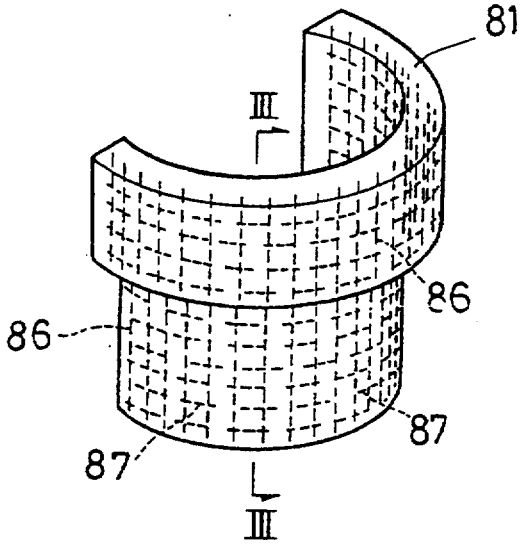
FIG. 42 is a perspective view of a non-conductive container portion showing another embodiment of the invention.

| | |
|---|---|
| Tundish Capacity | 20t |
| Swirl Flow Bath Radius | 1000 mm |
| Refractory | 300 mm thick Basic Brick |
| Iron Skin | 350° C. |
| Coil Device | Linear Type Semi-circular Coil |
| Material of Non-Conductive Body Container Portion | $Al_2O_3$, with vertical reinforcement (3 mm diameter) and lateral reinforcement of 3 mm over entire circumference (arranged as shown in FIG. 42) |

During operation, no vibration was induced in the tundish, and stable steel quality was obtained. On the other hand, after 90 changers of continuous casting, no loosing of the joint among the refractories 88 in the tundish 90 was caused.

Example 7

Employing the tundish 91 illustrated in FIG. 44, the molten steel (tin plate material) was continuously poured for casing a cast block.

The inner diameter of the tundish 91 was 1 m, and the molten steel depth was 1 m. On the outer periphery of this tundish, the vertically arranged two channels of shifting field generation coils 93 are provided. The height of each coil was 0.5 m. For the lower coil for rotating stirring, 3 Hz, 1500 A of current was applied. For the upper coil for heating, 50 Hz, 400 A of current was applied.

As a result, 300 Kw of heating power was obtained. With respect to the flow of the molten steel, the vertical reversing flow by the heating coil was not generated, and 40 r.p.m. of rotation was induced to reduce the foreign matter to one fifth in comparison to that obtained without rotation, as the effect of separation of the foreign matter.

Example 8

Figure 47:
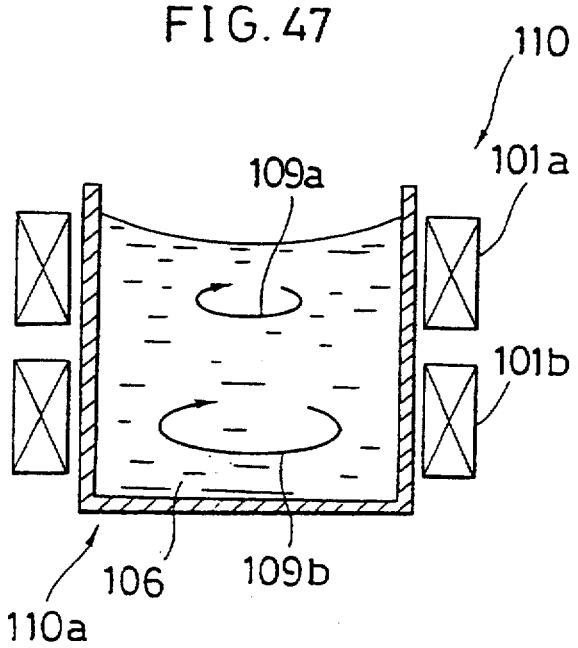
FIG. 47 is a section of the tundish showing one embodiment of the invention.
Figure 48:
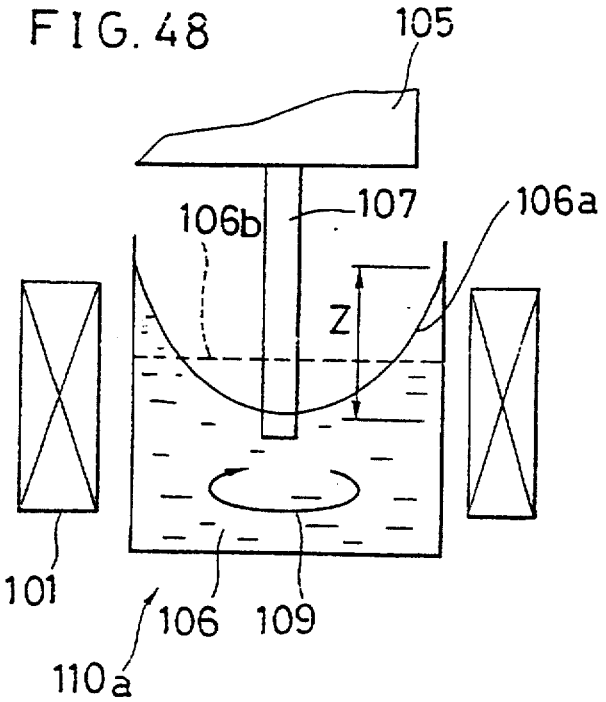
FIG. 48 is an explanatory illustration showing rotating condition of the molten steel in the conventional tundish.
Figure 49:
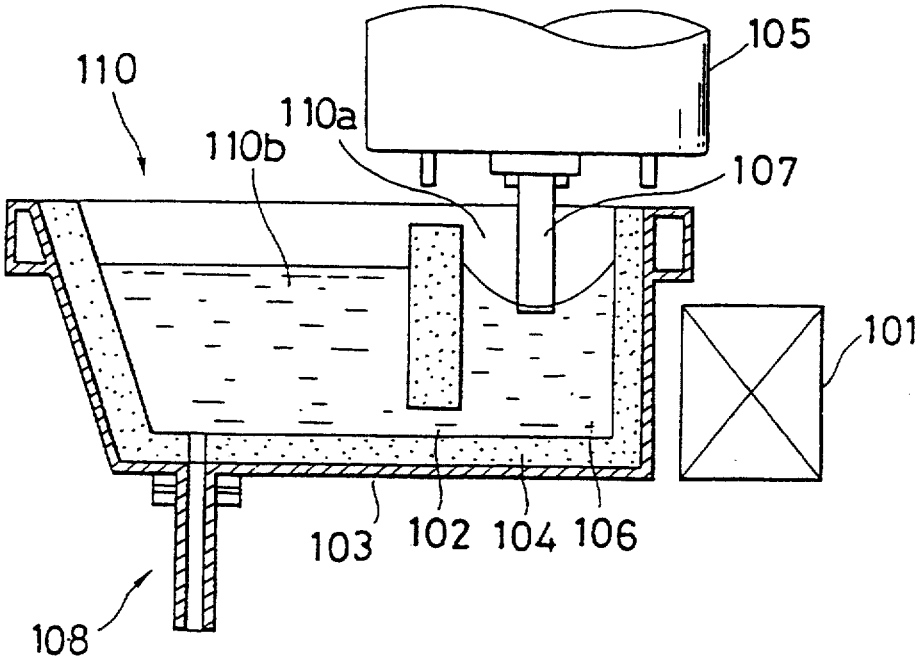
FIG. 49 is a section showing one example of the conventional tundish.
Figure 50:
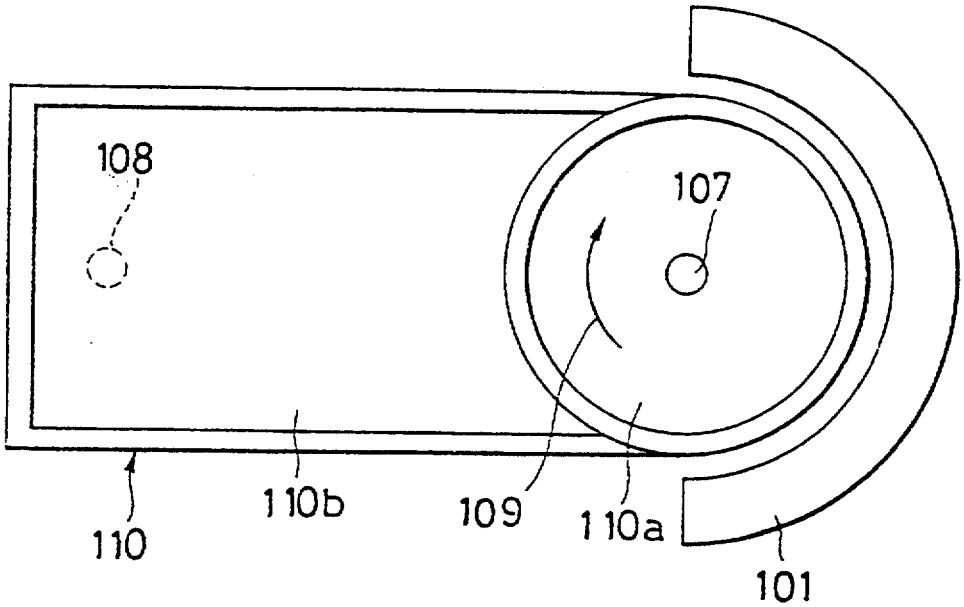
FIG. 50 is an explanatory plan view of the tundish illustrated in FIG. 49.

Employing the tundish 110 illustrated in FIG. 47, molten steel (tin plate material) was continuously poured to produce a cast product.

The inner diameter of the swirl flow bath 110*a* of the tundish 110 was 1 m, and the molten steel depth (static molten steel surface) was 1 m. On the outer circumference, the upper and lower two channels of shifting filed generation coils 101*a* and 101*b* are provided. Height of each coil was 0.3 m and 0.66 m. For the upper coil, 200 A of current was applied, and for the lower coil, 1000 A of current was applied As a result, the upper phase molten steel and the lower phase molten steel are rotated respectively at 10 r.p.m. and 60 r.p.m.

The depth (Z) of the concaved surface of the molten metal surface was 1.4 cm which does not require change of the length of the submerged nozzle 107, oxidation of the molten steel surface was the normal level, the foreign matter separation effect was equivalent to the case where 50 r.p.m. of rotation is induced by a single shifting field, and the resultant cast block quality was good.

Example 9

Figure 52:
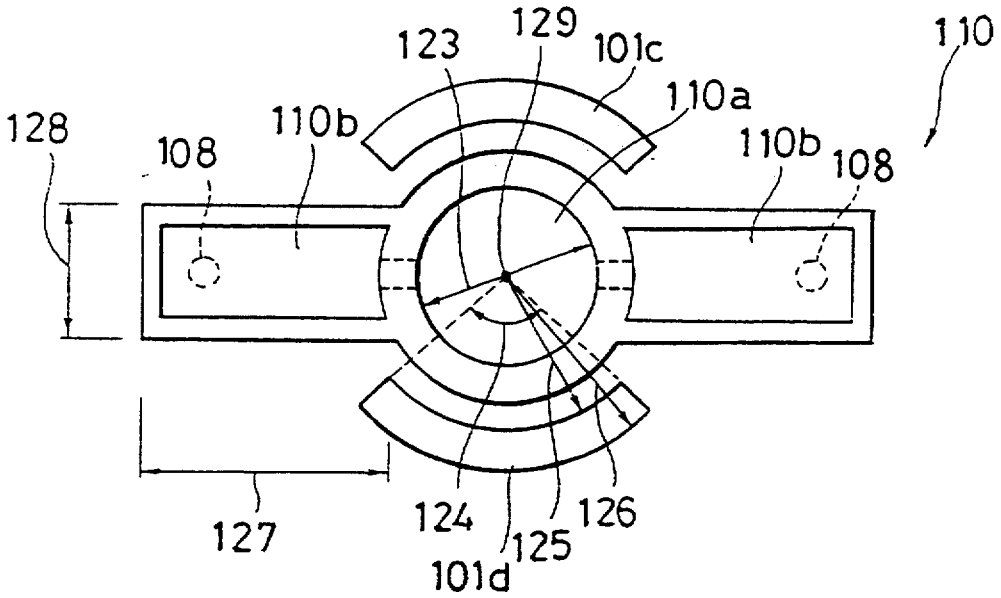
FIG. 52 is an illustration showing a arrangement of one embodiment of the tundish of the invention.

Employing the tundish 110 illustrated in FIG. 52, the molten steel (Lit plate material) was continuously poured to produce a cast block.

With respect to the tundish 110 having 1 m of the inner diameter 123 of the swirl flow bath 110*a*, the shifting field generation coil devices 101*c* and 10*d* respectively have the 110° of arc angle with respect to the molten steel swirl center 129 in the swirl flow bath 110*a* and have 1 m of the inner radius 125 from the molten steel swirl center 129 to the coil devices 101*c* and 101*d*, and 1.6 m of the outer radius 126, are arranged. For the coil 101*c* and 101*d*, 3 Hz and 2000 A of current was applied.

Each electrodes forming the coil devices 101*c* and 101*d* are arranged at substantially symmetric position with respect to the swirl center 129 of the molten steel in the swirl flow bath 110*a*. Different polarities are provided for these electrodes. When the same polarity is provided for the opposing electrodes, the rotation speed obtained was 10 r.p.m., and whereas 40 r.p.m. was obtained in the example of the present invention. At this time, the foreign matter separating performance was four times of that in the same polarity.

It should be noted that the length 27 and the width 28 of the floatation bath 110*b* were 2 m and 1 m.

Example 10

Figure 56:
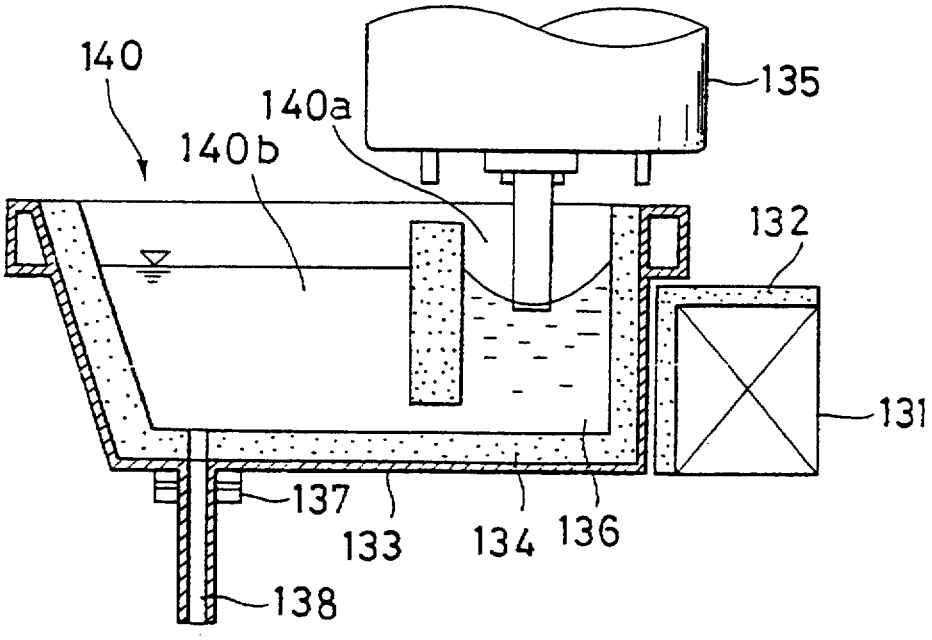
FIG. 56 is a section of the tundish, to which the coil device showing one embodiment of the invention is provided.

Employing the tundish 140 and the coil device 131 illustrated in FIG. 56, the molten steel (tin plate material) was continuously poured for producing a cast block. Each condition is as set out above.

| | |
|---|---|
| Tundish Capacity | 25 tons |
| Swirl Flow Bath Diameter | 1000 mm |
| Refractory | 25 mm thick alumina type castable refractory |
| Coil Device | linear type semi-circular coil |
| Iron Skin | 10 mm thick |
| Molten Steel Temperature | 1550° C. |
| Heat Insulation Material | 20 mm tick |

-continued

| | |
|---|---|
| (Coil Outer Periphery) | alumina type castable refractory |
| Heat Insulation Material (Coil Upper Surface) | 20 mm thick alumina type castable refractory |

During operation, the temperature at the surface of the coil device 131 opposing to the tundish 140 was maintained at 100° C., and the operation of the coil device 131 was held stable.

It to should be noted that, in case of no heat insulation material was employed for comparison, the temperature at the same portion of the coil device 131 was 200° C.

Example 11

Employing the tundish 150 illustrated in FIG. 57 and the coil device 1 having the cooling device 153 illustrated in FIG. 58, the molten steel (tin plate material) was continuously poured for producing a cast block. Each condition is as set out above.

| | |
|---|---|
| Tundish Capacity | 20 tons |
| Swirl Flow Bath Diameter | 1000 mm |
| Refractory | 300 mm thick basic flowable refractory |
| Iron Skin | 10 mm thick |
| Molten Steel Temperature | 1570° C. |
| Coil Device | linear type semi-circular coil |
| Heat Insulation Material (Coil Outer Periphery) | 25 mm tick alumina type castable refractory |
| Heat Insulation Material (Coil Upper Surface) | 20 mm thick alumina type castable refractory |
| Cooling Water Inlet Temperature | 20° C. |
| Cooling Water Outlet Temperature | 28° C. |

During operation, the temperature at the surface of the coil device 141 opposing to the tundish 150 was maintained at 40° C., and the operation of the coil device 141 was held stable.

It to should be noted that, in case of no heat insulation material was employed for comparison, the temperature at the same portion of the coil device 141 was 200° C.

Example 12

Employing the tundish 170 and the coil device 161 having the cooling device 162 illustrated in FIG. 60, the molten steel (tin plate material) was continuously poured for producing a cast block. Each condition is as set out above.

| | |
|---|---|
| Tundish Capacity | 15 tons |
| Swirl Flow Bath Diameter | 1000 mm |
| Refractory | 300 mm thick basic brick |
| Iron Skin | 10 mm thick |
| Molten Steel Temperature | 1550° C. |
| Coil Device | linear type semi-circular coil |
| Gap between Tundish and Coil Device | 70 mm |
| Cooling Fluid and Flow Velocity | air, 10 m/s |

During operation, the temperature at the surfaces of the coil device 161 opposing to the tundish 170 and the opposing iron skin 163 were maintained respectively at 100° C. and 350° C.

It to should be noted that, in case of no heat insulation material was employed for comparison, the temperature at the same portion of the coil device 161 and the iron skin 163 opposing thereto were 200° C. and 450° C.

On the other hand, the temperature of the iron skin 163 did not rise permitting long duration of use without causing deformations or cracks. Also, rising of the temperature of the coil device 161 could be suppressed to allow using for a long period with stable performance.

Example 13

Figure 64:
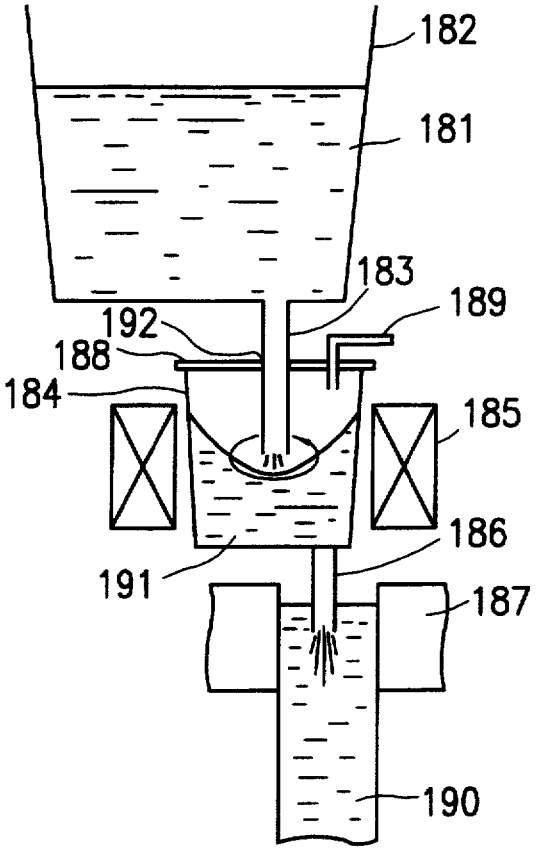
FIG. 64 is an illustration showing a casting method according to the present invention.

SUS 430 of heat size 100 t is cashed at a rate of 2 t/min into slab of 200×1240 mm size in the matter illustrated in FIG. 64. Namely, the molten steel 181 was poured into the molten steel swirl center in the tundish 184 from the ladle 182 to perform casting. During casting, the ladle was replaced to continuously perform casting for 300 t in total. In the tundish, the molten steel was flown in swirl fashion at the speed of approximately 40 to 60 r.p.m. The inside of the container was purged by Ar through an induction pipe 189. The capacity of the container was about 6 t. To the swirl center position of the tundish having radius of 0.6 m, the molten steel was poured through the nozzle 183 of the ladle 182.

The sampling was performed every several minutes from the inside of the mold 187. Then, total oxygen amount was analyzed. Variation of the total oxygen amount in time sequence is shown in FIG. 65.

Figure 65:
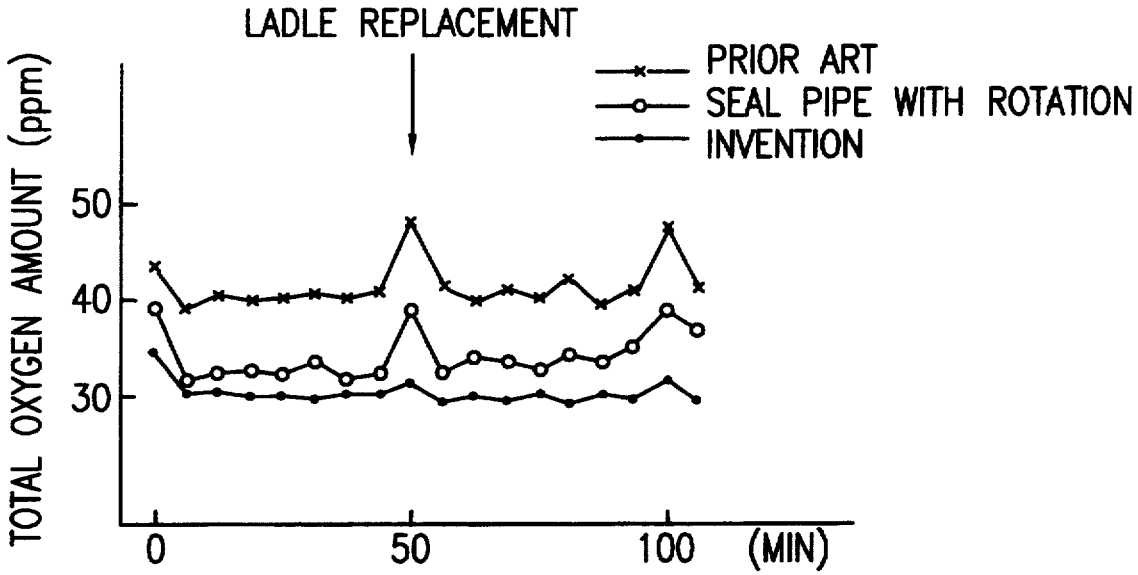
FIG. 65 is an illustration showing the result of an example 13.

Also, in FIG. 65, the results of casting with rotation by the magnet using the conventional method (shown in FIG. 62) and the method employing the seal pipe 194 are also shown as comparative examples. Here, in the conventional method, a container having a capacity of 12 t with double gate and without means for providing rotational force, is used as the tundish. On the other hand, in the method employing the seal pipe, although the rotational force is applied in the same condition in the tundish the conventional pouring method is used. The pouring position from the ladle to the tundish was the swirl center. It should be noted that the molten steel used in these examples had 35 to 37 ppm of total oxygen upon finishing of ladle refining. No difference in condition was present.

As can be clear from FIG. 65, by providing magnetic rotation for the molten metal in the tundish, separation of the non-metallic foreign matter is promoted to reduce the total oxygen amount in the cast block. Even when the same rotation of the molten metal is performed it should be understood that oxidation of the molten steel can be suppressed either at the steady state portion and the non-steady state portion by employing the pouring method according to the present invention.

Example 14

As shown in FIG. 66, microwave level gauges are mounted as sensors 211 and 212 for detecting the distance to the molten metal surface from the upper end of the tundish 203 having an inner diameter of 1 m. Assuming respective of detected length are $l_1$ and $l_2$, the depth Z of the concaved surface formed by rotation of the molten steel 207 can be calculated through the equation (1). From Z thus obtained, the rotation speed N of the molten steel 207 can be derived through the equation (2). The controller 213 received the signals from the microwave level gauges to calculate the rotation speed (N), and compared the rotation speed with the output signal from the setting device 214, in which an appropriate rotational speed pattern at respective stages of operation obtained or known from the experience of operations is preliminarily set, to control the power source device 210 of the shifting field generation coil 209.

It should be noted that the relationship between the detected distances $l_1$ and $l_2$ by the sensors 211 and 212 for detecting the distance to the molten steel surface, the depth Z of the concaved surface of the molten steel and the rotation speed N are varied at the initial stage of casting, steady casting state, ladle replacing state, and end stage of casting as shown in the following table 3.

TABLE 3

| | Initial Stace | Steady State | Ladle Replacing | End Stage |
|---|---|---|---|---|
| $l_1$ (m) | 0.9 | 0.624 | 0.75 | 0.9 |
| $l_2$ (m) | 0.4 | 0.4 | 0.4 | 0.4 |
| Z (m) | 0.5 | 0.224 | 0.35 | 0.5 |
| N (rpm) | 60 | 40 | 50 | 60 |

As set forth above, by detecting the rotation speed of the molten steel 207 in the tundish 203 and providing appropriate rotation speeds for the molten steel 207 are respective of the operational stages, good slab could be obtained throughout overall casing period.

INDUSTRIAL APPLICABILITY

It is very important for supplying purified molten steel, from which the non-metallic foreign matter is removed from the molten steel, to the mold. In order to purify the molten steel, the tundish is provided with the swirl flow bath and the floatation bath. With the coil arranged on the circumference of the swirl flow bath, the molten steel is flown in swirl fashion to float up the non-metallic foreign matter to the surface of the molten steel and the floated non-metallic foreign matter is removed. The molten steel removed the non-metallic foreign matter flows out to the floatation bath. With the static flow in the floatation bath, the residual non-metallic foreign matter float up. The molten steel thus purified is supplied to the mold from the bottom of the floatation bath. With such system, degree of removal of the non-metallic foreign matter in the molten steel can be significantly improved in comparison with that in the prior art.

On the other hand, the tundish and the coil are formed separately to have the construction allowing relative displacement to each other. Therefore, number of the coil can be smaller than the number of tundish to contribute lowering of the cost for facility. Also, since the tundish is formed separately from the coil and is movable relative to the later, the regular replacing operation of the tundish, repairing of the lining refractory brick of the tundish can be done easily and in short period.

We claim:

1. An apparatus for removing non-metallic foreign matters in a molten metal for continuous casting of the metal comprising:
   - a movable tundish for receiving and pouring molten metal, said tundish having a swirl flow bath;
   - a coil device for inducing a horizontal swirl flow of said molten metal around a swirling center in said swirl flow bath, wherein said coil device and said movable tundish are capable of undergoing a relative movement into and out of a close proximity to one another such that, when they are in a close proximity, a swirl flow can be induced in said swirl flow bath by said coil device;
   - a power supply means for said coil device; and
   - a system capable of detecting the depth of said molten metal at both the swirling center and at the periphery of said molten metal; calculating the swirling speed of said molten metal from the detected depths; and controlling the swirling speed of said molten metal in accordance with said calculated swirling speed.

2. An apparatus for removing non-metallic foreign matters in a molten metal for continuous casting of the metal comprising:
   - a movable tundish for receiving and pouring molten metal, said tundish having a swirl flow bath;
   - a coil device for inducing a horizontal swirl flow of molten metal around a swirling center in said swirl flow bath, wherein said coil device and said movable tundish are capable of undergoing a relative movement into and out of a close proximity to one another such that, when they are in a close proximity, a swirl flow can be induced in said swirl flow bath by said coil device;
   - said tundish being a vibration suppressive tundish wherein the part of said tundish within the electromagnetic field of said coil device mainly comprises non-electrically conductive material reinforced by a reinforcement which has at least one member selected front iron and carbon fiber reinforcements; and
   - a power supply means for said coil device.

3. A method for removing non-metallic foreign matter in a molten metal for continuous casting of the metal comprising the steps of:
   - receiving said molten metal into a movable tundish having a swirl flow bath;
   - inducing a horizontal swirl flow of the molten metal around a swirling center in said swirl flow bath to facilitate floating of the non-metallic foreign matters;
   - further floating said non-metallic foreign matters in a floatation bath which is in communication downstream of said swirl flow bath;
   - controlling the flow of said molten metal by the following relations:

$$h \geqq 0.47 \times q^{\frac{1}{3}} \quad (1)$$

and $$t_m \geqq 2 \quad (2)$$

- wherein h represents minimum depth in meter of the molten meal in the swirl flow bath;
   - q represents discharge rate in ton/min of the molten metal from the floatation bath, and $t_m$ represents average residence time in minute of the molten metal in the swirl flow bath;

$$h = \frac{q \times t_m}{\rho \times \pi \times r^2} - \frac{(r \times \omega)^2}{4g}, \text{ and} \quad (3)$$

$$H = \frac{q \times t_c}{\rho(a \times b + \pi \times r^2)} + \frac{(r \times \omega)^2}{4g} + \frac{q \times t_m}{\rho \times \pi \times r^2} \quad (4)$$

wherein H represents maximum depth in meter of the molten metal in the swirl flow bath;

$\rho$ represents specific weight in ton/m$^3$ of the molten metal;

$\omega$ represents horizontal rotation speed in rad/min of the molten metal in the swirl flow bath;

g represents acceleration of gravity in m/min$^2$; and $t_c$ represents maximum interval in minute of the pouring of the molten metal into the swirl flow bath.

4. An apparatus for removing non-metallic foreign matters in a molten metal for continuous casting of the metal comprising:

a movable tundish for receiving and pouring molten metal, said tundish having a swirl flow bath;

a coil device for inducing a horizontal swirl flow of the molten metal around a swirling center in said swirl flow bath, wherein said coil device and said movable tundish are capable of undergoing a relative movement into and out of a close proximity to one another such that, when they are in a close proximity, swirl flow can be induced in said swirl flow bath by said coil device; and a power supply means for said coil device;

a floatation bath in communication with said swirl flow bath, downstream of said swirl flow bath for further floatation of the non-metallic foreign matters;

said floatation bath being partitioned from said swirl flow bath by a partition between the swirl flow bath and the floating bath to allow for communication of the molten metal through an opening defined below the partition;

said swirl flow bath having a radius r and said floatation bath having a depth a and a width b sized according to the following relations:

$$h \geqq 0.47 \times q^{\frac{1}{3}} \quad (1)$$

and $$t_m \geqq 2 \quad (2)$$

wherein h represents minimum depth in meter of the molten meal in the swirl flow bath;

q represents discharge rate in ton/min of the molten metal from the floatation bath; and $t_m$ represents average residence time in minute of the molten metal in the swirl flow bath.

$$h = \frac{q \times t_m}{\rho \times \pi \times r^2} - \frac{(r \times \omega)^2}{4g}, \text{ and} \quad (3)$$

$$H = \frac{q \times t_c}{\rho(a \times b + \pi \times r^2)} + \frac{(r \times \omega)^2}{4g} + \frac{q \times t_m}{\rho \times \pi \times r^2} \quad (4)$$

wherein H represents maximum depth in meter of the molten metal in the swirl flow bath;

$\rho$ represents specific weight in ton/m$^3$ of the molten metal;

$\omega$ represents horizontal rotation speed in rad/min of the molten metal in the swirl flow bath;

g represents acceleration of gravity in m/min$^2$; and $t_c$ represents maximum interval in minute of the pouring of the molten metal into the swirl flow bath.

5. An apparatus according to claim 2, wherein said tundish is moved by a traveling or pivoting means.

6. An apparatus according to claim 2, wherein said coil device is moved by a lifting means.

7. An apparatus according to claim 2, wherein said coil device is moved by a traveling or pivoting means.

8. An apparatus according to claim 2, wherein said tundish and said coil device are movable mounted on a movable base.

9. An apparatus according to claim 8, wherein said movable base has a guide for positioning said tundish in relation to said coil device.

10. An apparatus according to claim 2, wherein said tundish comprises:

a swirl flow bath into which the molten metal is poured and in which said horizontal swirl flow is induced by said coil device to facilitate floating of the non-metallic foreign matters; and a floatation bath in communication with said swirl flow bath and in the downstream of said swirl flow bath provided for the purpose of further floatation of the non-metallic foreign matters, the molten metal being discharged from the floatation bath;

said floatation bath being partitioned from said swirl flow bath by a partition between the swirl flow bath and the floating bath to allow for communication of the molten metal through an opening defined below the partition.

11. An apparatus according to claim 2, wherein said tundish comprises:

a receptacle bath into which the molten metal is poured; and a swirl flow bath in communication with said receptacle bath and in the downstream of said receptacle bath, the molten metal being discharged from the swirl flow bath;

said swirl flow bath being partitioned from said receptacle bath by a partition between the receptacle bath and the swirl flow bath to allow for communication of the molten metal through an opening defined below the partition.

12. An apparatus according to claim 2, wherein said tundish comprises:

a receptacle bath into which the molten metal is poured;

a swirl flow bath in communication with said receptacle bath and in the downstream of said receptacle bath; and a flowing out bath in communication with said swirl flow bath and in the downstream of said swirl flow bath, the molten metal being discharged from the flowing out bath;

said swirl flow bath being partitioned from said receptacle bath by a partition between the receptacle bath and the swirl flow bath to allow for communication of the molten metal through an opening defined below the partition; and said flowing out bath being partitioned from said swirl flow bath by a partition between the swirl flow bath and the flowing out bath to allow for communication of the molten metal through an opening defined below the partition.

13. An apparatus according to claim 12, wherein the flowing out bath has a plurality of discharge openings.

14. An apparatus according to claim 10, wherein a baffling wall is further provided in the tundish on its bottom either immediately below the partition or in the downstream of the partition within the floatation bath to define an opening between the partition and the baffling wall.

15. An apparatus according to claim 2, wherein said coil device comprises a single coil.

16. An apparatus according to claim 2, wherein said coil device comprises a plurality of vertically aligned coils, and said coils are independently controllable for their frequency, current, and polarity.

17. An apparatus according to claim 16, wherein said coils are independently controlled for their frequency, current, and polarity such that the swirling speed of the swirl flow induced in upper portion of the molten metal is smaller than that of lower portion of the molten metal.

18. An apparatus according to claim 2, wherein said tundish comprises:

a swirl flow bath into which the molten metal is poured and in which said horizontal swirl flow is induced by said coil device to facilitate floating of the non-metallic foreign matters; and a pair of floatation baths in communication with said swirl flow bath and in the downstream of said swirl flow bath, said floatation baths being arranged on opposite sides of said swirl flow bath for the purpose of further floatation of the non-metallic foreign matters, the molten metal being discharged from the floatation baths;

each of said floatation baths being partitioned from said swirl flow bath by a partition to allow for communication of the molten metal through an opening defined below the partition;

wherein said coil device comprises an plurality of electrode pairs, electrodes of said electrode pair being arranged on opposite sides of said swirl flow bath such that one electrode of the electrode pair has a polarity different from that of the other electrode of the pair.

19. An apparatus according to claim 2, wherein said coil device is thermally insulated from said tundish by an insulating member provided on the exterior of said coil device on the side facing said tundish.

20. An apparatus according to claim 2, further comprising a cooling device.

21. An apparatus according to claim 20, wherein said cooling device is a water jacket or a water pipe panel mounted on said coil device.

22. An apparatus according to claim 20, wherein said cooling device is mounted on the tundish on the side facing the coil device.

23. An apparatus, according to claim 20, wherein said cooling device is a device capable of injecting a cooling fluid into a gap between the tundish and the coil device.

24. An apparatus according to claim 23, wherein said cooling fluid is air.

25. An apparatus according to claim 2, wherein said tundish has a highly sealable cover to enable the interior of the tundish to be purged with an inert gas; and said cover has an opening at a position beyond the swirling center of the molten metal so that the molten metal can be introduced onto the swirling center of the molten metal through a refractory nozzle which is inserted through said opening, said refractory nozzle being dimensioned to avoid from becoming immersed in the swirling molten metal.

26. An apparatus according to claim 23, wherein said cooling fluid is air mixed with water mist.

* * * * *